US008932700B2

(12) United States Patent
Shimizu et al.

(10) Patent No.: US 8,932,700 B2
(45) Date of Patent: Jan. 13, 2015

(54) PANEL

(75) Inventors: Nobutaka Shimizu, Tokyo (JP); Koji Hanya, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 150 days.

(21) Appl. No.: 13/521,714

(22) PCT Filed: Jan. 13, 2011

(86) PCT No.: PCT/JP2011/050423

§ 371 (c)(1),
(2), (4) Date: Jul. 11, 2012

(87) PCT Pub. No.: WO2011/087047

PCT Pub. Date: Jul. 21, 2011

(65) Prior Publication Data

US 2012/0295065 A1 Nov. 22, 2012

(30) Foreign Application Priority Data

Jan. 13, 2010 (JP) ..... P2010-004858

(51) Int. Cl.
*B32B 1/00* (2006.01)
*E04C 2/32* (2006.01)

(52) U.S. Cl.
CPC ..... *E04C 2/326* (2013.01)
USPC ..... 428/174; 428/178; 428/179; 428/180; 52/789.1; 52/793.1

(58) Field of Classification Search
USPC ..... 428/174, 178, 179, 180, 603; 52/789.1, 52/793.1
See application file for complete search history.

(56) References Cited

U.S. PATENT DOCUMENTS

| | | | | |
|---|---|---|---|---|
| 1,000,694 | A | 8/1911 | Schaefer et al. | |
| 1,154,254 | A * | 9/1915 | Lachman | 29/897.32 |
| 2,086,857 | A * | 7/1937 | Derby | 29/411 |
| 2,813,652 | A * | 11/1957 | Parsons | 217/26.5 |
| 3,558,394 | A * | 1/1971 | Marby | 156/210 |
| 4,495,237 | A * | 1/1985 | Patterson | 428/178 |
| 2004/0096628 | A1 | 5/2004 | Saathoff et al. | |

FOREIGN PATENT DOCUMENTS

| | | | |
|---|---|---|---|
| CA | 2144295 | A1 | 9/1996 |
| DE | 3206163 | A1 | 9/1983 |
| DE | 4447239 | A1 | 7/1995 |
| DE | 10252207 | B3 | 2/2004 |

(Continued)

OTHER PUBLICATIONS

Machine transaltion of DE 10252207 cited by the applicant, Feb. 2004.*

(Continued)

*Primary Examiner* — Donald J Loney
(74) *Attorney, Agent, or Firm* — Birch, Stewart, Kolasch & Birch, LLP.

(57) ABSTRACT

A panel which includes, among protrusions protruding from a predetermined reference surface, flat sections being flush with the reference surface, and recesses being recessed from the reference surface, the protrusions, and the flat sections or recesses, wherein; when the panel includes the flat sections, the entire periphery of each of the protrusions is surrounded by the flat sections, and the entire periphery of each of the flat sections is surrounded by the protrusions, while when the panel includes the recesses, the entire periphery of each of the protrusions is surrounded by the recesses, and the entire periphery of each of the recesses is surrounded by the protrusions.

13 Claims, 30 Drawing Sheets

(56) References Cited

FOREIGN PATENT DOCUMENTS

| | | | |
|---|---|---|---|
| DE | 202008008440 | U1 | 11/2008 |
| EP | 1215037 | A1 | 6/2002 |
| GB | 2341195 | A | 3/2000 |
| JP | 63-187623 | U | 12/1988 |
| JP | 10-166481 | A | 6/1998 |
| JP | 2960402 | B1 | 10/1999 |
| JP | 2007-23661 | A | 2/2007 |
| JP | 2008-180125 | A | 8/2008 |
| JP | 2011-27248 | A | 2/2011 |
| JP | 2011-110847 | A | 6/2011 |
| TW | 200419052 | A | 10/2004 |
| WO | 2007/010868 | A1 | 1/2007 |
| WO | WO 2009/108712 | A2 | 9/2009 |

OTHER PUBLICATIONS

Notification of Transmittal of International Preliminary Report on Patentability (Forms PCT/IPEA/416 and PCT/IPEA/409) dated May 22, 2012.
International Search Report, issued in PCT/JP2011/050423, mailed on Feb. 15, 2011.
Office Action of JP-2011-527533, mailed on Oct. 18, 2011.
Taiwanese Office Action for Taiwanese Application No. 100101240 dated Jan. 21, 2013 with English translation.
Extended European Search Report dated Jun. 4, 2013 for European Application No. 11732917.7.

* cited by examiner (TOP FLAT SECTION AREA + INCLINED SECTION AREA)
/ (UPPER SURFACE SECTION AREA + BOTTOM SURFACE SECTION AREA)

(TOP FLAT SECTION AREA + INCLINED SECTION AREA)
/ (UPPER SURFACE SECTION AREA + BOTTOM SURFACE SECTION AREA)

PANEL

TECHNICAL FIELD

The present invention relates to a panel, in more detail, a panel which is formed in an overall plate shape, and which has, at least on one of the surfaces thereof, a plurality of protruding protrusions.

Priority is claimed on Japanese Patent Application No. 2010-004858, filed Jan. 13, 2010, the contents of which are incorporated herein by reference.

BACKGROUND ART

Heretofore, as an interior panel to be used for transport machinery such as rolling stock, automobiles, aircraft, or ships, and for building structures and the like, there has been proposed a light weight type highly rigid panel having protrusions and recesses provided in a zigzag pattern (for example, refer to Patent Document 1). This panel disclosed in Patent Document 1 is such that protrusions and recesses are formed side by side in two directions, namely the vertical direction and horizontal direction of a flat plate panel, and it is formed in a shape such that flat sections other than the protrusions and recesses are not formed linearly. Moreover, for a heat insulator to be used for heat insulation in a catalytic converter or a muffler of an automobile, there has been proposed a configuration in which protrusions are arranged side by side in two directions within a panel surface (for example, refer to Patent Document 2). In these panels, there are formed protrusions and recesses or just protrusions, arranged side by side in two directions within the panel surface, and thereby a higher level of rigidity is achieved for the same plate thickness compared to a flat plate with no protrusions or recesses formed thereon, or to a corrugated plate with protrusions and recesses formed only in one direction thereon.

RELATED ART DOCUMENTS

Patent Documents

[Patent Document 1] Japanese Patent Publication No. 2960402

[Patent Document 2] Japanese Unexamined Patent Application, First Publication No. 2008-180125

DISCLOSURE OF THE INVENTION

Problems to be Solved by the Invention

Incidentally, on a conventional panel, protrusions and recesses are provided in a zigzag pattern so that flat sections are not formed linearly, while the flat sections are continuously formed so as to surround these protrusions and recesses. Consequently there is a problem in that these continuous flat sections influence the bending rigidity and torsional rigidity of the entire panel, so that the level of rigidity of the panel cannot be sufficiently increased and the weight thereof cannot be sufficiently reduced.

An object of the present invention is to provide a panel which has a simple structure and is capable of reliably increasing the level of rigidity thereof and reducing the weight thereof.

Means for Solving the Problems

In order to solve the above problem and achieve the relevant object, the present invention employs the following measures.

That is to say, (1) A panel according to an aspect of the present invention includes, among protrusions protruding from a predetermined reference surface, flat sections being flush with the reference surface, and recesses being recessed from the reference surface, the protrusions, and the flat sections or the recesses, wherein; when the panel includes the flat sections, the entire periphery of each of the protrusions is surrounded by the flat sections, and the entire periphery of each of the flat sections is surrounded by the protrusions, while when the panel includes the recesses, the entire periphery of each of the protrusions is surrounded by the recesses, and the entire periphery of each of the recesses is surrounded by the protrusions.

(2) The panel according to (1) above is preferably such that when viewed from the front, the protrusions, and the flat sections or the recesses are alternately arranged along a widthwise direction and a lengthwise direction orthogonal to this widthwise direction.

(3) The panel according to (1) above is preferably such that when viewed from the front, each of the protrusions has a hexagonal shape, and each of the flat sections has a triangular shape.

(4) The panel according to (1) above is preferably such that when viewed from the front, each of the protrusions has a hexagonal shape, and each of the recesses has a triangular shape.

(5) The panel according to (1) above is preferably such that when viewed from the front, the protrusions and the flat sections both have a quadrangular shape.

(6) The panel according to (1) above is preferably such that when viewed from the front, the protrusions and the recesses both have a quadrangular shape.

(7) The panel according to any one of (3) through (6) above is preferably such that each corner section of the respective adjacent protrusions is connected via a bridge having a flat top upper surface.

(8) The panel according to (1) above is preferably such that: when it includes the protrusions and the recesses, a protrusion side inclined surface is formed on a peripheral portion of the protrusions, and a recess side inclined surface is formed on a peripheral portion of the recesses; when the protrusion side inclined surface and the recess side inclined surface are viewed on a cross-section perpendicular to the reference surface, these protrusion side inclined surface and recess side inclined surface are linearly and continuously connected; and an inclination angle of the protrusion side inclined surface and an inclination angle of the recess side inclined surface are the same.

(9) The panel according to (1) above is preferably such that when it includes the protrusions and the recesses, planar shapes and planar dimensions of the protrusions and the recesses are the same.

(10) The panel according to (1) above is preferably such that when it includes the protrusions and the recesses, a protruding dimension of the protrusions and a recessing dimension of the recesses respectively in the direction perpendicular to the reference surface are the same.

(11) The panel according to (1) above is preferably such that a frame section is provided along a periphery of a face material, which includes all of the protrusions, and the flat sections or the recesses.

Effect of the Invention

According to the panel of (1) above, the protrusions, and the flat sections or the recesses are not formed in a planarly continuous manner. As a result, a three dimensional effect of the panel is obtained in the plate thickness direction, and the bending rigidity and the torsional rigidity of the panel can be improved. Therefore, the level of the rigidity can be improved dramatically, while weight reduction can be realized due to thickness reduction.

Furthermore, according to the panel of (1) above, when the flat sections are provided, since the entire periphery of each flat section is surrounded by the protrusions, the flat sections are not continuously formed, and the protrusions are not continuously formed. Moreover, when the recesses are provided, since the entire periphery of each recess is surrounded by the protrusions, the recesses are not continuously formed, and the protrusions are not continuously formed. As a result, the protrusions, and the flat sections or the recesses geometrically act with respect to bending or torsion of the entire panel, and the level of cross-sectional performance is increased due to the three dimensional effect. Accordingly, it is possible to improve the bending rigidity and the torsional rigidity. Therefore, the level of rigidity can be dramatically improved for a flat plate or a corrugated plate compared to conventional panels. As a result, the thickness of the entire panel can be reduced and the weight thereof can also be reduced.

The predetermined reference surface may be a flat surface, a cylindrical surface, a spherical surface, or any other three-dimensional curved surface. Moreover, the panel may be formed from a flat plate with a predetermined plate thickness through appropriate work processing such as press working and bending, and it may be manufactured integrally with protrusions and flat sections.

According to the panel of (2) above, since the protrusions, and the flat sections or the recesses are respectively arranged alternately, when a force is applied on the panel, the force can be distributed into two orthogonal directions (widthwise direction and lengthwise direction). As a result, it is possible to further increase the level of rigidity with the entire panel resisting bending and torsion that act on the panel.

According to the panel of either one of (3) and (4) above, it is possible to increase the level of panel rigidity with a good balance in the directions of the opposite edges and opposite corners of the hexagonal shape.

According to the panel of either one of (5) and (6) above, it is possible to increase the level of panel rigidity with a good balance in the directions of the opposite edges and opposite corners of the quadrangular shape.

According to the panel of (7) above, since a bridge is formed between the corner sections of the adjacent protrusions, when a force is applied to the panel, the force is transmitted through this bridge. As a result, stress concentration can be mitigated compared to those cases where adjacent protrusions are directly connected with each other.

According to the panel of (8) above, since the inclination angle of the protrusion side inclined surface is the same as that of the recess side inclined surface, and the protrusion side inclined surface and the recess side inclined surface are formed continuously, these continuous inclined surfaces function as rib members (reinforcing members). As a result, the level of panel cross-sectional performance can be further increased.

According to the panel of (9) above, since the planar shapes and the planar dimensions of the protrusions and the recesses are the same, a neutral axis is positioned at an intermediate part of the panel cross-section (in the vicinity of the reference surface). As a result, a well balanced resistance can be provided with respect to both an external force from the protruding side of the panel and an external force from the recessed side of the panel.

According to the panel of (10) above, the neutral axis is positioned in the vicinity of the reference surface, which is at the intermediate part of the panel cross-section. As a result, a well balanced resistance can be provided with respect to both an external force from the protruding side of the panel and an external force from the recessed side of the panel. Furthermore, when forming the panel by means of press working or the like, by matching the drawing dimensions of the protrusions and the recesses, it is possible to avoid variation in plate thickness and disproportionately remaining stress associated with plastic deformation. Therefore, it is possible to stabilize strength and deformation performance of the panel.

According to the panel of (11) above, by providing the frame section, it is possible to suppress local deformation in the periphery of the panel and improve the level of panel rigidity.

EMBODIMENTS OF THE INVENTION

Hereunder, each embodiment of the present invention is described, with reference to the drawings.

In FIG. 1 to FIG. 6E, a panel 1 (1A to 1E) of the present embodiment is to be used for; packaging for household electric appliances, walls for freight containers, structures and interior/exterior materials for building structures, vehicle bodies, chassis or various components for automobiles, rolling stock, aircraft, and ships, or other types of containers such as cans, and it is formed in an overall plate shape along a predetermined reference surface F of a flat surface or a curved surface. This panel 1 may be formed by means of press working with a metal thin plate composed of steel, stainless steel, or an aluminum alloy, and it may also be formed by means of injection molding with a thermoplastic resin. The panel 1 is formed so as to have a flat surface section 2 along the reference surface F, and a bent section (frame section) 3 which is bent at a substantially right angle from the outer periphery of this flat surface section 2. Here, although the panel 1 is provided with the bent section 3, it does not always have to be provided with the bent section 3. However, by providing the bent section 3, it is possible to obtain an effect of suppressing local deformation of the periphery of the panel 1.

Figure 1:
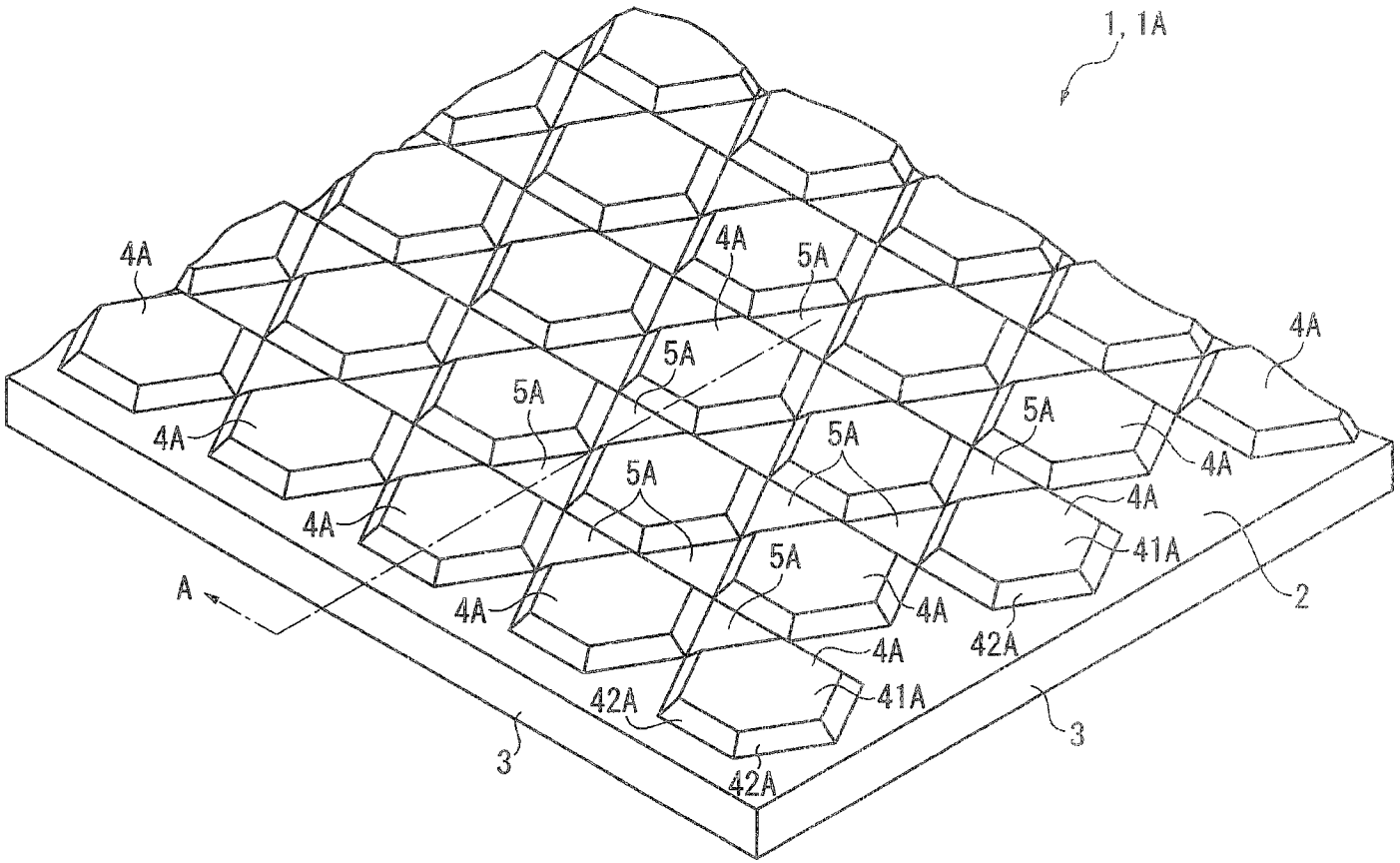
FIG. 1 is a perspective view showing a panel according to a first embodiment of the present invention.
Figure 6A:
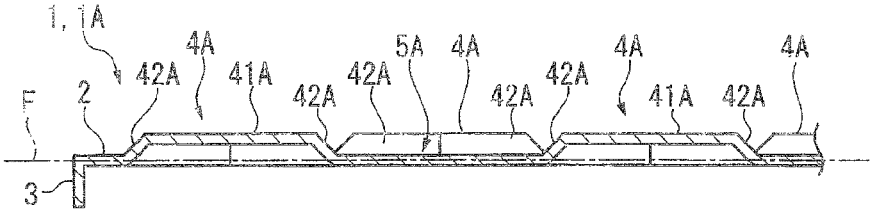
FIG. 6A is a cross-sectional view of the panel according to the first embodiment.

A panel 1A of a first embodiment shown in FIG. 1 and FIG. 6A is provided with a plurality of protrusions 4A each protruding from the reference surface F, and a plurality of flat sections 5A which are flush with the reference surface F.

The plurality of protrusions 4A protrude to one side (in the direction perpendicular to the reference surface F: upward from the drawing paper surface). The flat sections 5A each include a flat surface section 2, which remains as is and does not protrude. The protrusions 4A and the flat sections 5A are arranged side by side along the flat surface section 2.

Each protrusion 4A is of a regular hexagonal frustrum having an upper surface section 41A in a regular hexagon shape when viewed from the front (when viewed from the protruding direction), and inclined surface sections (inclined surfaces) 42A each extending from each edge of the upper surface section 41A toward the flat surface section 2 (reference surface F).

Each flat section 5A is formed in a regular triangular shape by the bottom end peripheries of the inclined surface sections 42A of three protrusions 4A. That is to say, the entire periphery of the protrusion 4A is surrounded by the flat sections 5A, and the entire periphery of each flat section 5A is surrounded by the protrusions 4A. Specifically, the three edges of the entire periphery of each flat section 5A are surrounded by three protrusions 4A, and the six edges of the entire periphery of each protrusion 4A are surrounded by six flat sections 5A. Therefore, the protrusions 4A and the flat sections 5A are arranged so that adjacent flat sections 5A are not formed continuously, and adjacent protrusions 4A are not formed continuously.

With the configuration described above, the panel 1A of the present embodiment is of a configuration in which the protrusions 4A and the flat sections 5A are not formed in a planarly continuous manner. As a result, a three dimensional effect of the panel 1A is obtained in the plate thickness direction, and the bending rigidity and the torsional rigidity of the panel 1A can be improved. Therefore, the level of the rigidity can be improved dramatically, while weight reduction can be realized due to thickness reduction.

Figure 2:
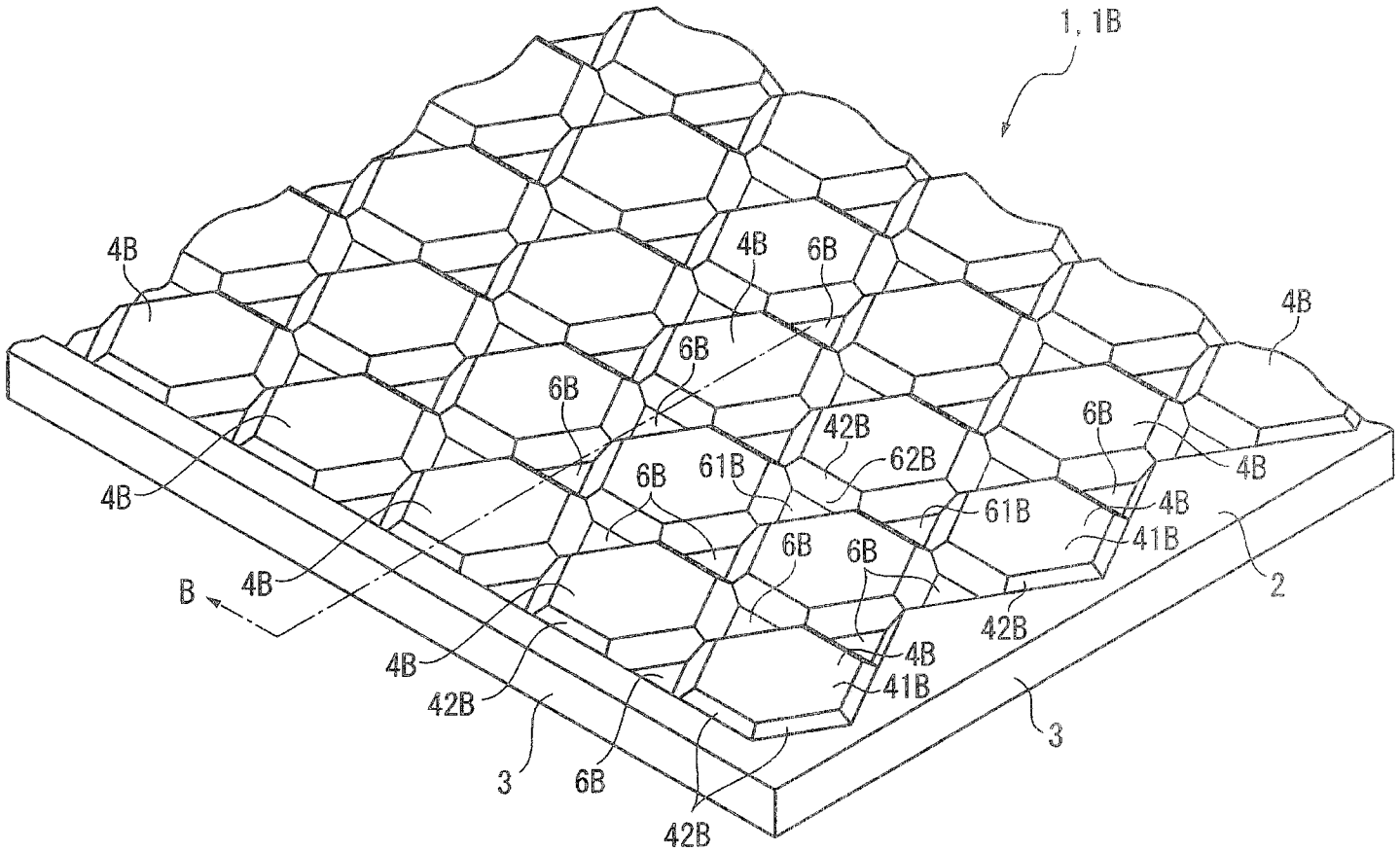
FIG. 2 is a perspective view showing a panel according to a second embodiment of the present invention.
Figure 6B:
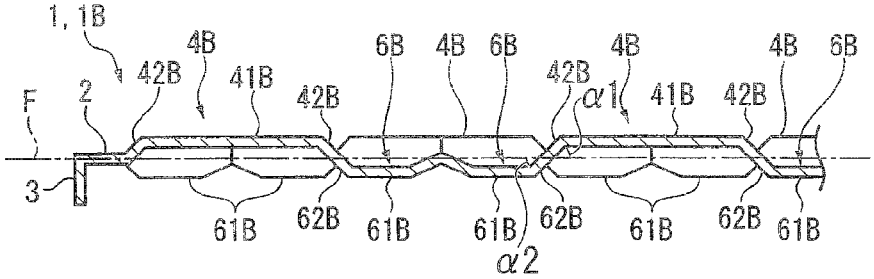
FIG. 6B is a cross-sectional view of the panel according to the second embodiment.

A panel 1B of a second embodiment shown in FIG. 2 and FIG. 6B is provided with a plurality of protrusions 4B each protruding from the reference surface F, and a plurality of recesses 6B each recessed from the reference surface F.

The protrusions 4B each protrude to one side (in the direction perpendicular to the reference surface F: upward from the drawing paper surface), and the recesses 6B are each recessed to the other side, which is opposite of the above one side (downward in the drawing). The protrusions 4B and the recesses 6B are arranged side by side along the flat surface section 2.

Each protrusion 4B is of a regular hexagonal frustrum having an upper surface section 41B in a regular hexagon shape when viewed from the front (when viewed from the protruding direction), and inclined surface sections 42B each serving as a side surface thereof. This inclined surface section 42B is a protrusion side inclined surface which is formed on the peripheral portion of the protrusion 4B, extends from each edge of the upper surface section 41B toward the flat surface section 2 (reference surface F), and is inclined with respect to the flat surface section 2.

Each recess 6B is of a downward-facing regular triangular frustrum having a bottom surface section 61B in a regular triangular shape, and inclined surface sections 62B each serving as a side surface thereof. The inclined surface section 62B is a recess side inclined surface which is formed on the peripheral portion of the recess 6B, extends from each edge of the bottom surface section 61B toward the flat surface section 2 (reference surface F), and is inclined with respect to the flat surface section 2. The entire periphery of each protrusion 4B is surrounded by six of these recesses 6B. Meanwhile, the entire periphery of each recess 6B is surrounded by three of the protrusions 4B.

With the configuration described above, the adjacent protrusions 4B are arranged not to be continuous with each other, and the adjacent recesses 6B are arranged not to be continuous with each other. Moreover, an inclination angle $\alpha 1$ of the inclined surface section 42B of the protrusion 4B with respect to the reference surface F is the same as an inclination angle $\alpha 2$ of the inclined surface section 62B of the recess 6B with respect to the reference surface F.

Furthermore, when the inclined surface section 42B and the inclined surface section 62B are viewed on a cross-section perpendicular to the reference surface F, these inclined surface section 42B and inclined surface section 62B are linearly continuous and are connected. That is to say, they are formed as being continuous within the same plane.

With the configuration described above, as with the panel 1A, the panel 1B of the present embodiment is capable of dramatically increasing the level of rigidity while realizing a reduction in weight as a result of thickness reduction.

Figure 3:
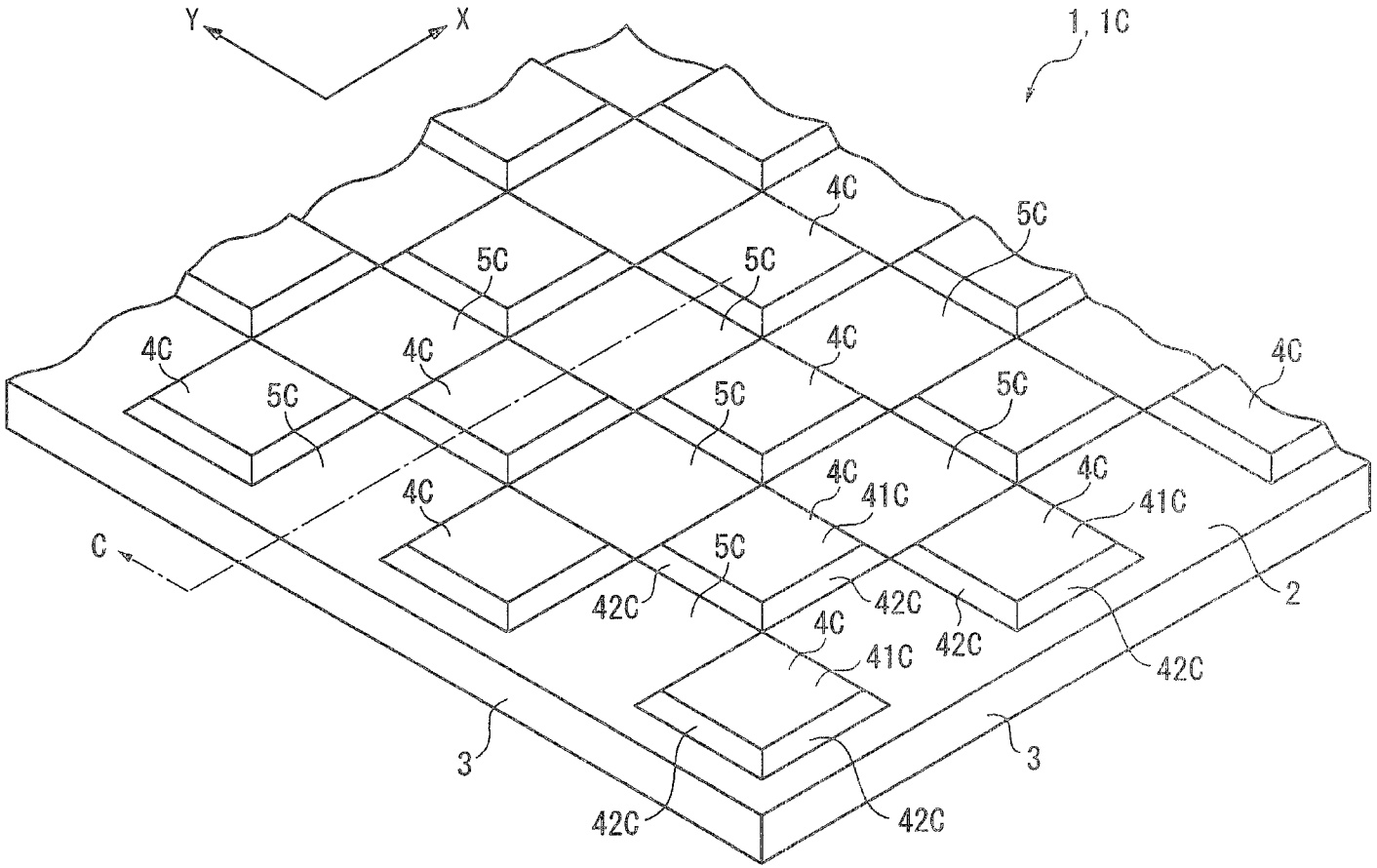
FIG. 3 is a perspective view showing a panel according to a third embodiment of the present invention.
Figure 6C:
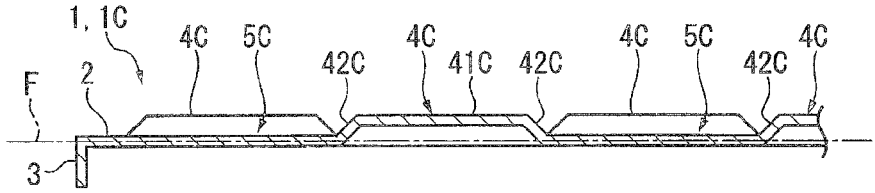
FIG. 6C is a cross-sectional view of the panel according to the third embodiment.

A panel 1C of a third embodiment shown in FIG. 3 and FIG. 6C is provided with a plurality of protrusions 4C each protruding from the reference surface F, and a plurality of flat sections 5C which are flush with the flat surface section 2.

The protrusions 4C are each of a quadrangular shape, and protrude to one side (in the direction perpendicular to the reference surface F: upward from the drawing paper surface). The flat sections 5C each include a flat surface section 2, which does not protrude and remains as is. The protrusions 4C and the flat sections 5C are arranged side by side along the flat surface section 2.

Each protrusion 4C is of a regular quadrangular frustrum having an upper surface section 41C in a regular quadrangular (tetragonal) shape when viewed from the front (when viewed from the protruding direction), and inclined surface sections (inclined surfaces) 42C each extending from each edge of the upper surface section 41C toward the flat surface section 2 (reference surface F). The entire periphery of each flat section 5C is surrounded by the protrusions 4C. Specifically, each flat section 5C is formed in a regular quadrangular shape by the bottom end peripheries of the inclined surface sections 42C of four (three in the case of the periphery of the panel 1) of the protrusions 4C, that is to say, the four edges of the entire periphery of each flat section 5C are surrounded by four of the protrusions 4C. Moreover, the entire periphery of each protrusion 4C is surrounded by the flat sections 5C.

With this type of configuration, the protrusions 4C and the flat sections 5C are arranged so that adjacent flat sections 5C are not formed continuously, and adjacent protrusions 4C are not formed continuously.

Moreover, the protrusions 4C and the flat sections 5C are arranged alternately along the reference surface F, along the widthwise direction (X direction) and the lengthwise direction (Y direction) orthogonal to this widthwise direction. That is to say, they are formed in a checkered pattern.

With the configuration described above, as with the panel 1A, the panel 1C of the present embodiment is capable of dramatically increasing the level of rigidity while realizing a reduction in weight as a result of thickness reduction.

Figure 4:
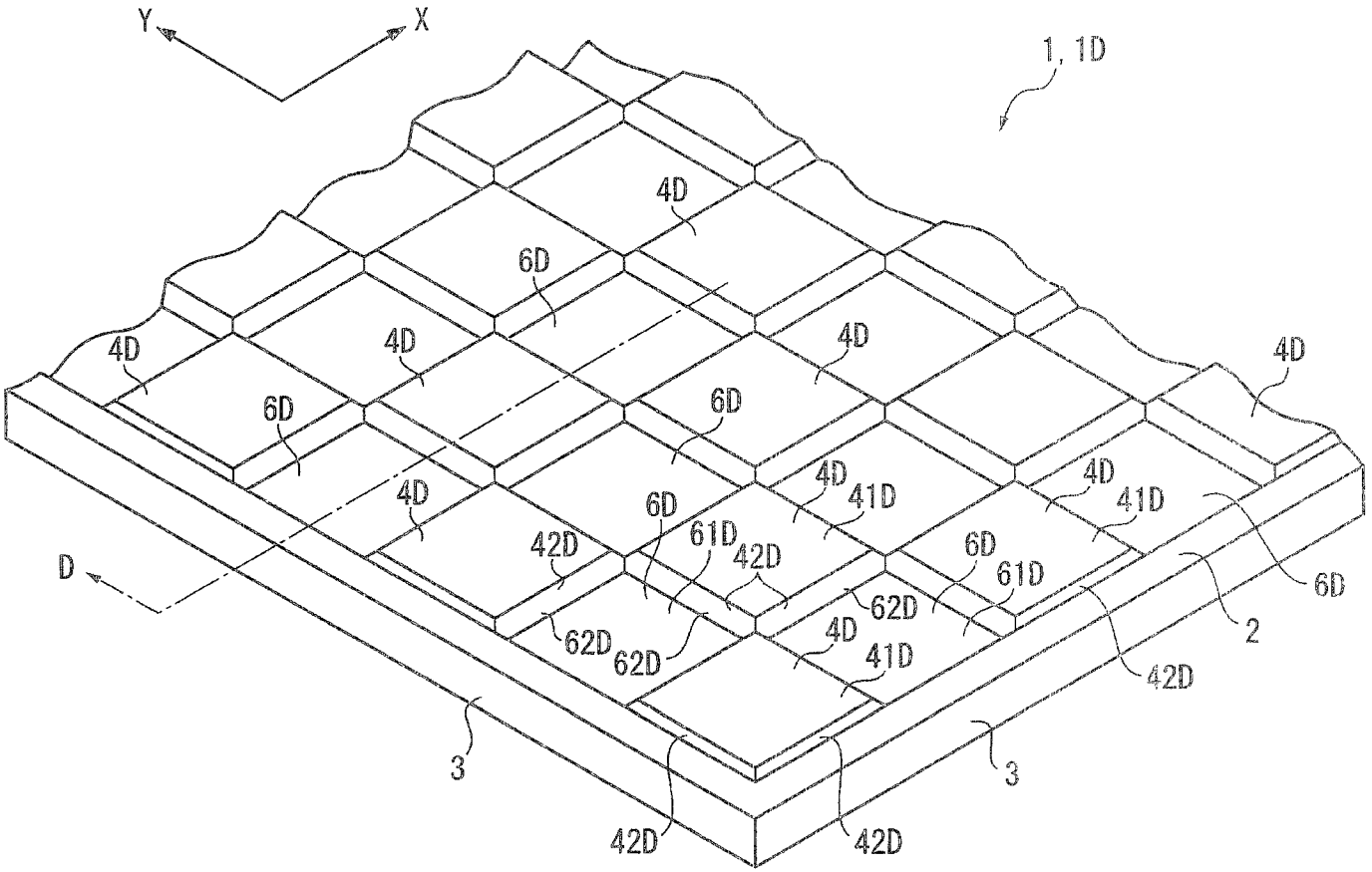
FIG. 4 is a perspective view showing a panel according to a fourth embodiment of the present invention.
Figure 6D:
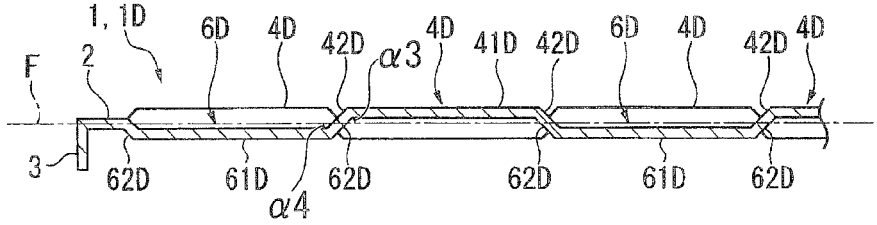
FIG. 6D is a cross-sectional view of the panel according to the fourth embodiment.

A panel 1D of a fourth embodiment shown in FIG. 4 and FIG. 6D is provided with a plurality of protrusions 4D each protruding from the reference surface F, and a plurality of recesses 6D each recessed from the reference surface F.

The protrusions 4D protrude to one side (in the direction perpendicular to the reference surface F: upward from the drawing paper surface). The recesses 6D are recessed to the other side, which is opposite of the above one side (downward in the drawing). The protrusions 4D and the recesses 6D are arranged side by side along the flat surface section 2.

Each protrusion 4D is of a regular quadrangular frustrum having an upper surface section 41D in a regular quadrangular (tetragonal) shape when viewed from the front (when viewed from the protruding direction), and inclined surface sections 42D each serving as a side surface thereof. The inclined surface section 42D is a protrusion side inclined surface which is formed on the peripheral portion of the protrusion, extends from each edge of the upper surface section 41D toward the flat surface section 2 (reference surface F), and is inclined with respect to the flat surface section 2. The entire periphery of each protrusion 4D is surrounded by four of these recesses 6D. Meanwhile, the entire periphery of each recess 6D is surrounded by four of the protrusions 4B.

Each protrusion 6D is of a downward-facing regular quadrangular frustrum having a bottom surface section 61D in a regular quadrangular (tetragonal) shape when viewed from the front (when viewed from the protruding direction), and inclined surface sections 62D each serving as a side surface thereof. The inclined surface section 62D is a recess side inclined surface which is formed on the peripheral portion of the recess 6D, extends from each edge of the bottom surface section 61D toward the flat surface section 2 (reference surface F), and is inclined with respect to the flat surface section 2. The entire periphery of each protrusion 4D is surrounded by four of the recesses 6D, while the entire periphery of each recess 6D is surrounded by four of the protrusions 4D.

With the configuration described above, the protrusions 4D and the recesses 6D are arranged side by side alternately along the widthwise direction (X direction) and the lengthwise direction (Y direction) orthogonal to this widthwise direction. That is to say, they are formed in a checkered pattern.

Accordingly, the adjacent protrusions 4D are arranged not to be continuous with each other, and the adjacent recesses 6D are arranged not to be continuous with each other. Moreover, an inclination angle $\alpha$3 of the inclined surface section 42D of the protrusion 4D with respect to the reference surface F is the same as an inclination angle $\alpha$4 of the inclined surface section 62D of the recess 6D with respect to the reference surface F. Furthermore, when the inclined surface section 42D and the inclined surface section 62D are viewed on a cross-section perpendicular to the reference surface F, these inclined surface section 42D and inclined surface section 62D are linearly continuous and are connected. That is to say, they are formed as being continuous within the same plane.

With the configuration described above, as with the panel 1A, the panel 1D of the present embodiment is capable of dramatically increasing the level of rigidity while realizing a reduction in weight as a result of thickness reduction.

Figure 5:
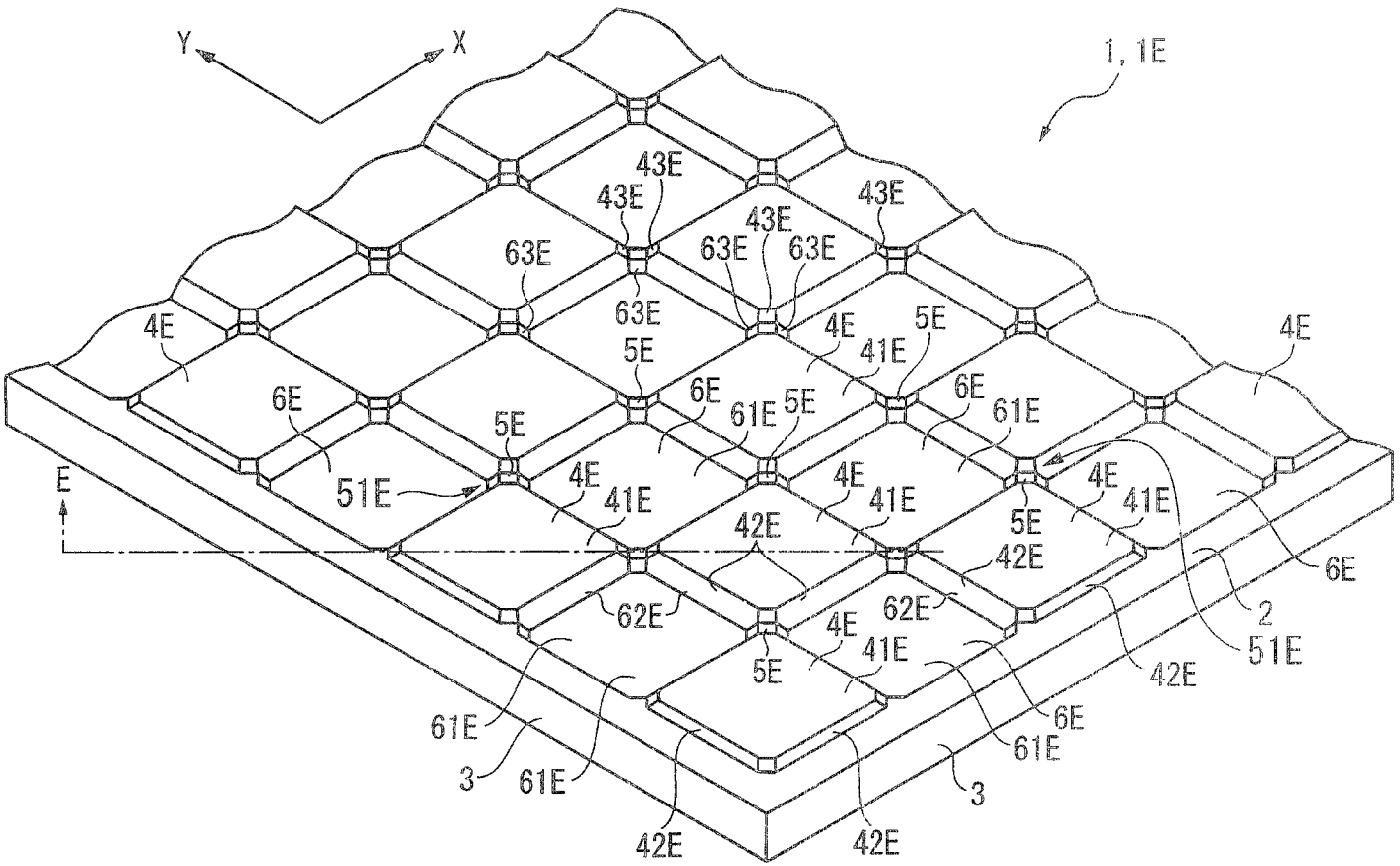
FIG. 5 is a perspective view showing a panel according to a fifth embodiment of the present invention.
Figure 6E:
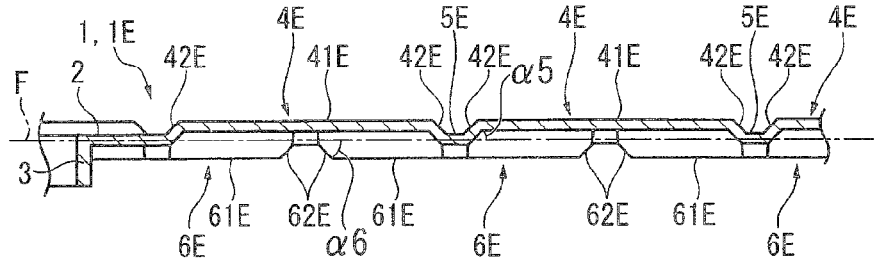
FIG. 6E is a cross-sectional view of the panel according to the fifth embodiment.

A panel 1E of a fifth embodiment shown in FIG. 5 and FIG. 6E is provided with a plurality of protrusions 4E each protruding from the reference surface F, and a plurality of recesses 6E each recessed from the reference surface F.

The protrusions 4E protrude to one side (in the direction perpendicular to the reference surface F: upward from the drawing paper surface). The recesses 6E arc recessed to the other side, which is opposite of the above one side (downward in the drawing). The protrusions 4E and the recesses 6E are arranged side by side along the flat surface section 2.

Moreover, between corner sections of the adjacent protrusions 4E (between corner sections of the recesses 6E), there is formed a bridge 51E. Each bridge 51E has a flat top flat section (top upper surface) 5E, and this top flat section 5E is formed with a flat surface section 2 which remains as is and does not protrude nor is recessed.

Each protrusion 4E is of an octangular frustrum having a regular-quadrangular-shaped (tetragonal) upper surface section 41E, four corners of which are chamfered, when viewed from the front (when viewed from the protruding direction), inclined surface sections 42E each serving as a side surface, and corner section inclined surfaces 43E each extending from the four corners of the upper surface section 41E toward the flat surface section 2 (reference surface F). This inclined surface section 42E is a protrusion side inclined surface which is formed on the peripheral portion of the protrusion 4E, extends from each edge of the upper surface section 41E toward the flat surface section 2 (reference surface F), and is inclined with respect to the flat surface section 2.

Each recess 6E is of a downward-facing octangular frustrum having a regular-quadrangular-shaped bottom surface section 61E, four corners of which are chamfered, when viewed from the front (when viewed from the protruding direction), inclined surface sections 62E each serving as a side surface, and corner section inclined surfaces 63E each extending from the four corners of the bottom surface section 61E toward the flat surface section 2 (reference surface F). The inclined surface section 62E is a recess side inclined surface which is formed on the peripheral portion of the recess 6E, extends from each edge of the bottom surface section 61E toward the flat surface section 2 (reference surface F), and is inclined with respect to the flat surface section 2.

Each top flat section 5E is formed, in a corner section where diagonally positioned two protrusions 4E and two recesses 6E approach to each other, in a regular quadrangular shape defined by the bottom end peripheries of the corner section inclined surfaces 43E and the upper end peripheries of the corner section inclined surfaces 63E.

On the panel 1E of the fifth embodiment, the entire periphery of each protrusion 4E is surrounded by four of the recesses 6E, and the entire periphery of each recess 6E is surrounded by four of the protrusions 4E. With this configuration, the protrusions 4E and the recesses 6E are arranged side by side alternately along the widthwise direction (X direction) and the lengthwise direction (Y direction) orthogonal to this widthwise direction. That is to say, they are formed in a checkered pattern.

Accordingly, the panel 1E is configured such that the adjacent protrusions 4E are arranged not to be continuous with each other, and the adjacent recesses 6E are arranged not to be continuous with each other. Furthermore, four edges of the entire periphery of the top flat section 5E are surrounded by two of the protrusions 4E and two of the recesses 6E, and the adjacent top flat sections 5E (bridges 51E) are not continuous with each other. Moreover, an inclination angle $\alpha$5 of the inclined surface section 42E of the protrusion 4E with respect to the reference surface F is the same as an inclination angle $\alpha$6 of the inclined surface section 62E of the recess 6E with respect to the reference surface F. Furthermore, the inclined surface section 42E and the inclined surface section 62E are formed as being continuous within the same plane.

With the configuration described above, as with the panel 1A, the panel 1E of the present embodiment is capable of dramatically increasing the level of rigidity while realizing a reduction in weight as a result of thickness reduction.

Moreover, the panels 1A to 1D of FIG. 1 to FIG. 4 may be provided with bridges 51E as with those of the panel 1E.

Here, panels 10 (10A, 10B, 10C, and 10D) according to conventional examples of the present invention are described based on FIG. 7A, FIG. 7B, FIG. 7C, and FIG. 8.

Figure 7A:
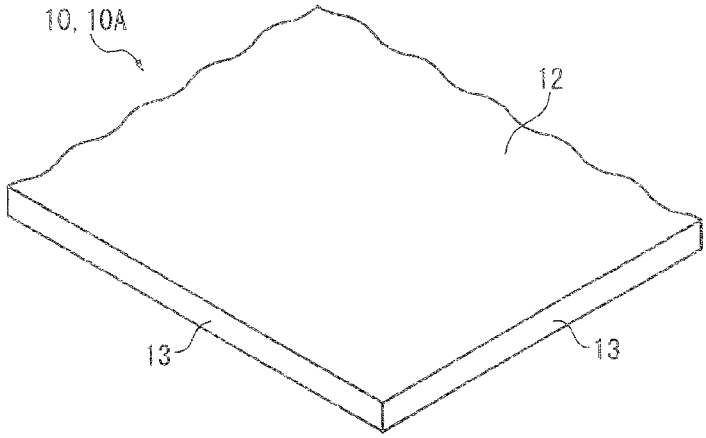
FIG. 7A is a perspective view showing a conventional panel.

In FIG. 7A, the panel 10A is formed having a flat-plate-shaped flat surface section 12, and bent sections 13 each bent substantially at right angles from the outer periphery of this flat surface section 12.

Figure 7B:
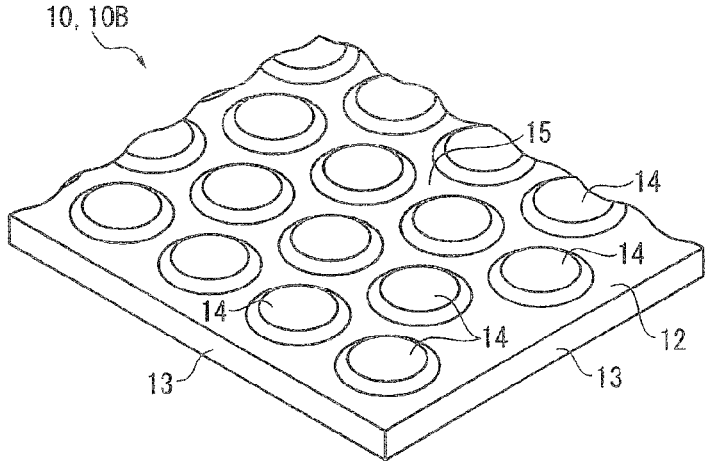
FIG. 7B is a perspective view showing a conventional panel.

In FIG. 7B, the panel 10B is formed having a flat surface section 12, bent sections 13, a plurality of protrusions 14 each protruding to one side (upward from the drawing paper surface) from the flat surface section 12, and a flat section 15 where no protrusion 14 is formed on the flat surface section 12.

Figure 7C:
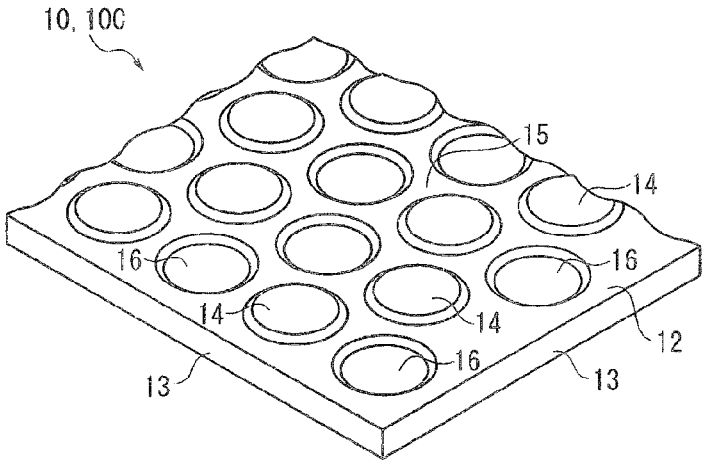
FIG. 7C is a perspective view showing a conventional panel.

In FIG. 7C, the panel 10C is formed having a flat surface section 12, bent sections 13, a plurality of protrusions 14, a flat section 15, and a plurality of recesses 16 each recessed from the flat surface section 12 to the other side (downward in the drawing).

Figure 8:
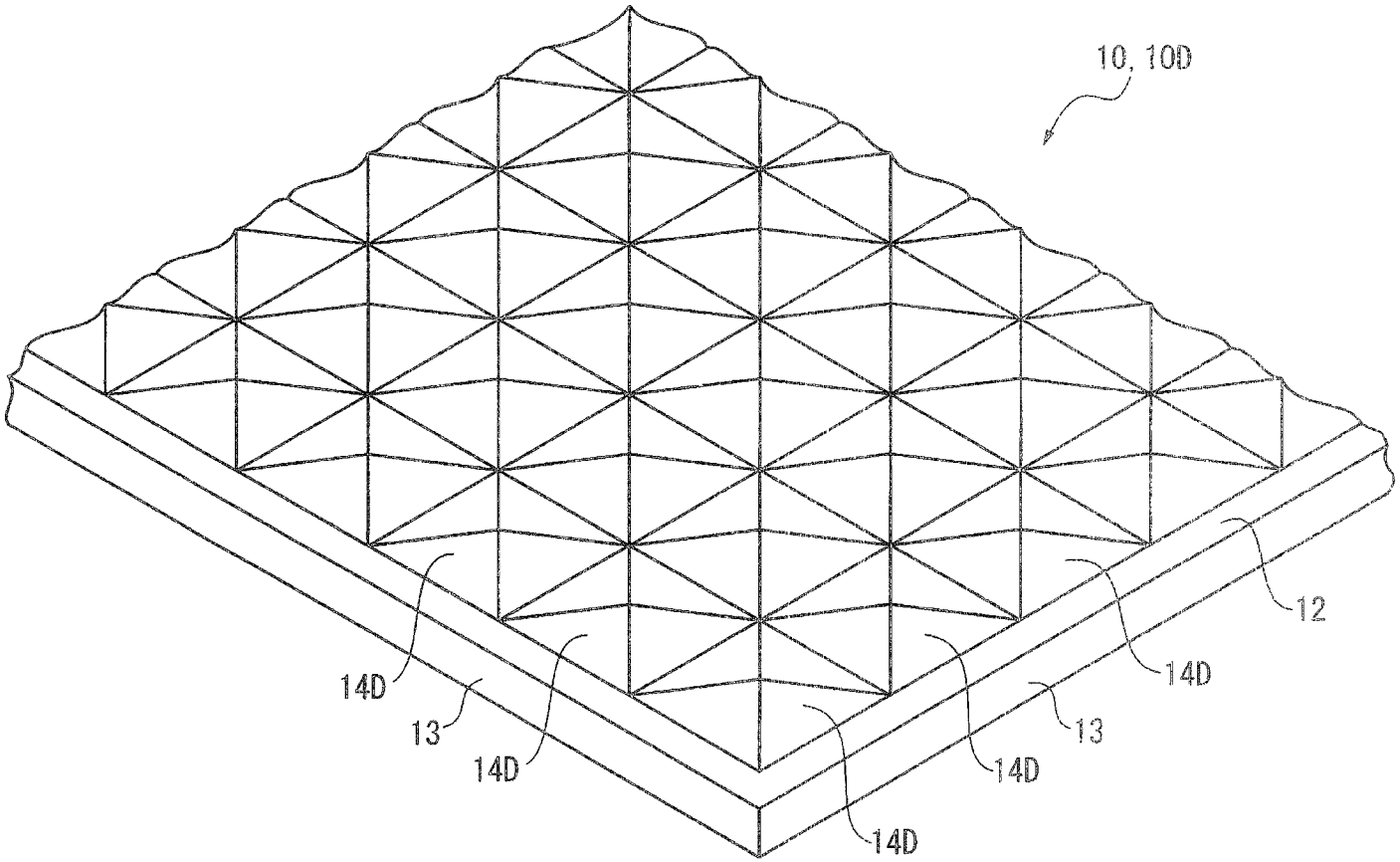
FIG. 8 is a perspective view showing another conventional panel.

In FIG. 8, the panel 10D is formed having a flat surface section 12, bent sections 13, and a plurality of protrusions 14D each protruding from the flat surface section 12 to one side (upward from the drawing paper surface), and the protrusions 14D are each of a quadrangular pyramid in a planarly regular quadrangular shape and are arranged side by side so that the edges of the adjacent protrusions 14D are in contact with each other.

Examples

Hereunder, there are described results of a panel rigidity investigation conducted for the panels 1 of the present embodiment and the conventional panels 10.

Figure 9A:
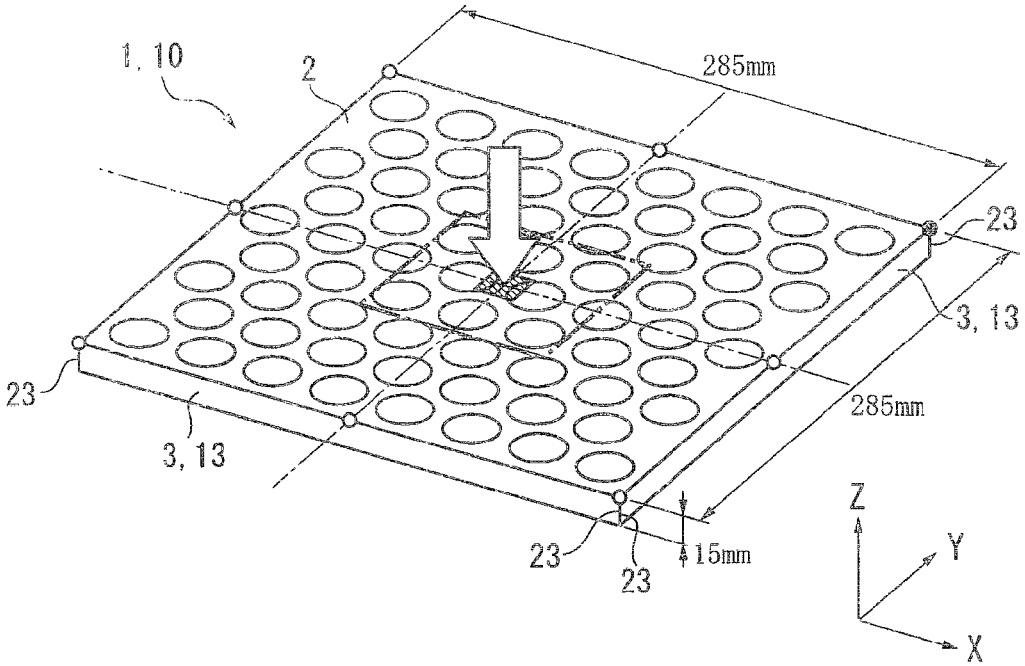
FIG. 9A is a cross-sectional view showing an FEM analysis method according to an example of the present invention.
Figure 9B:
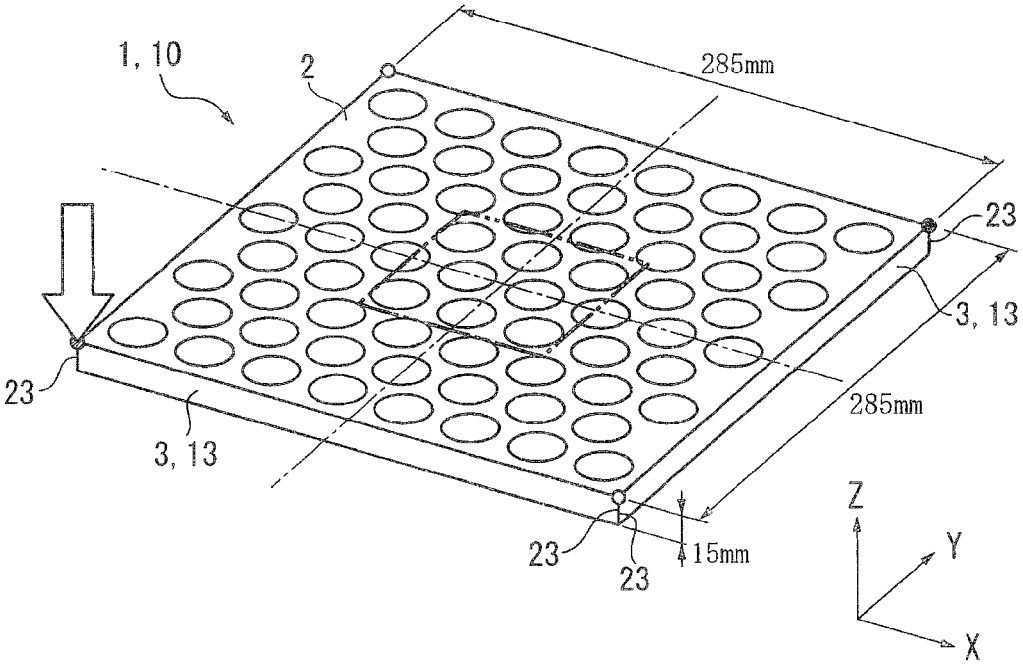
FIG. 9B is a cross-sectional view showing an FEM analysis method according to an example of the present invention.

Here, with the panels 1A to 1E of the embodiments taken as examples, and the conventional panels 10A to 10D taken as comparative examples, an FEM analysis was conducted with a model of each panel to calculate the rigidity of the panels. As the FEM analysis models, there were used a bending model in which the four corners and the center of the four edges of each of the panels 1 and 10 were supported and a load was applied onto the center of the panel as shown in FIG. 9A, and a torsion model in which the three corners of each of the panels 1 and 10 were supported while applying a load onto the other corner as shown in FIG. 9B. Moreover, the panels 1 and 10 of each model was of a configuration such that the height of each bent section 3 and 13 was 15 mm, and end peripheries 23 thereof were not connected with each other. Furthermore, the arrangement and the dimension of protrusions and recesses of each model are shown in FIG. 10A to FIG. 18B. The model dimensions arc each expressed as a dimension at the plate thickness center of the panels 1 and 10. Moreover, analysis results arc shown in FIG. 19 and FIG. 20.

{Analysis Models}

Common analysis model elements and analysis conditions among the examples and comparative examples are as follows.

Panel size: 285 mm×285 mm

Panel plate thickness: 0.6 mm (panel material assumed to be steel)

Load application position: a range of 20 mm×20 mm in the center of panel in the bending model, and one point at the non-supported one corner in the torsion model (illustrated with the outline arrow in FIG. 9).

Applied load: 10 N

Comparative Examples

Figure 10A:
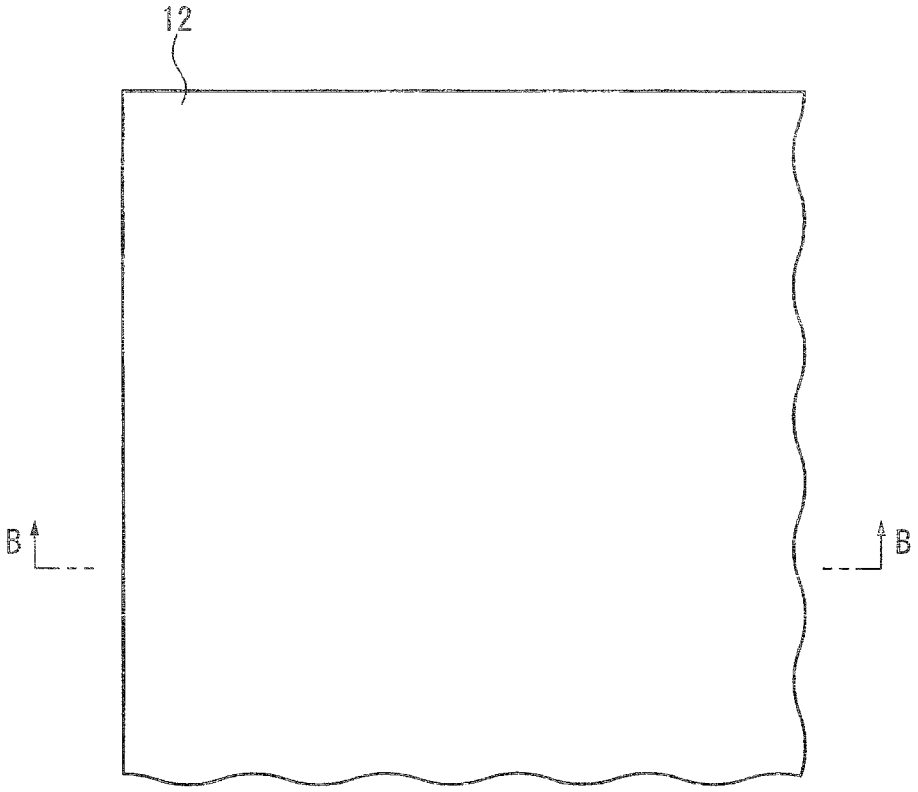
FIG. 10A is an analysis model diagram viewed from the front of Comparative Example 1 (No. 1) in the example.
Figure 10B:
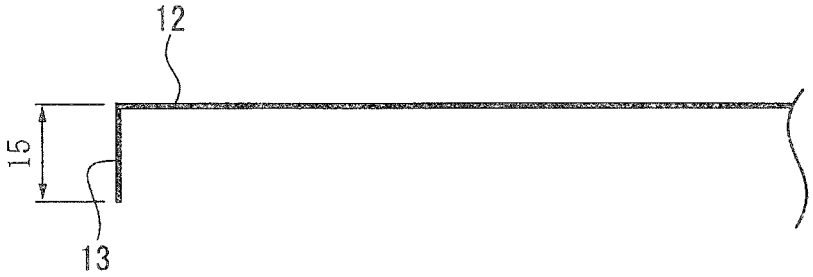
FIG. 10B is an analysis model diagram viewed from the cross-section of Comparative Example 1 (No. 1) in the example.
Figure 19:
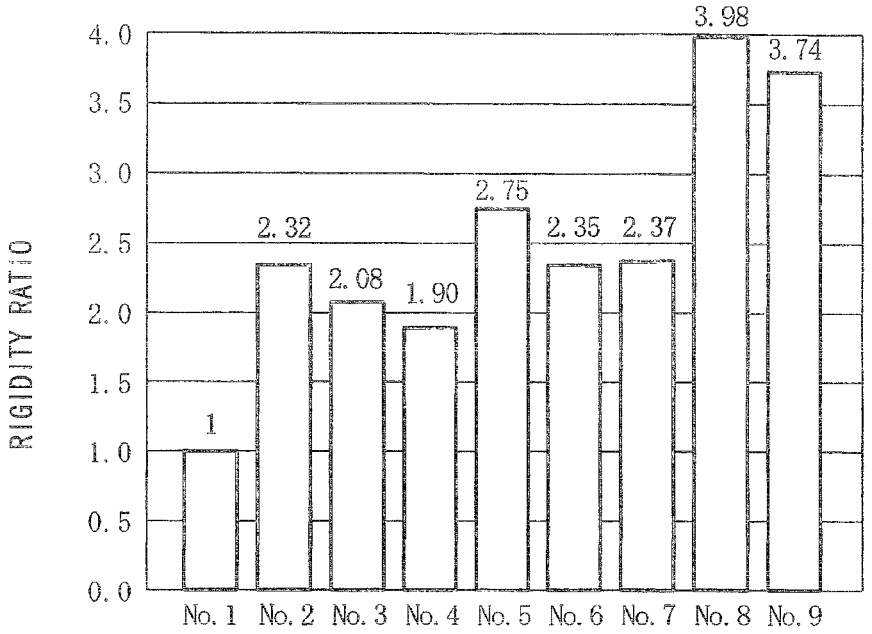
FIG. 19 is a graph showing rigidity ratios in a bending model of the example.
Figure 20:
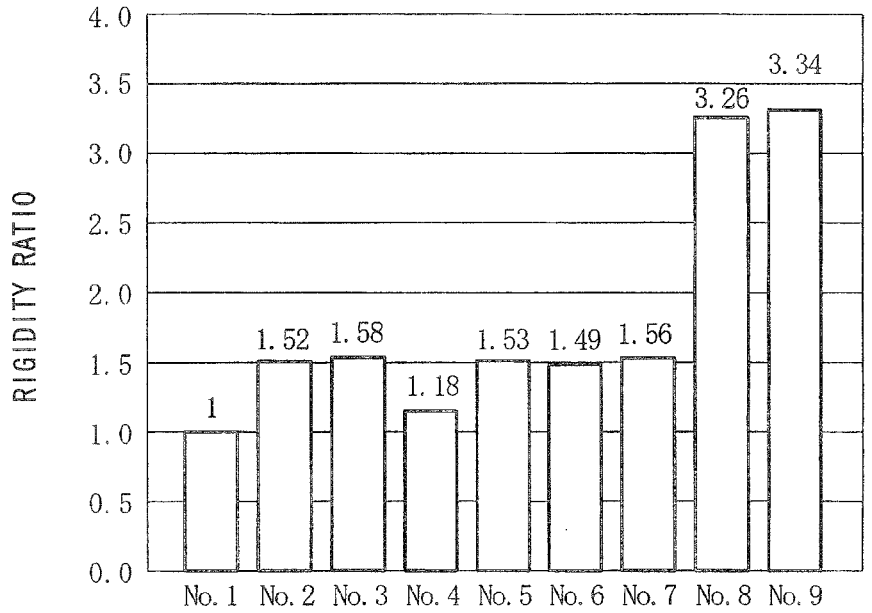
FIG. 20 is a graph showing rigidity ratios in a torsion model of the example.
Figure 21A:
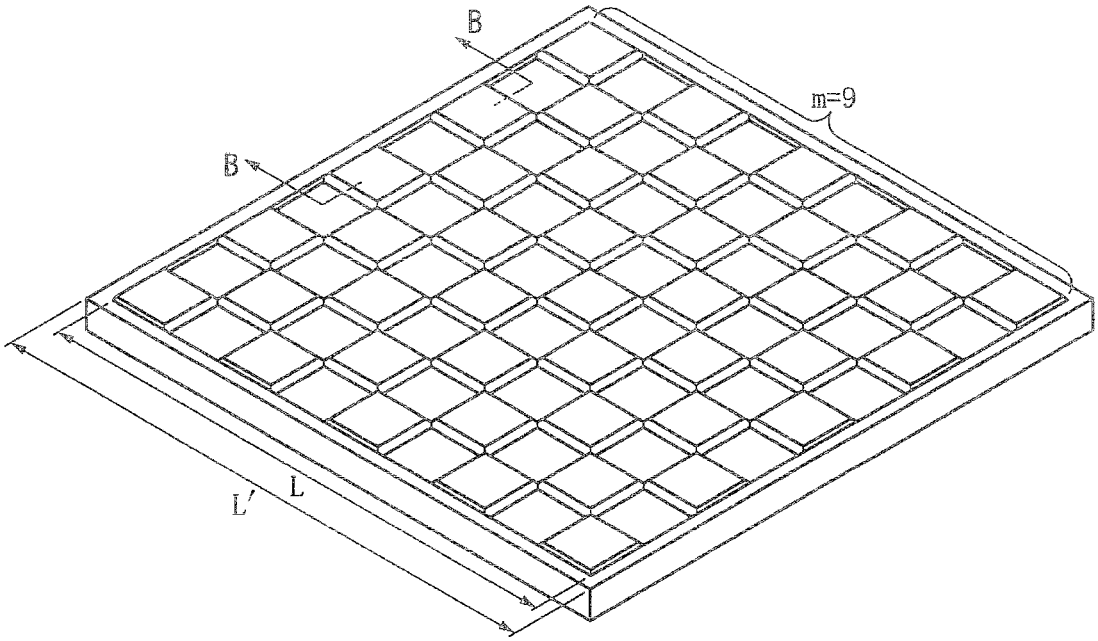
FIG. 21A is a perspective view showing a panel according to a modified example of the present invention.
Figure 21B:
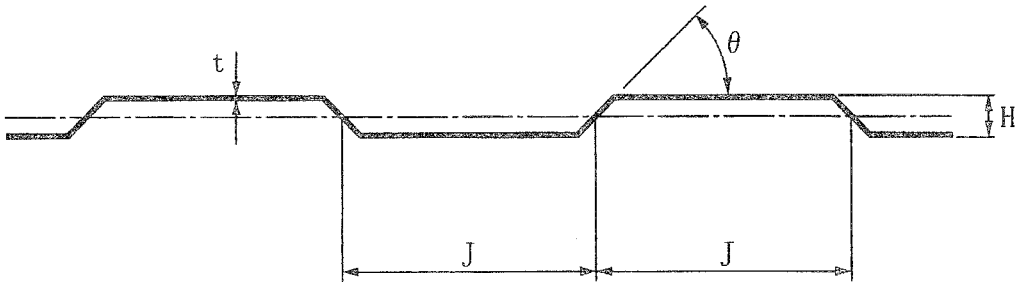
FIG. 21B is a perspective view showing the panel according to the modified example of the present invention.
Figure 22A:
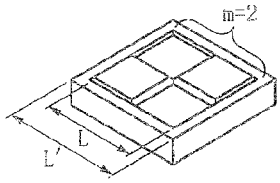
FIG. 22A is a perspective view showing a variation of the panel according to the same modified example.
Figure 22B:
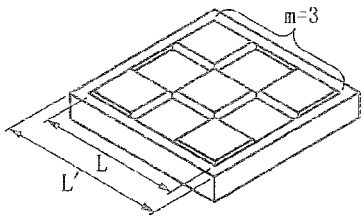
FIG. 22B is a perspective view showing a variation of the panel according to the same modified example.
Figure 22C:
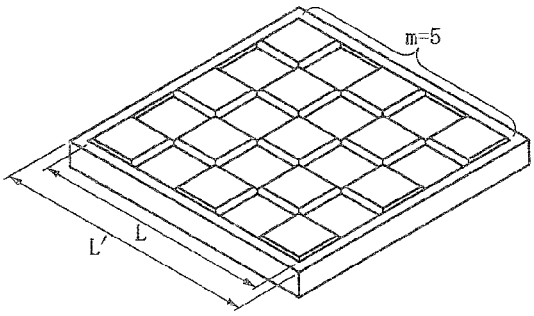
FIG. 22C is a perspective view showing a variation of the panel according to the same modified example.
Figure 22D:
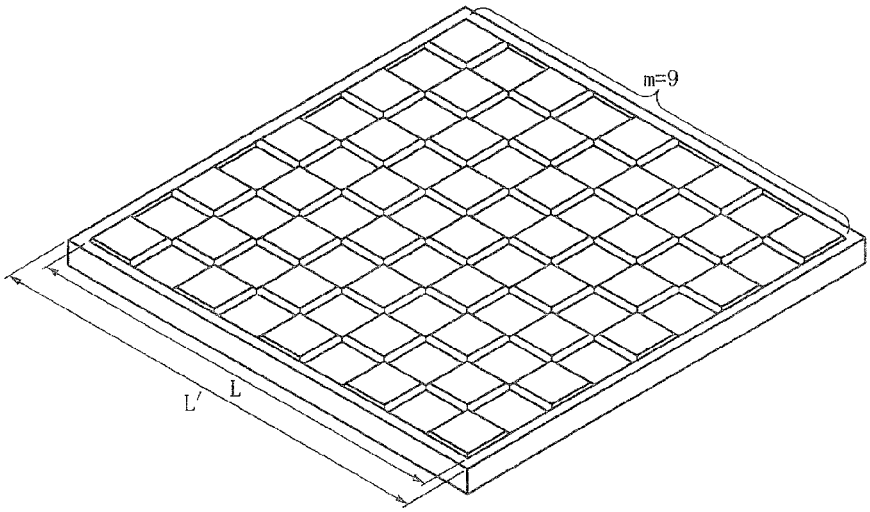
FIG. 22D is a perspective view showing a variation of the panel according to the same modified example.

Comparative Example 1 uses a panel 10A shown in FIG. 7A, and the shape of the analysis model is shown in FIG. 10. Moreover, it is shown as No. 1 in the analysis result graphs (FIG. 19 and FIG. 20).

Figure 11A:
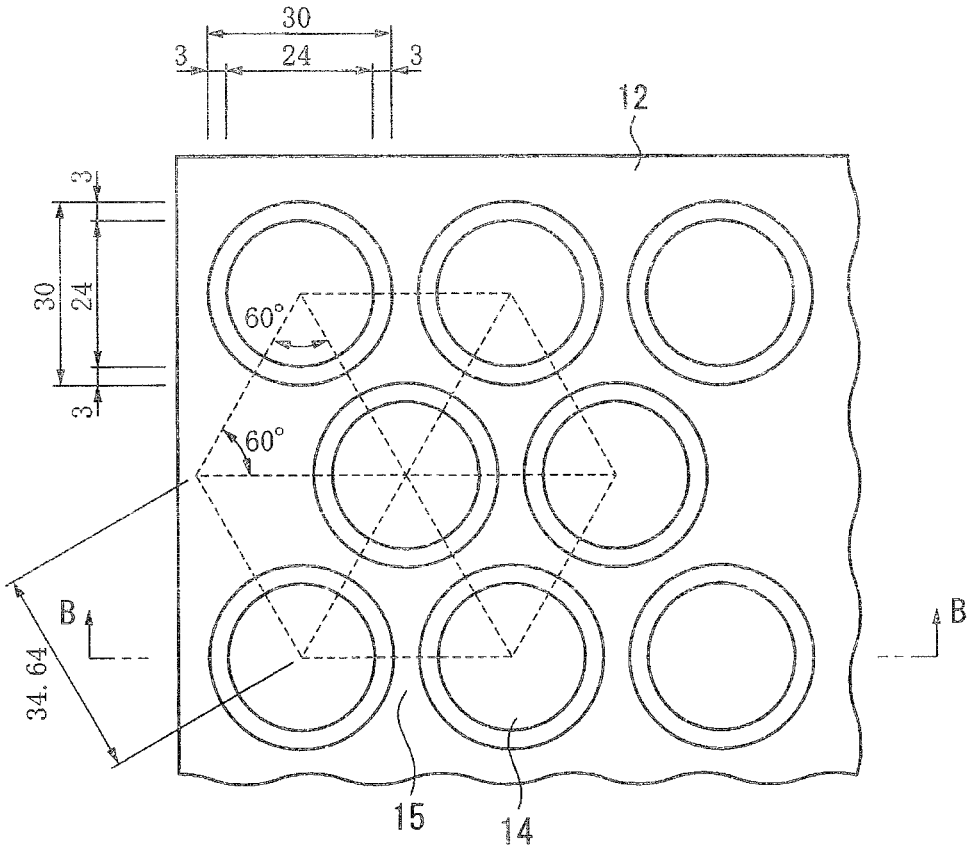
FIG. 11A is an analysis model diagram viewed from the front of Comparative Example 2 (No. 2) in the example.
Figure 11B:
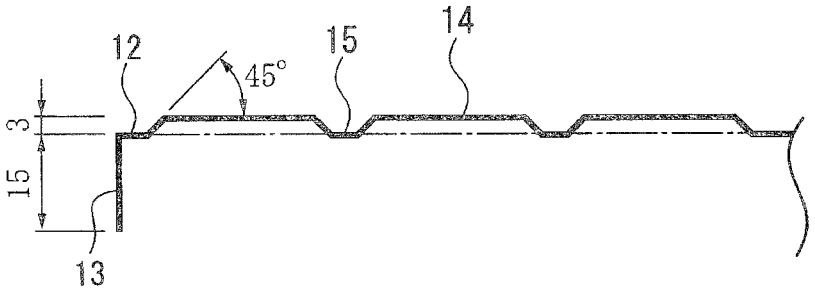
FIG. 11B is an analysis model diagram viewed from the cross-section of Comparative Example 2 (No. 2) in the example.

Comparative Example 2 uses a panel 10B shown in FIG. 7B, and the arrangement and dimensions of protrusions and recesses of the analysis model are shown in FIG. 11A and FIG. 11B. Moreover, it is shown as No. 2 in the analysis result graphs (FIG. 19 and FIG. 20). In this Comparative Example 2, there is made an arrangement such that the distance between the centers of adjacent protrusions 14 is 34.64 mm, and the center point is positioned at the apex of an equilateral triangle. The diameter of the truncated cone top surface of each protrusion 14 is 24 mm, the diameter of the truncated cone bottom surface is 30 mm, the protrusion dimension of the protrusion 14 from the flat surface section 12 is 3 mm, and the inclination angle of the truncated cone of the protrusion 14 is 45°.

Figure 12A:
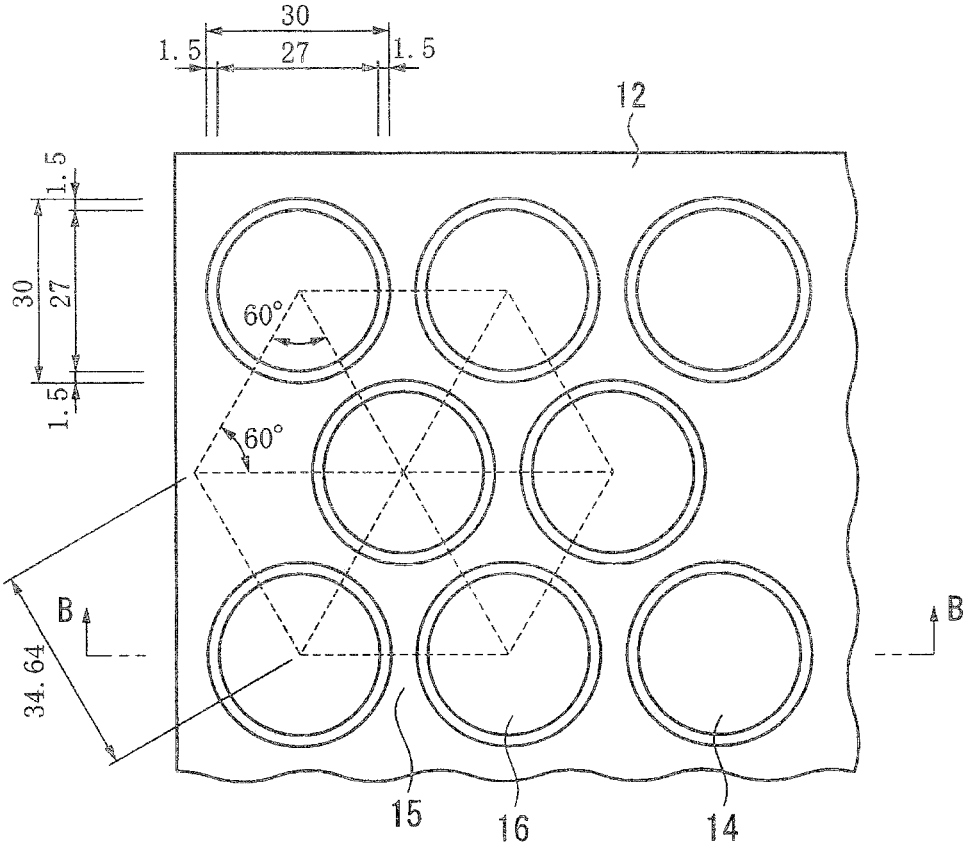
FIG. 12A is an analysis model diagram viewed from the front of Comparative Example 3 (No. 3) in the example.
Figure 12B:
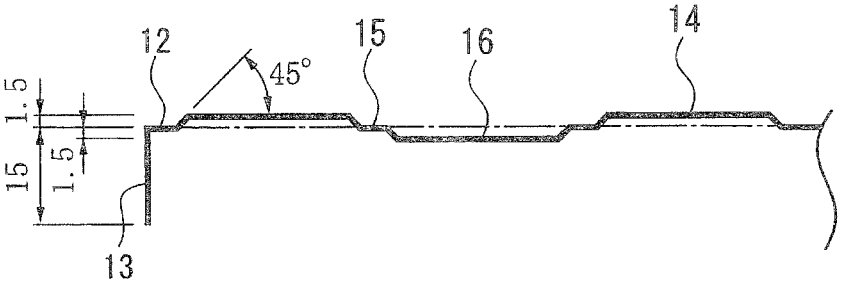
FIG. 12B is an analysis model diagram viewed from the cross-section of Comparative Example 3 (No. 3) in the example.

Comparative Example 3 uses a panel 10C shown in FIG. 7C, and the arrangement and dimensions of protrusions and recesses of the analysis model are shown in FIG. 12A and FIG. 12B. Moreover, it is shown as No. 3 in the analysis result graphs (FIG. 19 and FIG. 20). In this Comparative Example 3, there is made an arrangement such that the distance between the centers of an adjacent protrusion 14 and a recess 16 is 34.64 mm, and the center point is positioned at the apex of an equilateral triangle. The diameter of the truncated cone top surface of each protrusion 14 and each recess 16 is 27 mm, the diameter of the truncated cone bottom surface is 30 mm, and the protrusion dimension of the protrusion 14 and the recess dimension of the recess 16 from the flat surface section 12 are both 1.5 mm. Moreover, the distance between the protrusion 14 and the truncated cone top surface of the recess 16 is 3 mm, and the inclination angle of the truncated cones of the protrusion 14 and the recess 16 is 45°.

Figure 13A:
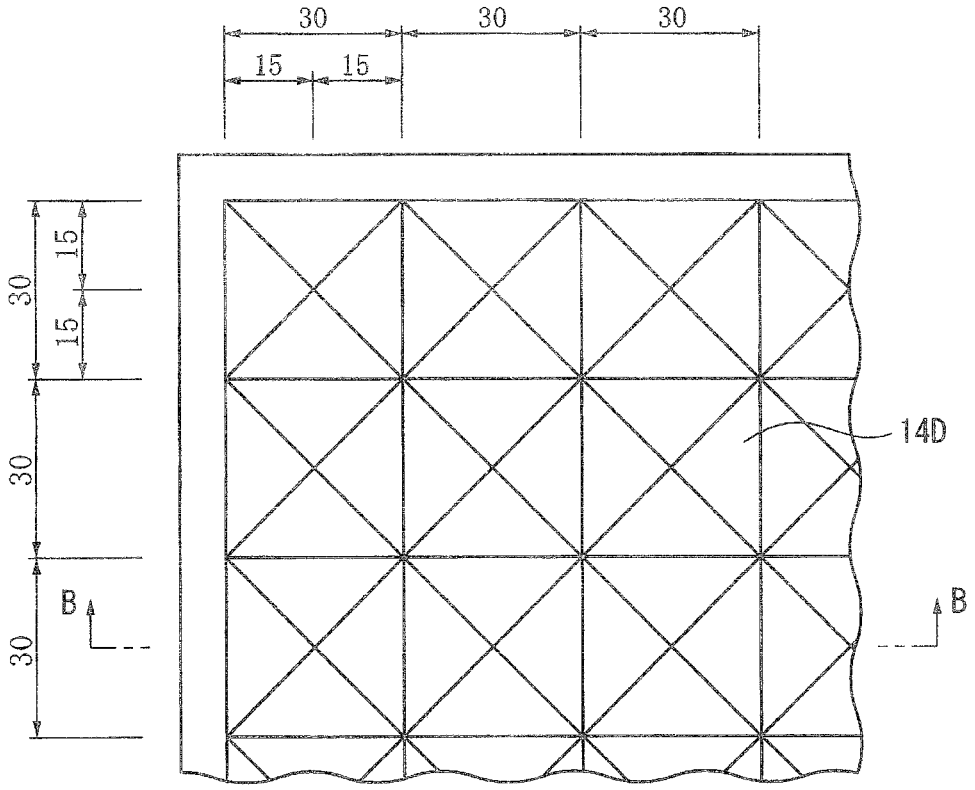
FIG. 13A is an analysis model diagram viewed from the front of Comparative Example 4 (No. 4) in the example.
Figure 13B:
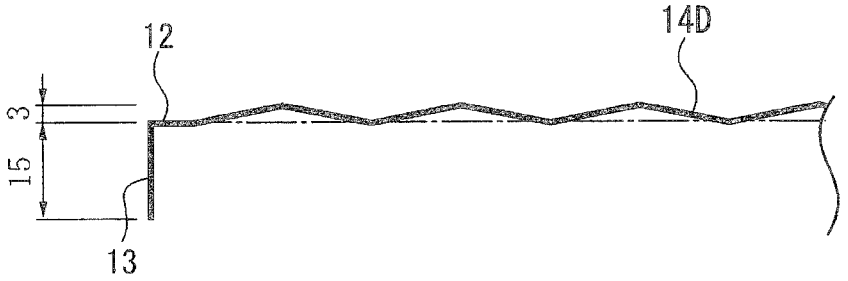
FIG. 13B is an analysis model diagram viewed from the cross-section of Comparative Example 4 (No. 4) in the example.

Comparative Example 4 uses a panel 10D shown in FIG. 8, and the arrangement and dimensions of protrusions and recesses of the analysis model are shown in FIG. 13A and FIG. 13B. Moreover, it is shown as No. 4 in the analysis result graphs (FIG. 19 and FIG. 20). In this Comparative Example 4, the distance between the centers of adjacent protrusions 14D is 30 mm, that is to say, the planar dimension of each protrusion 14D is 30 mm×30 mm, and the protrusion dimension of the protrusion 14D from the flat surface section 12, that is, the height of the apex of the quadrangular pyramid is 3 mm.

Examples

Figure 14A:
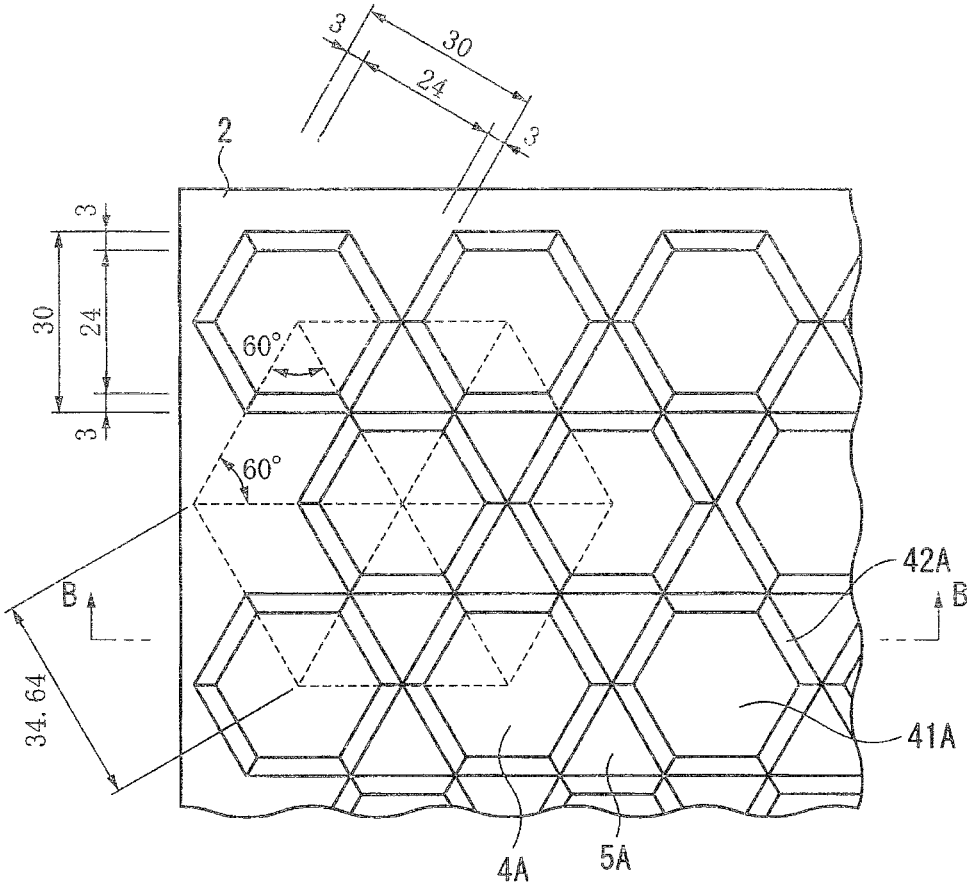
FIG. 14A is an analysis model diagram viewed from the front of Example 1 (No. 5) in the example.
Figure 14B:
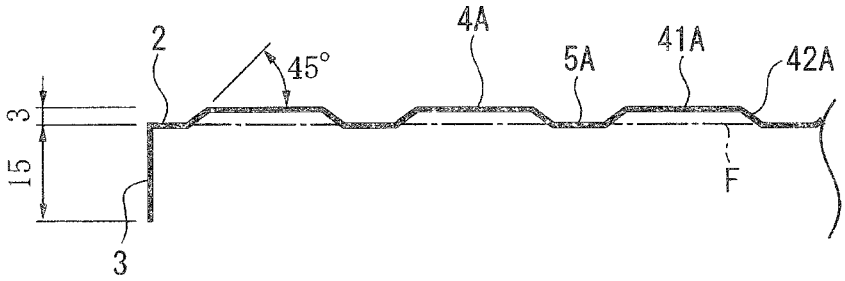
FIG. 14B is an analysis model diagram viewed from the cross-section of Example 1 (No. 5) in the example.

Example 1 uses a panel 1A shown in FIG. 1 and FIG. 6A, and the arrangement and dimensions of protrusions and recesses of the analysis model are shown in FIG. 14A and FIG. 14B. Moreover, it is shown as No. 5 in the analysis result graphs (FIG. 19 and FIG. 20). In this panel 1A of Example 1, the distance between the centers of adjacent protrusions 4A is 34.64 mm, the center point is positioned at the apex of an equilateral triangle, the distance between the opposite edges of the hexagonal frustrum top surface of each protrusion 4A is 24 mm, the distance between the opposite edges of the hexagonal frustrum bottom surface is 30 mm, and the flat surface equilateral triangle surrounded by hexagonal frustrum bottom surfaces serves as each flat section 5A. Furthermore, the protrusion dimension of the protrusion 4A from the flat surface section 2 is 3 mm, and the inclination angle of the inclined surface section 42A of each protrusion 4A with respect to the reference surface F is 45°.

Figure 15A:
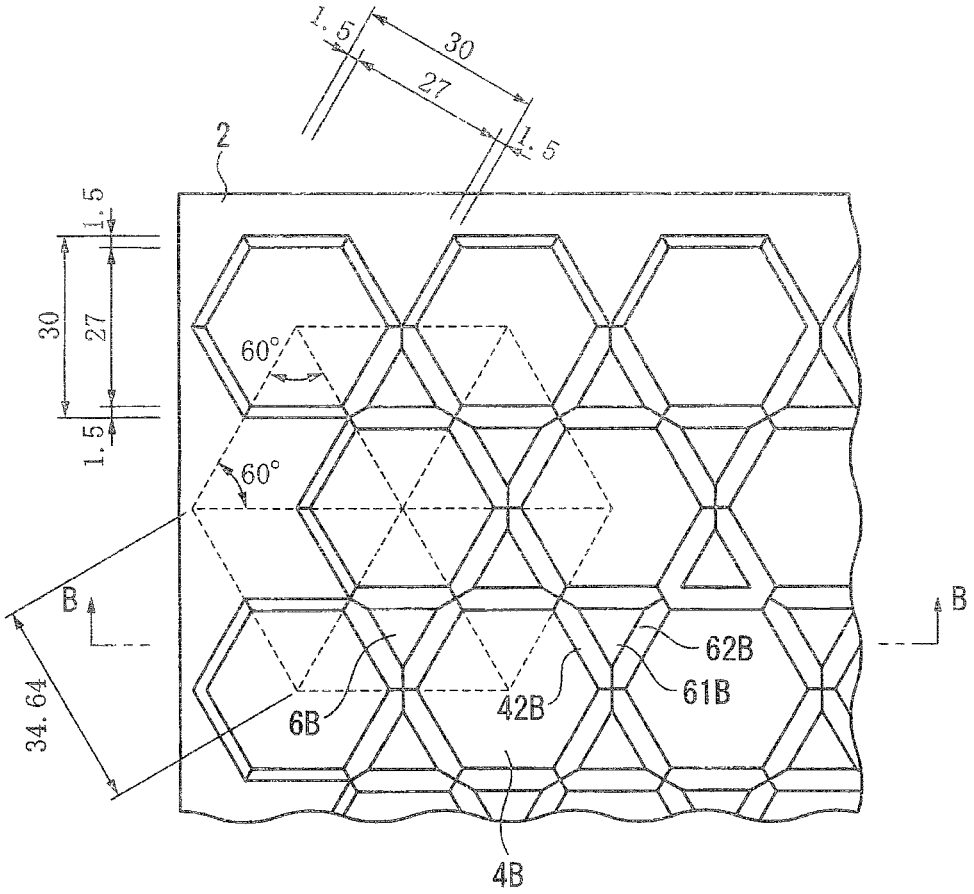
FIG. 15A is an analysis model diagram viewed from the front of Example 2 (No. 6) in the example.
Figure 15B:
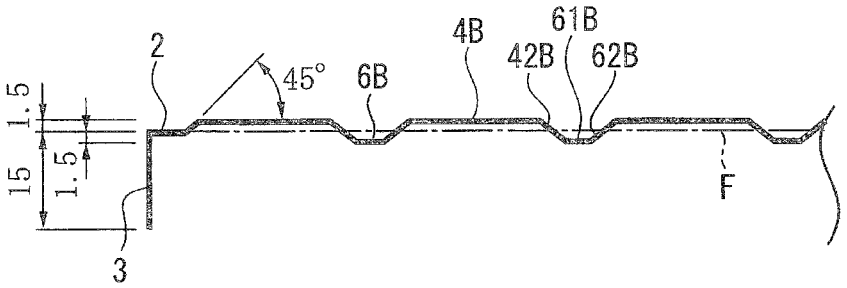
FIG. 15B is an analysis model diagram viewed from the cross-section of Example 2 (No. 6) in the example.

Example 2 uses a panel 1B shown in FIG. 2 and FIG. 6B, and the arrangement and dimensions of protrusions and recesses of the analysis model are shown in FIG. 15A and FIG. 15B. Moreover, it is shown as No. 6 in the analysis result graphs (FIG. 19 and FIG. 20). In this panel 1B of Example 2, the distance between the centers of adjacent protrusions 4B is 34.64 mm, and the center point is positioned at the apex of the equilateral triangle, the distance between the opposite edges of the hexagonal frustrum top surface of each protrusion 4B is 27 mm, and the distance between the opposite edges of the hexagonal frustrum bottom surface is 30 mm. Moreover, in each region surrounded by the hexagonal frustrum bottom surfaces, there is provided a triangular frustrum each serving as a recess 6B. Furthermore, the protrusion dimension of each protrusion 4B from the flat surface section 2 is 1.5 mm, and the recess dimension of each recess 6B from the flat surface section 2 is 1.5 mm. Moreover, the distance between the hexagonal frustrum top surface of each protrusion 4B and the triangular frustrum top surface of each recess 6B is 3 mm, and the inclination angles of the inclined surface section 42B of the protrusion 4A and the inclination angle of the inclined surface section 62B of the recess 6B with respect to the reference surface F are respectively 45°.

Figure 16A:
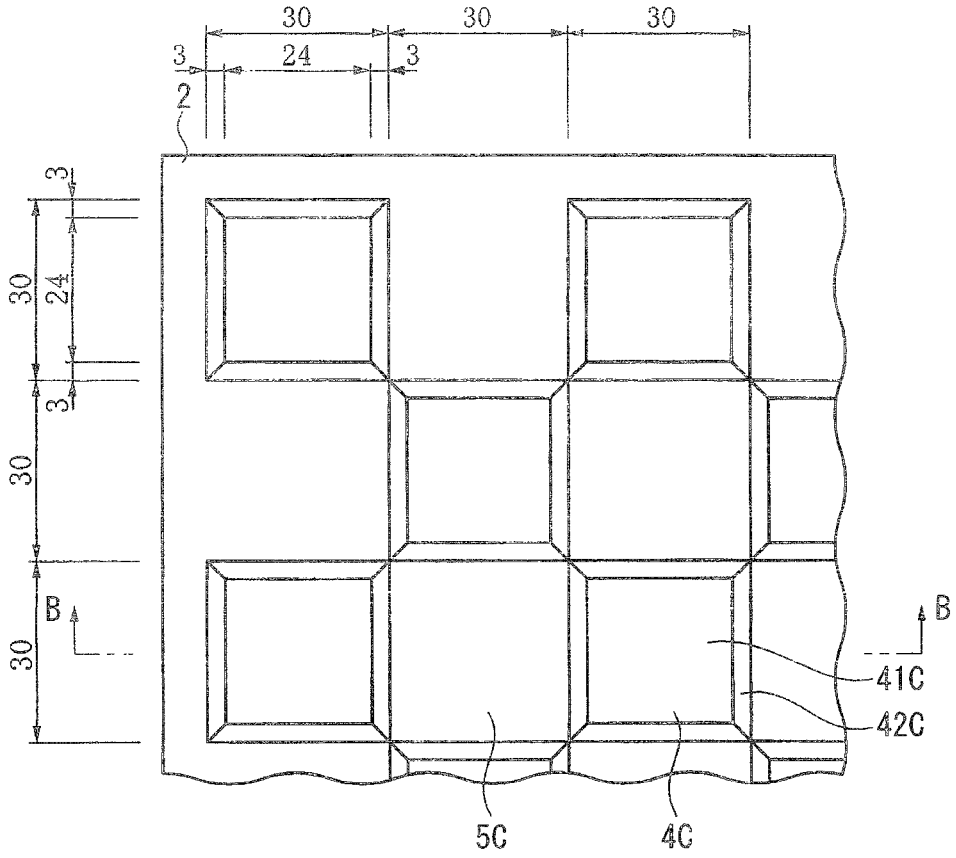
FIG. 16A is an analysis model diagram viewed from the front of Example 3 (No. 7) in the example.
Figure 16B:
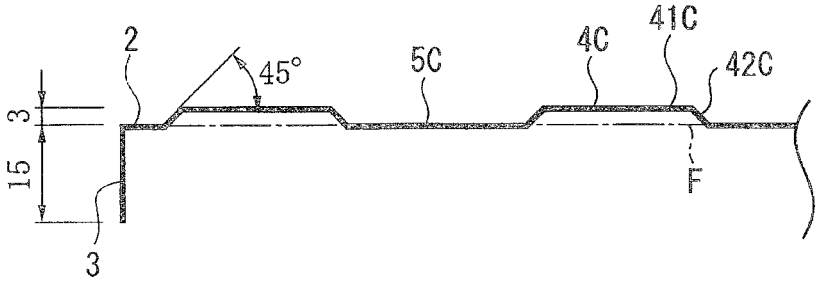
FIG. 16B is an analysis model diagram viewed from the cross-section of Example 3 (No. 7) in the example.

Example 3 uses a panel 1C shown in FIG. 3 and FIG. 6C, and the arrangement and dimensions of protrusions and recesses of the analysis model are shown in FIG. 16A and FIG. 16B. Moreover, it is shown as No. 7 in the analysis result graphs (FIG. 19 and FIG. 20). In this panel 1C of Example 3, the distance between the centers of adjacent protrusions 4C is 30 mm, that is to say, the length of each edge of the quadrangular frustrum bottom surface of each protrusion 4C is 30 mm, and the length of each edge of the quadrangular frustrum top surface is 24 mm. Furthermore, the protrusion dimension of the protrusion 4C from the flat surface section 2 is 3 mm, and the inclination angle of the inclined surface section 42C of each protrusion 4C with respect to the reference surface F is 45°.

Figure 17A:
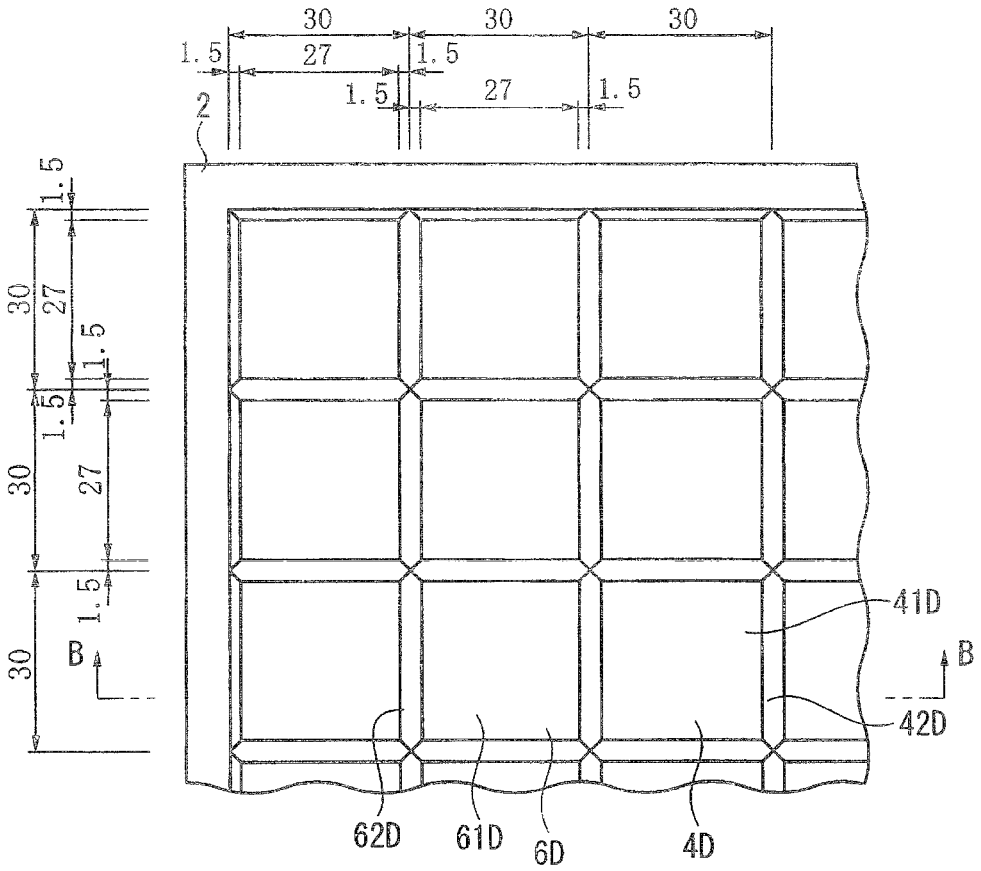
FIG. 17A is an analysis model diagram viewed from the front of Example 4 (No. 8) in the example.
Figure 17B:
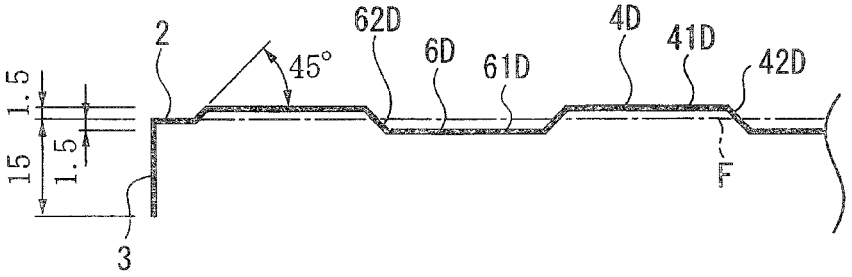
FIG. 17B is an analysis model diagram viewed from the cross-section of Example 4 (No. 8) in the example.

Example 4 uses a panel 1D shown in FIG. 4 and FIG. 6D, and the arrangement and dimensions of protrusions and recesses of the analysis model are shown in FIG. 17A and FIG. 17B. Moreover, it is shown as No. 8 in the analysis result graphs (FIG. 19 and FIG. 20). In this panel 1D of Example 4, the distance between the centers of adjacent protrusions 4D is 30 mm, that is to say, the length of each edge of the quadrangular frustrum bottom surface of each planarly regular-quadrangular-shaped protrusion 4D is 30 mm, the length of each edge of the quadrangular frustrum top surface thereof is 27 mm, the length of each edge of the quadrangular frustrum bottom surface of each recess 6D is 30 mm, and the length of each edge of the quadrangular frustrum top surface thereof is 27 mm. Furthermore, the protrusion dimension of each protrusion 4D from the flat surface section 2 is 1.5 mm, and the recess dimension of each recess 6D from the flat surface section 2 is 1.5 mm. Moreover, the distance between the quadrangular frustrum top surface of each protrusion 4D and the quadrangular frustrum top surface of each recess 6D is 3 mm, and the inclination angle of the inclined surface section 42D of the protrusion 4D and the inclination angle of the inclined surface section 62D of the recess 6D with respect to the reference surface F are respectively 45°.

In this Example 4, the planar shapes and the planar dimensions of the protrusion 4D and the recess 6D are the same. As a result, a well balanced resistance can be provided with respect to both an external force from the protruding side of the panel and an external force from the recessed side of the panel.

Furthermore, in this Example 4, the protrusion dimension of the protrusion and the recess dimension of the recess perpendicular to the reference surface are the same. Also in this case, a well balanced resistance can be provided with respect to both an external force from the protruding side of the panel and an external force from the recessed side of the panel.

Figure 18A:
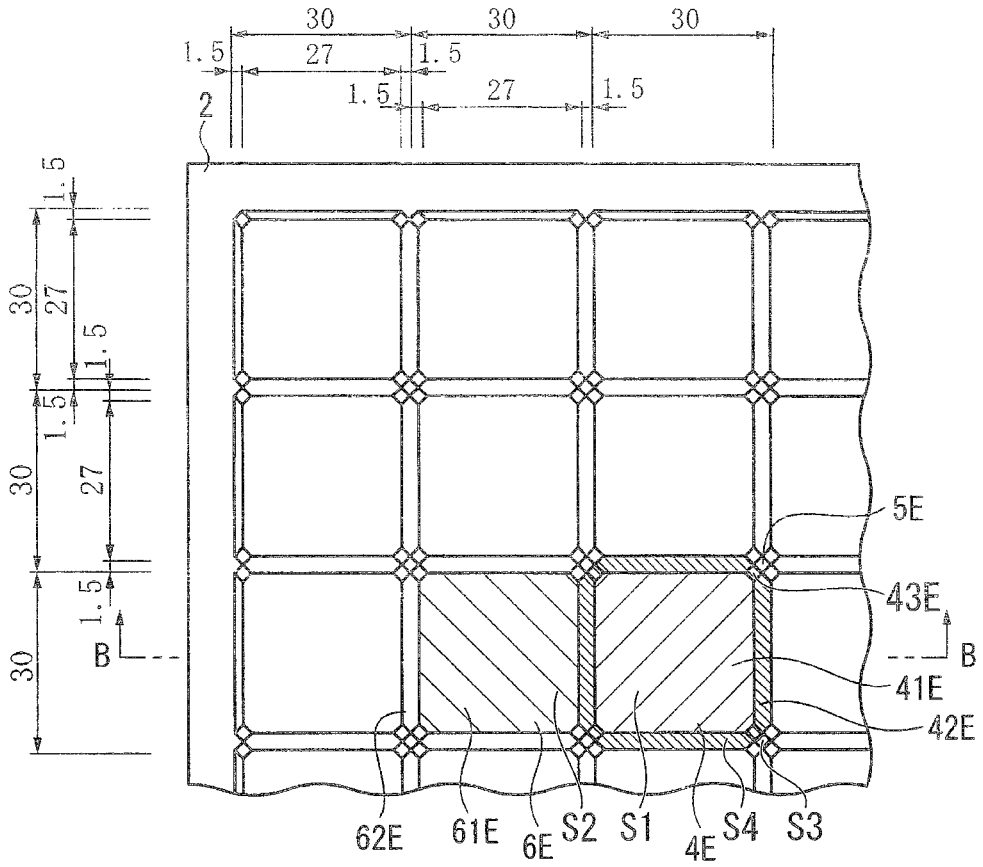
FIG. 18A is an analysis model diagram viewed from the front of Example 5 (No. 9) in the example.
Figure 18B:
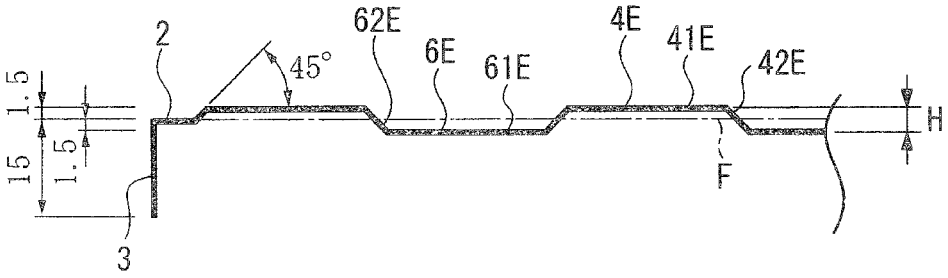
FIG. 18B is an analysis model diagram viewed from the cross-section of Example 5 (No. 9) in the example.

Example 5 uses a panel 1E shown in FIG. 5 and FIG. 6E, and the arrangement and dimensions of protrusions and recesses of the analysis model are shown in FIG. 18. Moreover, it is shown as No. 9 in the analysis result graphs (FIG. 19 and FIG. 20). In this panel 1E of Example 5, the distance between the centers of adjacent protrusions 4E is 30 mm, that is to say, the length of each edge of the quadrangular frustrum bottom surface of each planarly regular-quadrangular-shaped protrusion 4E is 30 mm, the length of each edge of the quadrangular frustrum top surface thereof is 27 mm, the length of each edge of the quadrangular frustrum bottom surface of each recess 6E is 30 mm, and the length of each edge of the quadrangular frustrum top surface thereof is 27 mm. Furthermore, the protrusion dimension of each protrusion 4E from the flat surface section 2 is 1.5 mm, and the recess dimension of each recess 6E from the flat surface section 2 is 1.5 mm. Moreover, the distance between the quadrangular frustrum top surface of each protrusion 4E and the quadrangular frustrum top surface of each recess 6E is 3 mm, and the inclination angle of the inclined surface section 42E of the protrusion 4E and the inclination angle of the inclined surface section 62E of the recess 6E with respect to the reference surface F are respectively 45°. Moreover, in the panel 1E of Example 5, the chamfer dimensions of the protrusion 4E and the recess 6E are respectively 1.5 mm, that is to say, the length of the respective diagonal lengths of each top flat section 5E of the regular quadrangular shape are 3 mm, and the inclination angles of the corner section inclined surface 43E and the corner section inclined surface 63E with respect to the reference surface F are respectively 45°.

FIG. 19 and FIG. 20 show FEM analysis results. FIG. 19 is a graph showing rigidity ratios in the bending model in which there are shown values found by dividing vertical displacement of the panel center in the panel 10A of Comparative Example 1 by vertical displacement of the panel center in the panels 1 and 10 of the respective examples and comparative examples. FIG. 20 is a graph showing rigidity ratios in the torsion model in which there are shown values found by dividing vertical displacement of the load application position in the panel 10A of Comparative Example 1 by vertical displacement of the load application position in the panels 1 and 10 of the respective examples and comparative examples. That is to say, FIG. 19 and FIG. 20 show the ratio of increments in bending rigidity and torsional rigidity of the panels 1A to 1E of Examples 1 to 5 and the panels 10B to 10D of Comparative Examples 2 to 4, with respect to the panel 10A of Comparative Example 1, which has no protrusion and recess. The vertical axis in FIG. 19 and FIG. 20 each represents rigidity ratio.

As shown in FIG. 19, with respect to the panel 10A of Comparative Example 1 (No. 1), the bending rigidity of the panels 10B to 10D of Comparative Examples 2 to 4 (No. 2, 3, and 4) increased by only 1.9 times to 2.32 times, and the bending rigidity of the panels 1A to 1C of Examples 1 to 3 (No. 5 to 7) increased by only 2.35 times to 2.75 times. Meanwhile, the bending rigidity of the panels 1D and 1E of Examples 4 and 5 (No. 8 and 9) increased by 3.98 times and 3.74 times, that is, nearly four times that of the panel 10A of Comparative Example 1. As mentioned above, it has been learned that in the panels 1A to 1C of Examples 1 to 3 according to the embodiments of the present invention, the level of bending rigidity increases to a level similar to or higher than that of the conventional panels 10B and 10C having protrusions and recesses (Comparative Examples 2 and 3). Furthermore, it has been learned that in the panels 1D and 1E of Examples 4 and 5 according to the embodiments of the present invention, the level of bending rigidity increases by approximately 1.6 to 1.9 times compared to the conventional panels 10B and 10C.

As shown in FIG. 20, with respect to the panel 10A of Comparative Example 1 (No. 1), the torsional rigidity of the panels 10B to 10D of Comparative Examples 2 to 4 (No. 2, 3, and 4) increased by only 1.18 times to 1.58 times, and the torsional rigidity of the panels 1A to 1C of Examples 1 to 3 (No. 5 to 7) increased by only 1.49 times to 1.56 times. Meanwhile, the torsional rigidity of the panels 1D and 1E of Examples 4 and 5 (No. 8 and 9) increased by 3.26 times and 3.34 times, that is, more than three times that of the panel 10A of Comparative Example 1. As mentioned above, it has been learned that in the panels 1A to 1C of Examples 1 to 3 according to the embodiments of the present invention, the level of torsional rigidity increases to a level similar to that of the conventional panels 10B and 10C having protrusions and recesses (Comparative Examples 2 and 3). Furthermore, it has been learned that in the panels 1D and 1E of Examples 4 and 5 according to the embodiments of the present invention, the level of torsional rigidity increases by approximately 2.1 to 2.2 times compared to the conventional panels 10B and 10C.

The following knowledge has been learned from the above examples.

That is to say, compared to the comparative examples in which the flat surface section 12 and the flat section 15 are continuous, in the panels of Examples 1 to 5 in which the flat sections 5A, 5C and the top flat section 5E are not continuous with each other, and the protrusions 4A to 4E and the recesses 6B, 6D, and 6E are not continuous with each other, it is possible to increase the level of bending rigidity and torsional rigidity. In particular, in Examples 4 and 5 in which the protrusions 4D, 4E and the recesses 6D, 6E are arranged in a checkered pattern, the ratio of increment in the bending rigidity and torsional rigidity is high, and it is possible to dramatically increase the level of rigidity.

Figure 23A:
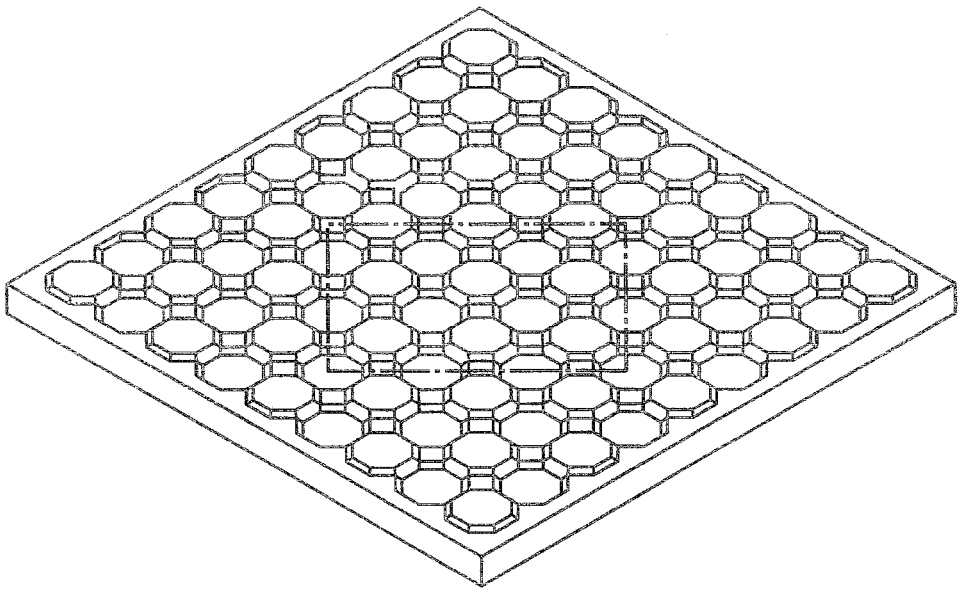
FIG. 23A is a perspective view showing a panel according to another modified example.
Figure 23B:
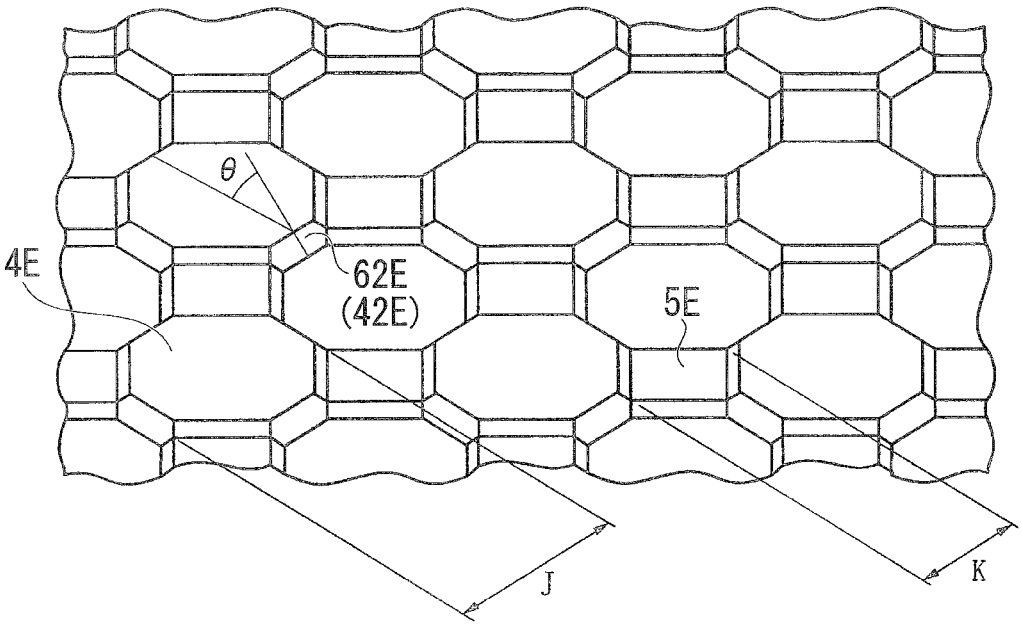
FIG. 23B is an enlarged perspective view showing the panel according to the other modified example.

The dimensions of the respective sections of the panel 1 shown in the above examples are merely an example, and they may be appropriately changed according to the intended purpose. An effect in the case of further changing the dimension of the respective sections of the panel 1 from those in the above example is described based on FIG. 21A to FIG. 27B and Tables 1 to 10. Here, the dimensions of the respective sections of the panel 1 are denoted by symbols shown in FIG. 21A to FIG. 23B. The dimensions of the respective sections in FIG. 21A to FIG. 22D respectively illustrate: the distance H between the quadrangular frustrum top surface of the protrusion and the quadrangular frustrum top surface of the recess; the plate thickness t; the length J of each edge of the quadrangular frustrum bottom surface of the protrusion and the recess; the inclination angle θ of the inclined surfaces of the protrusion and the recess with respect to the reference surface F; the number m of the protrusions and the recesses; and the panel size L and the panel size L' excluding the flat surface section of the panel periphery. Moreover, the dimensions of the respective sections in FIG. 23A and FIG. 23B respectively illustrate the length J of each edge of the quadrangular frustrum bottom surface, and the diagonal length K of the top flat section.

Figure 24A:
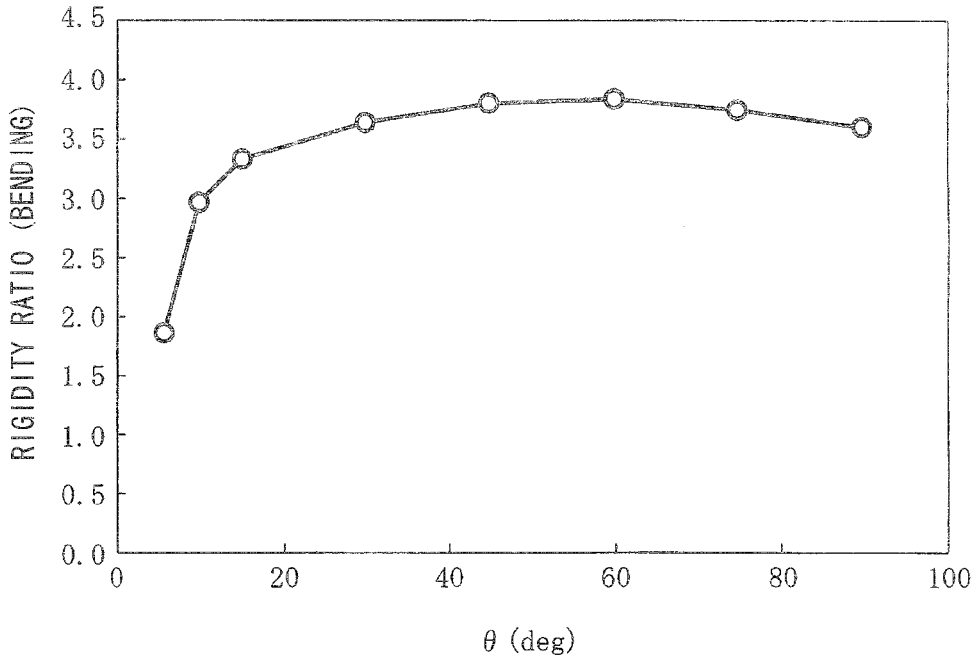
FIG. 24A is a graph showing rigidity ratios (bending) in the case where the inclination angle of the inclined surface sections of the protrusions and recesses is changed in another modified example.
Figure 24B:
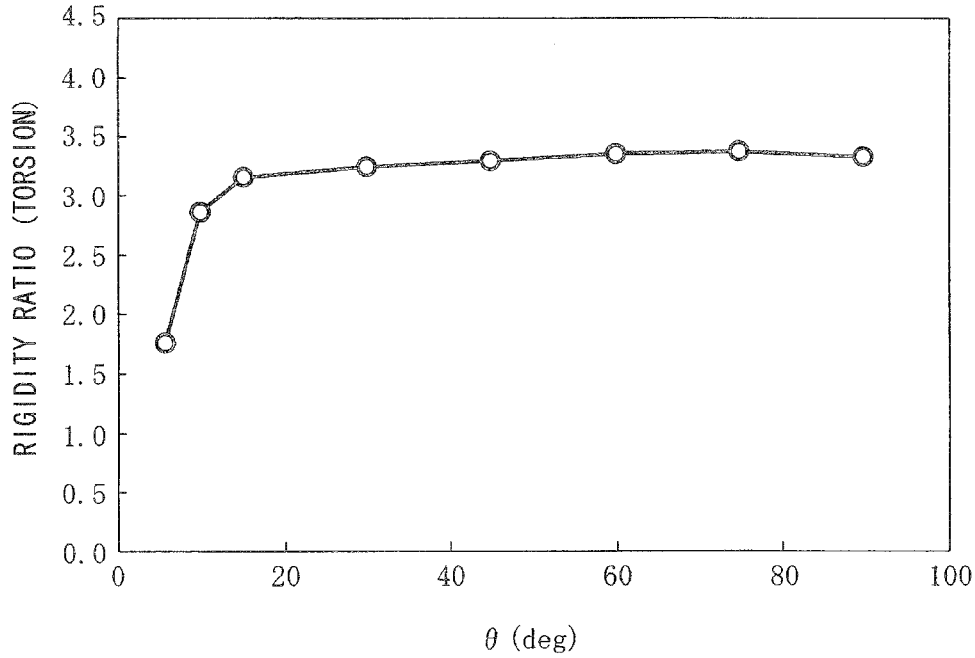
FIG. 24B is a graph showing rigidity ratios (torsion) in the case where the inclination angle of the inclined surface sections of the protrusions and recesses is changed in another modified example.

Taking the panel shape of Example 4 as a base, respective rigidity ratios of bending rigidity and torsional rigidity in the case of changing the inclination angle θ with use of the dimensions of the respective sections of the panel shown in Tables 1 and 2 (as with Comparative Example 1, a panel having no protrusions and recesses is taken as the reference of comparison) are shown in FIG. 24A and FIG. 24B. Here, Tables 1 and 2 each show bending rigidity ratio (Table 1) and torsional rigidity ratio (Table 2) in the case of changing the inclination angle θ of the protrusions and the recesses. In each shape where θ=5.7° to 90°, an improvement can be seen in bending rigidity and torsional rigidity with any inclination angle θ. Moreover, within the range of θ=10° to 90°, the level of rigidity markedly improved with roughly 3 times or more increase in the bending rigidity ratio and torsional rigidity ratio. Furthermore, within the range of θ=45° to 75°, the level of rigidity significantly improved with 3.8 times increase in bending rigidity and 3.3 times or more increase in torsional rigidity. That is to say, in the panel of this Example 4, it is possible to provide a panel with a high level of rigidity ratio regardless of the inclination angle θ.

Figure 25A:
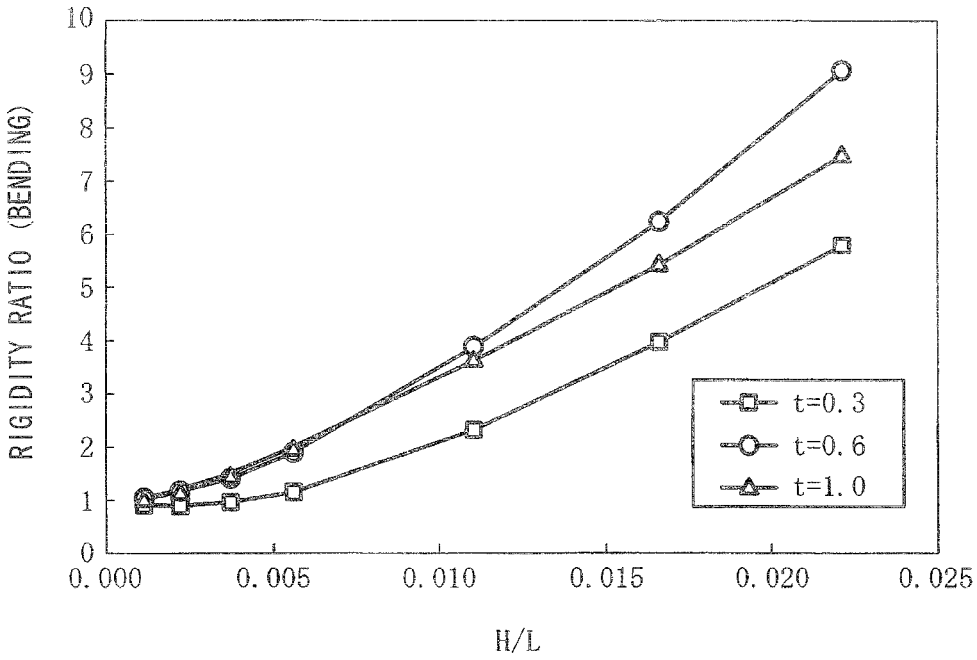
FIG. 25A is a graph showing rigidity ratios (bending) in the case where the distance between the top surfaces of the protrusions and recesses are changed in another modified example.
Figure 25B:
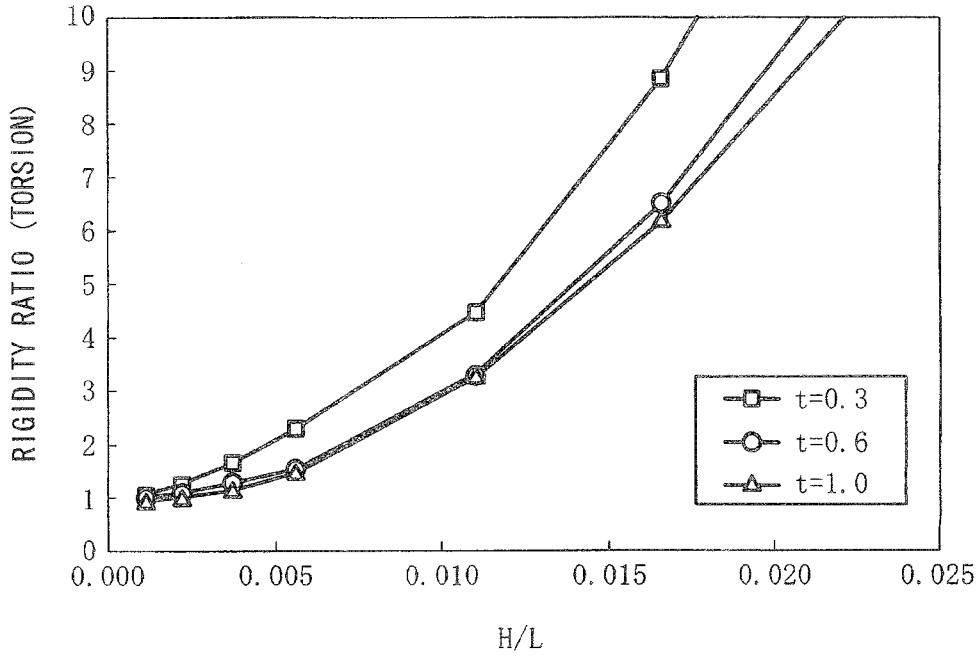
FIG. 25B is a graph showing rigidity ratios (torsion) in the case where the distance between the top surfaces of the protrusions and recesses are changed in another modified example.

Taking the panel shape of Example 4 as a base, respective rigidity ratios of bending rigidity and torsional rigidity in the case of changing the distance H between the top surface of the quadrangular frustrum of the protrusion and the top surface of the quadrangular frustrum of the recess with use of the dimensions of the respective sections of the panel shown in Tables 3 to 8 (a panel having no protrusions and recesses is taken as the reference of comparison) are shown in FIG. 25. Here, Tables 3 to 8 each show bending rigidity ratios (Tables 3, 5, and 7) and torsional rigidity ratios (Tables 4, 6, and 8) in the case of changing the distance H between the top surfaces of the quadrangular frustrums of the protrusion and the recesses, where the plate thickness is t=0.3 mm in Tables 3 and 4, the plate thickness is t=0.6 mm in Tables 5 and 6, and the plate thickness is t=1.0 mm in Tables 7 and 8. Although there were some increments and decrements, in all plate thicknesses, the level of both bending rigidity and torsional rigidity improved roughly by twice within the range of H/L≥0.005, and the level of both bending rigidity and torsional rigidity improved roughly by three times within the range of H/L≥0.01. Regarding the relationship between plate thickness t and distance H, an improvement was seen in the level of rigidity in the relationships between all plate thicknesses t and distances H. Here, rigidity in particular tends to improve when roughly H≥t or higher, that is to say, within the range of H/t≥1.0.

Figure 26A:
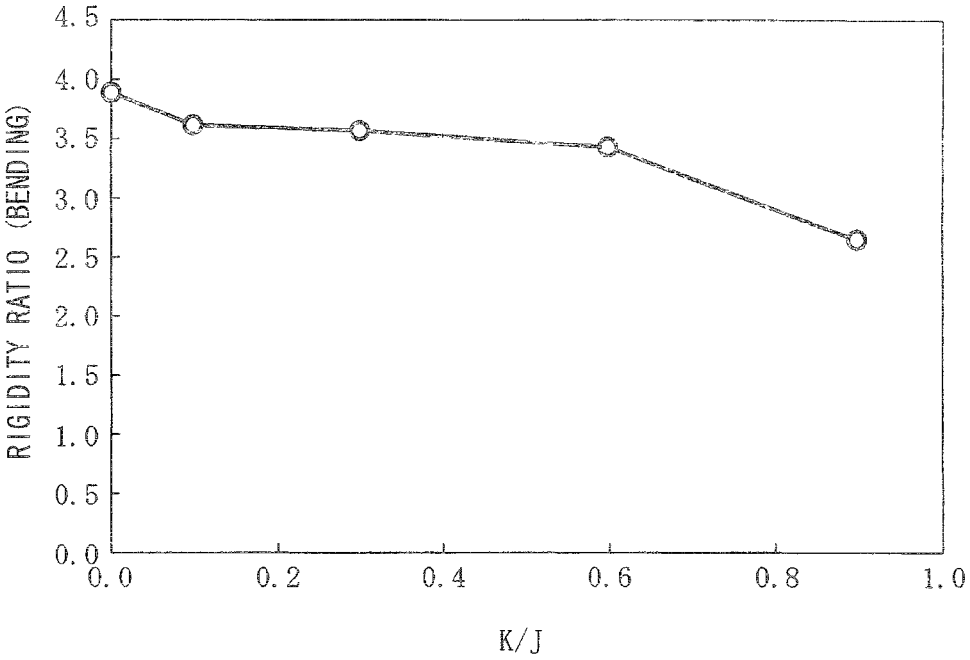
FIG. 26A is a graph showing rigidity ratios (bending) in the case where the diagonal length of the top flat sections is changed in another modified example.
Figure 26B:
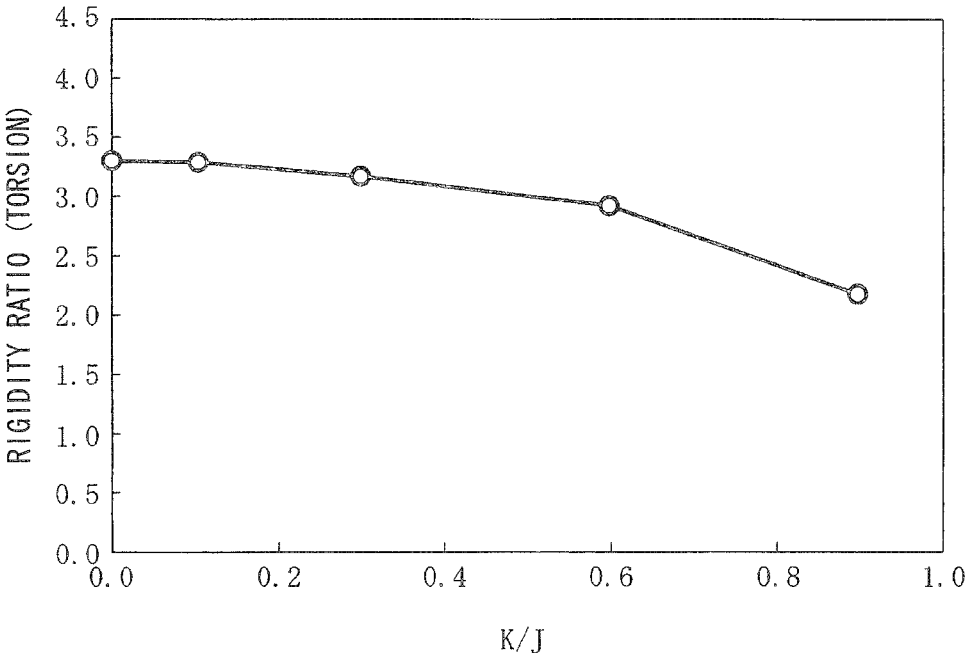
FIG. 26B is a graph showing rigidity ratios (torsion) in the case where the diagonal length of the top flat sections is changed in another modified example.

Taking the panel shape of Example 5 as a base, respective rigidity ratios of bending rigidity and torsional rigidity in the case of changing the diagonal length K of the top flat section with use of the dimensions of the respective sections of the panel shown in Tables 9 and 10 (a panel having no protrusions and recesses is taken as the reference of comparison) are shown in FIG. 26A and FIG. 26B. Here, Tables 9 and 10 each show bending rigidity ratio (Table 9) and torsional rigidity ratio (Table 10) in the case of changing the diagonal length K of the top flat section. Within the range of K/J=0 to 0.9, an improvement was seen in the level of bending rigidity and torsional rigidity, and within the range of K/J=0 to 0.6 in particular, the level of rigidity markedly improved with roughly three times or more increase in the rigidity ratio.

Figure 27A:
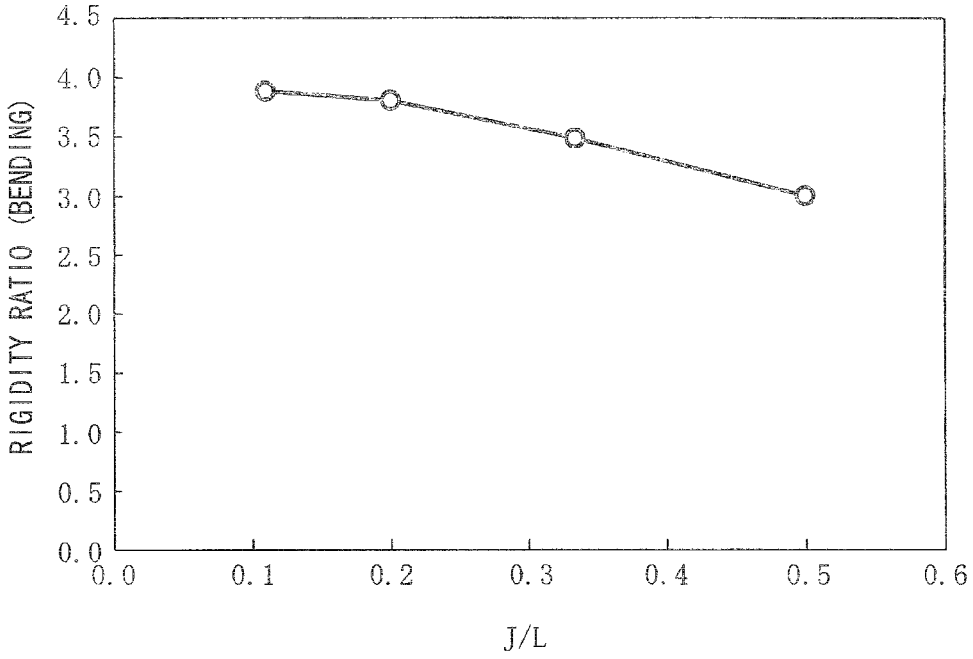
FIG. 27A is a graph showing rigidity ratios (bending) in the case where the sizes of the protrusions and the recesses with respect to the panel size are changed in another modified example.
Figure 27B:
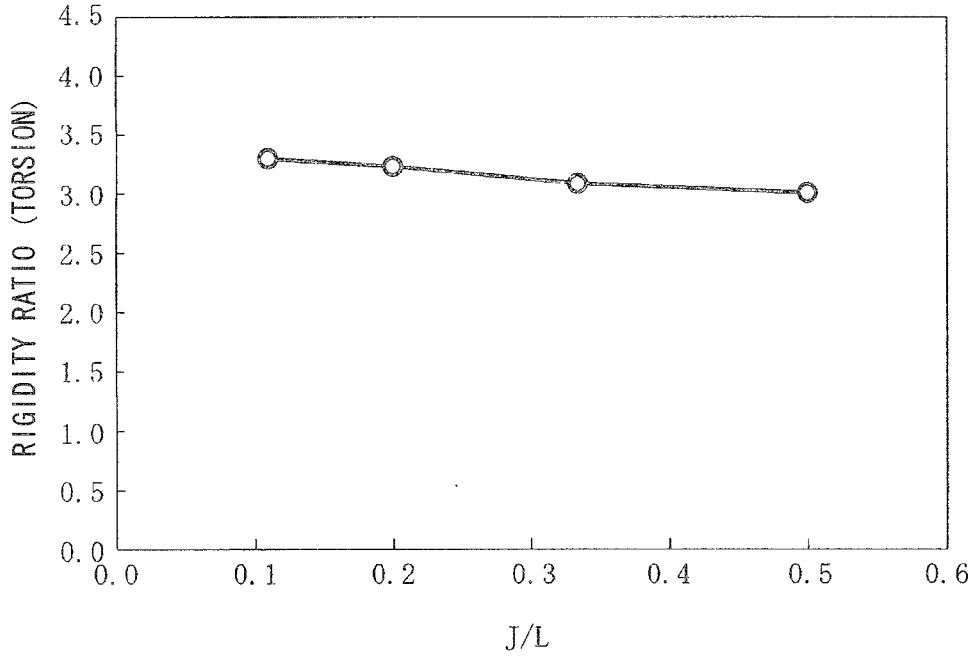
FIG. 27B is a graph showing rigidity ratios (torsion) in the case where the sizes of the protrusions and the recesses with respect to the panel size are changed in another modified example.

Taking the panel shape of Example 4 as a base, respective rigidity ratios of bending rigidity and torsional rigidity in the case of changing the ratio of the length J of each edge of the quadrangular frustum bottom surface of the protrusion and recess with respect to the panel size L (corresponding to the inverse number of the number m of protrusions and recesses) with use of the dimensions of the respective sections of the panel shown in Tables 11 and 12 (a panel having no protrusions and recesses is taken as the reference of comparison), are shown in FIG. 27A and FIG. 28B. Here, Table 11 shows bending rigidity ratios, and Table 12 shows torsional rigidity ratios. Since the panel size of each model is different, rigidity ratios are obtained by making a comparison based on the rigidity in a deformation range which produces a deflection angle and a torsion angle equivalent to the deflection angle and the torsion angle due to torsional deformation, created as a result of bending deformation at the time of applying a load 10N on the model of panel size L=270 mm (L'=285 mm).

Within the range of J/L≤0.5, an improvement is seen in the level of bending rigidity and torsional rigidity. Here, an improvement is seen in the level of rigidity also when J/L=0.5, that is to say, also with a checkered pattern, which is formed with a combination of a minimum number of protrusions and recesses including two protrusions and two recesses. That is to say, as a special form of configuration of protrusions and recesses, other than the configuration in which protrusions and recesses alternately surround four edges, there may be provided a configuration such that two edges among the peripheral edges of the protrusion and the recess are surrounded by flat sections, the surfaces of which are different from the top surface of the quadrangular frustrum.

TABLE 1

| H (mm) | t (mm) | J (mm) | θ (deg) | m (number) | L (mm) | L' (mm) | Rigidity (N/mm) | Rigidity Ratio | H/J | t/J | H/L | H/L' | t/L | t/L' | H/t | Remarks |
|---|---|---|---|---|---|---|---|---|---|---|---|---|---|---|---|---|
| — | 0.6 | — | — | — | — | 285 | 8.95 | 1.00 | — | — | — | — | — | — | — | Reference |
| 3 | 0.6 | 30 | 5.7 | 9 | 270 | 285 | 16.8 | 1.87 | 0.100 | 0.020 | 0.011 | 0.011 | 0.002 | 0.002 | 5.00 | |
| 3 | 0.6 | 30 | 10 | 9 | 270 | 285 | 26.7 | 2.99 | 0.100 | 0.020 | 0.011 | 0.011 | 0.002 | 0.002 | 5.00 | |
| 3 | 0.6 | 30 | 15 | 9 | 270 | 285 | 29.9 | 3.34 | 0.100 | 0.020 | 0.011 | 0.011 | 0.002 | 0.002 | 5.00 | |
| 3 | 0.6 | 30 | 30 | 9 | 270 | 285 | 32.6 | 3.65 | 0.100 | 0.020 | 0.011 | 0.011 | 0.002 | 0.002 | 5.00 | |
| 3 | 0.6 | 30 | 45 | 9 | 270 | 285 | 34.1 | 3.81 | 0.100 | 0.020 | 0.011 | 0.011 | 0.002 | 0.002 | 5.00 | |
| 3 | 0.6 | 30 | 60 | 9 | 270 | 285 | 34.4 | 3.85 | 0.100 | 0.020 | 0.011 | 0.011 | 0.002 | 0.002 | 5.00 | |
| 3 | 0.6 | 30 | 75 | 9 | 270 | 285 | 33.6 | 3.75 | 0.100 | 0.020 | 0.011 | 0.011 | 0.002 | 0.002 | 5.00 | |
| 3 | 0.6 | 30 | 90 | 9 | 270 | 285 | 32.3 | 3.61 | 0.100 | 0.020 | 0.011 | 0.011 | 0.002 | 0.002 | 5.00 | |

TABLE 2

| H (mm) | t (mm) | J (mm) | θ (deg) | m (number) | L (mm) | L' (mm) | Rigidity (N/mm) | Rigidity Ratio | H/J | t/J | H/L | H/L' | t/L | t/L' | H/t | Remarks |
|---|---|---|---|---|---|---|---|---|---|---|---|---|---|---|---|---|
| — | 0.6 | — | — | — | — | 285 | 0.37 | 1.00 | — | — | — | — | — | — | — | Reference |
| 3 | 0.6 | 30 | 5.7 | 9 | 270 | 285 | 0.65 | 1.75 | 0.100 | 0.020 | 0.011 | 0.011 | 0.002 | 0.002 | 5.00 | |
| 3 | 0.6 | 30 | 10 | 9 | 270 | 285 | 1.05 | 2.85 | 0.100 | 0.020 | 0.011 | 0.011 | 0.002 | 0.002 | 5.00 | |
| 3 | 0.6 | 30 | 15 | 9 | 270 | 285 | 1.16 | 3.14 | 0.100 | 0.020 | 0.011 | 0.011 | 0.002 | 0.002 | 5.00 | |
| 3 | 0.6 | 30 | 30 | 9 | 270 | 285 | 1.20 | 3.24 | 0.100 | 0.020 | 0.011 | 0.011 | 0.002 | 0.002 | 5.00 | |
| 3 | 0.6 | 30 | 45 | 9 | 270 | 285 | 1.22 | 3.29 | 0.100 | 0.020 | 0.011 | 0.011 | 0.002 | 0.002 | 5.00 | |
| 3 | 0.6 | 30 | 60 | 9 | 270 | 285 | 1.24 | 3.35 | 0.100 | 0.020 | 0.011 | 0.011 | 0.002 | 0.002 | 5.00 | |
| 3 | 0.6 | 30 | 75 | 9 | 270 | 285 | 1.25 | 3.37 | 0.100 | 0.020 | 0.011 | 0.011 | 0.002 | 0.002 | 5.00 | |
| 3 | 0.6 | 30 | 90 | 9 | 270 | 285 | 1.23 | 3.33 | 0.100 | 0.020 | 0.011 | 0.011 | 0.002 | 0.002 | 5.00 | |

TABLE 3

| H (mm) | t (mm) | J (mm) | θ (deg) | m (number) | L (mm) | L' (mm) | Rigidity (N/mm) | Rigidity Ratio | H/J | t/J | H/L | H/L' | t/L | t/L' | H/t | Remarks |
|---|---|---|---|---|---|---|---|---|---|---|---|---|---|---|---|---|
| — | 0.3 | — | — | — | — | 285 | 4.84 | 1.00 | — | — | — | — | — | 0.001 | — | Reference |
| 0.3 | 0.3 | 30 | 45 | 9 | 270 | 285 | 4.86 | 1.00 | 0.010 | 0.010 | 0.001 | 0.001 | 0.001 | 0.001 | 1.00 | H = t |
| 0.6 | 0.3 | 30 | 45 | 9 | 270 | 285 | 4.88 | 1.01 | 0.020 | 0.010 | 0.002 | 0.002 | 0.001 | 0.001 | 2.00 | |
| 1.0 | 0.3 | 30 | 45 | 9 | 270 | 285 | 4.91 | 1.02 | 0.033 | 0.010 | 0.004 | 0.004 | 0.001 | 0.001 | 3.33 | |
| 1.5 | 0.3 | 30 | 45 | 9 | 270 | 285 | 5.77 | 1.19 | 0.050 | 0.010 | 0.006 | 0.006 | 0.001 | 0.001 | 5.00 | |
| 3.0 | 0.3 | 30 | 45 | 9 | 270 | 285 | 11.4 | 2.35 | 0.100 | 0.010 | 0.011 | 0.011 | 0.001 | 0.001 | 10.00 | |
| 4.5 | 0.3 | 30 | 45 | 9 | 270 | 285 | 19.3 | 3.98 | 0.150 | 0.010 | 0.017 | 0.017 | 0.001 | 0.001 | 15.00 | |
| 6.0 | 0.3 | 30 | 45 | 9 | 270 | 285 | 28.0 | 5.80 | 0.200 | 0.010 | 0.022 | 0.022 | 0.001 | 0.001 | 20.00 | |

TABLE 4

| H (mm) | t (mm) | J (mm) | θ (deg) | m (number) | L (mm) | L' (mm) | Rigidity (N/mm) | Rigidity Ratio | H/J | t/J | H/L | H/L' | t/L | t/L' | H/t | Remarks |
|---|---|---|---|---|---|---|---|---|---|---|---|---|---|---|---|---|
| — | 0.3 | — | — | — | — | 285 | 0.12 | 1.0 | — | — | — | — | — | 0.001 | — | Reference |
| 0.3 | 0.3 | 30 | 45 | 9 | 270 | 285 | 0.13 | 1.1 | 0.010 | 0.010 | 0.001 | 0.001 | 0.001 | 0.001 | 1.00 | H = t |
| 0.6 | 0.3 | 30 | 45 | 9 | 270 | 285 | 0.15 | 1.2 | 0.020 | 0.010 | 0.002 | 0.002 | 0.001 | 0.001 | 2.00 | |
| 1.0 | 0.3 | 30 | 45 | 9 | 270 | 285 | 0.21 | 1.7 | 0.033 | 0.010 | 0.004 | 0.004 | 0.001 | 0.001 | 3.33 | |
| 1.5 | 0.3 | 30 | 45 | 9 | 270 | 285 | 0.29 | 2.3 | 0.050 | 0.010 | 0.006 | 0.006 | 0.001 | 0.001 | 5.00 | |
| 3.0 | 0.3 | 30 | 45 | 9 | 270 | 285 | 0.55 | 4.5 | 0.100 | 0.010 | 0.011 | 0.011 | 0.001 | 0.001 | 10.00 | |
| 4.5 | 0.3 | 30 | 45 | 9 | 270 | 285 | 1.08 | 8.8 | 0.150 | 0.010 | 0.017 | 0.017 | 0.001 | 0.001 | 15.00 | |
| 6.0 | 0.3 | 30 | 45 | 9 | 270 | 285 | 1.82 | 14.8 | 0.200 | 0.010 | 0.022 | 0.022 | 0.001 | 0.001 | 20.00 | |

TABLE 5

| H (mm) | t (mm) | J (mm) | θ (deg) | m (number) | L (mm) | L' (mm) | Rigidity (N/mm) | Rigidity Ratio | H/J | t/J | H/L | H/L' | t/L | t/L' | H/t | Remarks |
|---|---|---|---|---|---|---|---|---|---|---|---|---|---|---|---|---|
| — | 0.6 | — | — | — | — | 285 | 8.95 | 1.00 | — | — | — | — | — | 0.002 | — | Reference |
| 0.3 | 0.6 | 30 | 45 | 9 | 270 | 285 | 9.28 | 1.04 | 0.010 | 0.020 | 0.001 | 0.001 | 0.002 | 0.002 | 0.50 | |
| 0.6 | 0.6 | 30 | 45 | 9 | 270 | 285 | 10.3 | 1.15 | 0.020 | 0.020 | 0.002 | 0.002 | 0.002 | 0.002 | 1.00 | H = t |
| 1.0 | 0.6 | 30 | 45 | 9 | 270 | 285 | 13.0 | 1.45 | 0.033 | 0.020 | 0.004 | 0.004 | 0.002 | 0.002 | 1.67 | |
| 1.5 | 0.6 | 30 | 45 | 9 | 270 | 285 | 17.6 | 1.96 | 0.050 | 0.020 | 0.006 | 0.006 | 0.002 | 0.002 | 2.50 | |

TABLE 5-continued

| H (mm) | t (mm) | J (mm) | θ (deg) | m (number) | L (mm) | L' (mm) | Rigidity (N/mm) | Rigidity Ratio | H/J | t/J | H/L | H/L' | t/L | t/L' | H/t | Remarks |
|---|---|---|---|---|---|---|---|---|---|---|---|---|---|---|---|---|
| 3.0 | 0.6 | 30 | 45 | 9 | 270 | 285 | 34.8 | 3.89 | 0.100 | 0.020 | 0.011 | 0.011 | 0.002 | 0.002 | 5.00 | |
| 4.5 | 0.6 | 30 | 45 | 9 | 270 | 285 | 56.0 | 6.26 | 0.150 | 0.020 | 0.017 | 0.017 | 0.002 | 0.002 | 7.50 | |
| 6.0 | 0.6 | 30 | 45 | 9 | 270 | 285 | 81.2 | 9.07 | 0.200 | 0.020 | 0.022 | 0.022 | 0.002 | 0.002 | 10.00 | |

TABLE 6

| H (mm) | t (mm) | J (mm) | θ (deg) | m (number) | L (mm) | L' (mm) | Rigidity (N/mm) | Rigidity Ratio | H/J | t/J | H/L | H/L' | t/L | t/L' | H/t | Remarks |
|---|---|---|---|---|---|---|---|---|---|---|---|---|---|---|---|---|
| — | 0.6 | — | — | — | — | 285 | 0.37 | 1.00 | — | — | — | — | — | 0.002 | — | Reference |
| 0.3 | 0.6 | 30 | 45 | 9 | 270 | 285 | 0.39 | 1.05 | 0.010 | 0.020 | 0.001 | 0.001 | 0.002 | 0.002 | 0.50 | |
| 0.6 | 0.6 | 30 | 45 | 9 | 270 | 285 | 0.44 | 1.18 | 0.020 | 0.020 | 0.002 | 0.002 | 0.002 | 0.002 | 1.00 | H = t |
| 1.0 | 0.6 | 30 | 45 | 9 | 270 | 285 | 0.50 | 1.35 | 0.033 | 0.020 | 0.004 | 0.004 | 0.002 | 0.002 | 1.67 | |
| 1.5 | 0.6 | 30 | 45 | 9 | 270 | 285 | 0.58 | 1.57 | 0.050 | 0.020 | 0.006 | 0.006 | 0.002 | 0.002 | 2.50 | |
| 3.0 | 0.6 | 30 | 45 | 9 | 270 | 285 | 1.22 | 3.29 | 0.100 | 0.020 | 0.011 | 0.011 | 0.002 | 0.002 | 5.00 | |
| 4.5 | 0.6 | 30 | 45 | 9 | 270 | 285 | 2.42 | 6.53 | 0.150 | 0.020 | 0.017 | 0.017 | 0.002 | 0.002 | 7.50 | |
| 6.0 | 0.6 | 30 | 45 | 9 | 270 | 285 | 4.04 | 10.92 | 0.200 | 0.020 | 0.022 | 0.022 | 0.002 | 0.002 | 10.00 | |

TABLE 7

| H (mm) | t (mm) | J (mm) | θ (deg) | m (number) | L (mm) | L' (mm) | Rigidity (N/mm) | Rigidity Ratio | H/J | t/J | H/L | H/L' | t/L | t/L' | H/t | Remarks |
|---|---|---|---|---|---|---|---|---|---|---|---|---|---|---|---|---|
| — | 1.0 | — | — | — | — | 285 | 24.2 | 1.00 | — | — | — | — | — | 0.003509 | — | Reference |
| 0.3 | 1.0 | 30 | 45 | 9 | 270 | 285 | 25.9 | 1.07 | 0.010 | 0.033 | 0.001 | 0.001 | 0.004 | 0.004 | 0.30 | |
| 0.6 | 1.0 | 30 | 45 | 9 | 270 | 285 | 30.0 | 1.24 | 0.020 | 0.033 | 0.002 | 0.002 | 0.004 | 0.004 | 0.60 | |
| 1.0 | 1.0 | 30 | 45 | 9 | 270 | 285 | 38.1 | 1.58 | 0.033 | 0.033 | 0.004 | 0.004 | 0.004 | 0.004 | 1.00 | H = t |
| 1.5 | 1.0 | 30 | 45 | 9 | 270 | 285 | 50.1 | 2.07 | 0.050 | 0.033 | 0.006 | 0.006 | 0.004 | 0.004 | 1.50 | |
| 3.0 | 1.0 | 30 | 45 | 9 | 270 | 285 | 88.9 | 3.67 | 0.100 | 0.033 | 0.011 | 0.011 | 0.004 | 0.004 | 3.00 | |
| 4.5 | 1.0 | 30 | 45 | 9 | 270 | 285 | 132.0 | 5.46 | 0.150 | 0.033 | 0.017 | 0.017 | 0.004 | 0.004 | 4.50 | |
| 6.0 | 1.0 | 30 | 45 | 9 | 270 | 285 | 182.3 | 7.54 | 0.200 | 0.033 | 0.022 | 0.022 | 0.004 | 0.004 | 6.00 | |

TABLE 8

| H (mm) | t (mm) | J (mm) | θ (deg) | m (number) | L (mm) | L' (mm) | Rigidity (N/mm) | Rigidity Ratio | H/J | t/J | H/L | H/L' | t/L | t/L' | H/t | Remarks |
|---|---|---|---|---|---|---|---|---|---|---|---|---|---|---|---|---|
| — | 1.0 | — | — | — | — | 285 | 0.74 | 1.00 | — | — | — | — | — | 0.004 | — | Reference |
| 0.3 | 1.0 | 30 | 45 | 9 | 270 | 285 | 0.75 | 1.01 | 0.010 | 0.033 | 0.001 | 0.001 | 0.004 | 0.004 | 0.30 | |
| 0.6 | 1.0 | 30 | 45 | 9 | 270 | 285 | 0.78 | 1.05 | 0.020 | 0.033 | 0.002 | 0.002 | 0.004 | 0.004 | 0.60 | |
| 1.0 | 1.0 | 30 | 45 | 9 | 270 | 285 | 0.88 | 1.19 | 0.033 | 0.033 | 0.004 | 0.004 | 0.004 | 0.004 | 1.00 | H = t |
| 1.5 | 1.0 | 30 | 45 | 9 | 270 | 285 | 1.11 | 1.49 | 0.050 | 0.033 | 0.006 | 0.006 | 0.004 | 0.004 | 1.50 | |
| 3.0 | 1.0 | 30 | 45 | 9 | 270 | 285 | 2.44 | 3.28 | 0.100 | 0.033 | 0.011 | 0.011 | 0.004 | 0.004 | 3.00 | |
| 4.5 | 1.0 | 30 | 45 | 9 | 270 | 285 | 4.57 | 6.16 | 0.150 | 0.033 | 0.017 | 0.017 | 0.004 | 0.004 | 4.50 | |
| 6.0 | 1.0 | 30 | 45 | 9 | 270 | 285 | 7.43 | 10.00 | 0.200 | 0.033 | 0.022 | 0.022 | 0.004 | 0.004 | 6.00 | |

TABLE 9

| H (mm) | t (mm) | J (mm) | K (mm) | θ (deg) | m (number) | L (mm) | L' (mm) | Ri-gidity (N/mm) | Ri-gidity Ratio | H/J | t/J | H/L | H/L' | t/L | t/L' | H/t | K/J | Remarks |
|---|---|---|---|---|---|---|---|---|---|---|---|---|---|---|---|---|---|---|
| — | 0.6 | — | — | — | — | — | 285 | 8.95 | 1.00 | — | — | — | — | — | 0.002 | — | — | Reference |
| 3.0 | 0.6 | 30 | 0 | 45 | 9 | 270 | 285 | 34.8 | 3.89 | 0.100 | 0.020 | 0.011 | 0.011 | 0.002 | 0.002 | 5.00 | 0.00 | |
| 3.0 | 0.6 | 30 | 3 | 45 | 9 | 270 | 285 | 32.4 | 3.62 | 0.100 | 0.020 | 0.011 | 0.011 | 0.002 | 0.002 | 5.00 | 0.10 | |
| 3.0 | 0.6 | 30 | 9 | 45 | 9 | 270 | 285 | 32.0 | 3.58 | 0.100 | 0.020 | 0.011 | 0.011 | 0.002 | 0.002 | 5.00 | 0.30 | |
| 3.0 | 0.6 | 30 | 18 | 45 | 9 | 270 | 285 | 30.8 | 3.44 | 0.100 | 0.020 | 0.011 | 0.011 | 0.002 | 0.002 | 5.00 | 0.60 | |
| 3.0 | 0.6 | 30 | 27 | 45 | 9 | 270 | 285 | 24.0 | 2.68 | 0.100 | 0.020 | 0.011 | 0.011 | 0.002 | 0.002 | 5.00 | 0.90 | |

TABLE 10

| H (mm) | t (mm) | J (mm) | K (mm) | θ (deg) | m (number) | L (mm) | L' (mm) | Rigidity (N/mm) | Rigidity Ratio | H/J | t/J | H/L | H/L' | t/L | t/L' | H/t | K/J | Remarks |
|---|---|---|---|---|---|---|---|---|---|---|---|---|---|---|---|---|---|---|
| — | 0.6 | — | — | — | — | — | 285 | 0.37 | 1.00 | — | — | — | — | — | 0.002 | — | — | Reference |
| 3.0 | 0.6 | 30 | 0 | 45 | 9 | 270 | 285 | 1.22 | 3.29 | 0.100 | 0.020 | 0.011 | 0.011 | 0.002 | 0.002 | 5.00 | 0.00 | |
| 3.0 | 0.6 | 30 | 3 | 45 | 9 | 270 | 285 | 1.21 | 3.27 | 0.100 | 0.020 | 0.011 | 0.011 | 0.002 | 0.002 | 5.00 | 0.10 | |
| 3.0 | 0.6 | 30 | 9 | 45 | 9 | 270 | 285 | 1.17 | 3.16 | 0.100 | 0.020 | 0.011 | 0.011 | 0.002 | 0.002 | 5.00 | 0.30 | |
| 3.0 | 0.6 | 30 | 18 | 45 | 9 | 270 | 285 | 1.08 | 2.91 | 0.100 | 0.020 | 0.011 | 0.011 | 0.002 | 0.002 | 5.00 | 0.60 | |
| 3.0 | 0.6 | 30 | 27 | 45 | 9 | 270 | 285 | 0.81 | 2.18 | 0.100 | 0.020 | 0.011 | 0.011 | 0.002 | 0.002 | 5.00 | 0.90 | |

TABLE 11

| H (mm) | t (mm) | J (mm) | θ (deg) | m (number) | L (mm) | L' (mm) | Rigidity (N/mm) | Rigidity Ratio | H/J | t/J | H/L | H/L' | t/L | t/L' | H/t | J/L' | J/L | Remarks |
|---|---|---|---|---|---|---|---|---|---|---|---|---|---|---|---|---|---|---|
| — | 0.6 | — | — | — | — | 75 | 135.0 | 1.00 | — | — | — | — | — | 0.008 | — | — | — | Reference |
| 3.0 | 0.6 | 30 | 45 | 2 | 60 | 75 | 406.3 | 3.01 | 0.100 | 0.020 | 0.050 | 0.050 | 0.010 | 0.008 | 5.00 | 0.400 | 0.500 | |
| — | 0.6 | — | — | — | — | 105 | 73.2 | 1.00 | — | — | — | — | — | 0.006 | — | — | — | Reference |
| 3.0 | 0.6 | 30 | 45 | 3 | 90 | 105 | 255.4 | 3.49 | 0.100 | 0.020 | 0.033 | 0.033 | 0.007 | 0.006 | 5.00 | 0.286 | 0.333 | |
| — | 0.6 | — | — | — | — | 165 | 25.7 | 1.00 | — | — | — | — | — | 0.004 | — | — | — | Reference |
| 3.0 | 0.6 | 30 | 45 | 5 | 150 | 165 | 97.6 | 3.80 | 0.100 | 0.020 | 0.020 | 0.020 | 0.004 | 0.004 | 5.00 | 0.182 | 0.200 | |
| — | 0.6 | — | — | — | — | 285 | 8.95 | 1.00 | — | — | — | — | — | 0.002 | — | — | — | Reference |
| 3.0 | 0.6 | 30 | 45 | 9 | 270 | 285 | 34.8 | 3.89 | 0.100 | 0.020 | 0.011 | 0.011 | 0.002 | 0.002 | 5.00 | 0.105 | 0.111 | |

TABLE 12

| H (mm) | t (mm) | J (mm) | θ (deg) | m (number) | L (mm) | L' (mm) | Rigidity (N/mm) | Rigidity Ratio | H/J | t/J | H/L | H/L' | t/L | t/L' | H/t | J/L' | J/L | Remarks |
|---|---|---|---|---|---|---|---|---|---|---|---|---|---|---|---|---|---|---|
| — | 0.6 | — | — | — | — | 75 | 2.93 | 1.00 | — | — | — | — | — | 0.008 | — | — | — | Reference |
| 3.0 | 0.6 | 30 | 45 | 2 | 60 | 75 | 8.79 | 3.00 | 0.100 | 0.020 | 0.050 | 0.050 | 0.010 | 0.008 | 5.00 | 0.400 | 0.500 | |
| — | 0.6 | — | — | — | — | 105 | 1.85 | 1.00 | — | — | — | — | — | 0.006 | — | — | — | Reference |
| 3.0 | 0.6 | 30 | 45 | 3 | 90 | 105 | 5.69 | 3.08 | 0.100 | 0.020 | 0.033 | 0.033 | 0.007 | 0.006 | 5.00 | 0.286 | 0.333 | |
| — | 0.6 | — | — | — | — | 165 | 0.94 | 1.00 | — | — | — | — | — | 0.004 | — | — | — | Reference |
| 3.0 | 0.6 | 30 | 45 | 5 | 150 | 165 | 3.03 | 3.22 | 0.100 | 0.020 | 0.020 | 0.020 | 0.004 | 0.004 | 5.00 | 0.182 | 0.200 | |
| — | 0.6 | — | — | — | — | 285 | 0.37 | 1.00 | — | — | — | — | — | 0.002 | — | — | — | Reference |
| 3.0 | 0.6 | 30 | 45 | 9 | 270 | 285 | 1.22 | 3.29 | 0.100 | 0.020 | 0.011 | 0.011 | 0.002 | 0.002 | 5.00 | 0.105 | 0.111 | |

As described above, in the panel 1 of the present embodiment, it is possible to configure a more preferred panel provided that H/L≥0.005, H/t≥1.0, θ=5.7° to 90°, K/J=0 to 0.9, and J/L≤0.5.

Taking the panel shape of Example 5 as a base, respective rigidity ratios of bending rigidity and torsional rigidity in the case of changing the diagonal length K of the top flat section 5E and the inclination angle θ of the inclined surface section 42E (62E) (a panel having no protrusions and recesses is taken as the reference of comparison), are shown in FIGS. 28, 29, 30, and 31. Values of the diagonal length K of the top flat section 5E are respectively: K=0, 3, 6, 15, 21, 24, and 27. Moreover, the inclination angle θ of the inclined surface section 42E (62E) takes values shown in Tables 13 to 40.

Figure 28:
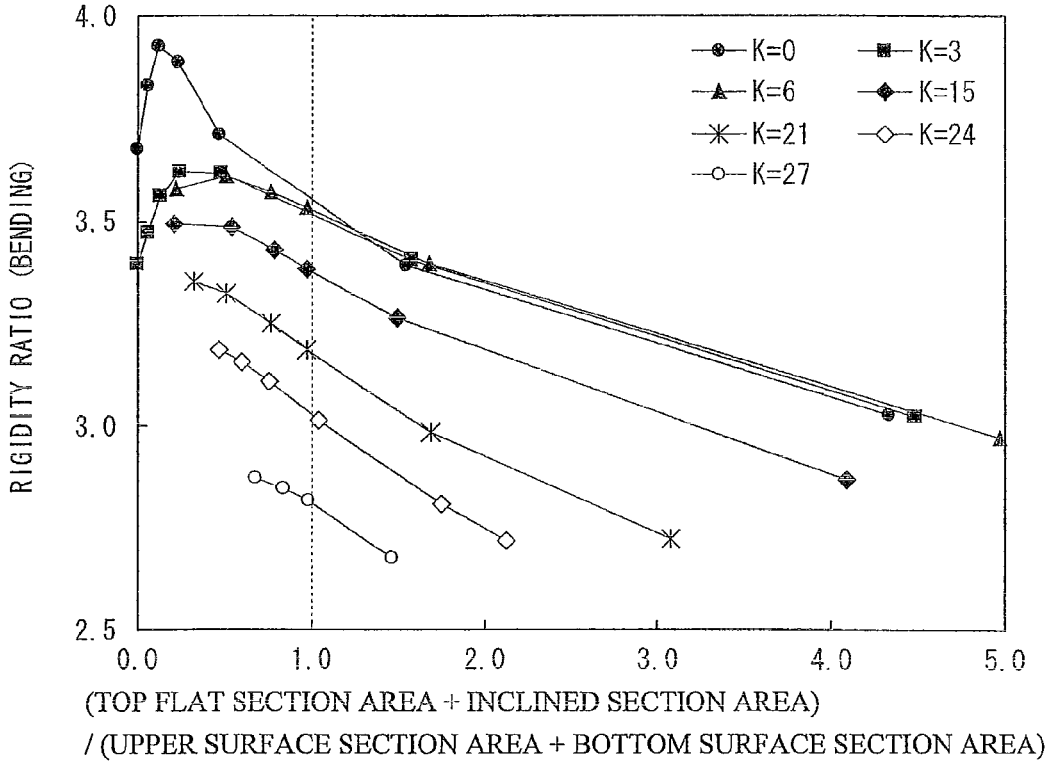
FIG. 28 is a graph showing rigidity ratios (bending) in the case where the diagonal length of the top flat sections is changed.
Figure 29:
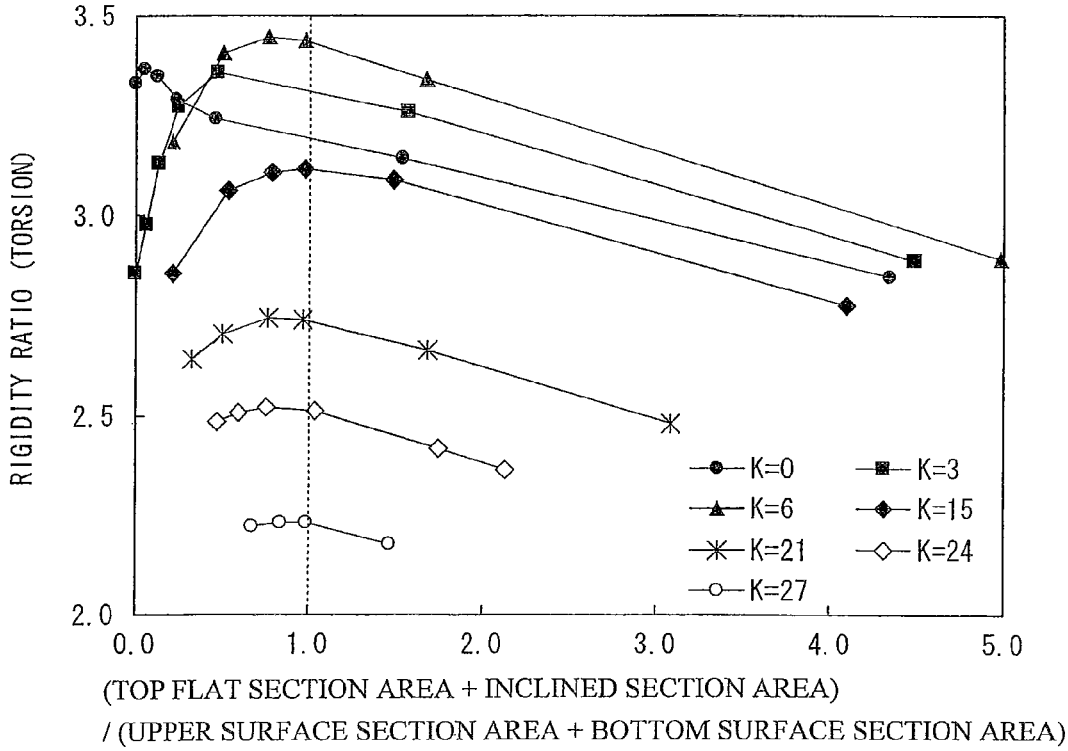
FIG. 29 is a graph showing rigidity ratios (torsion) in the case where the diagonal length of the top flat sections is changed.
Figure 30:
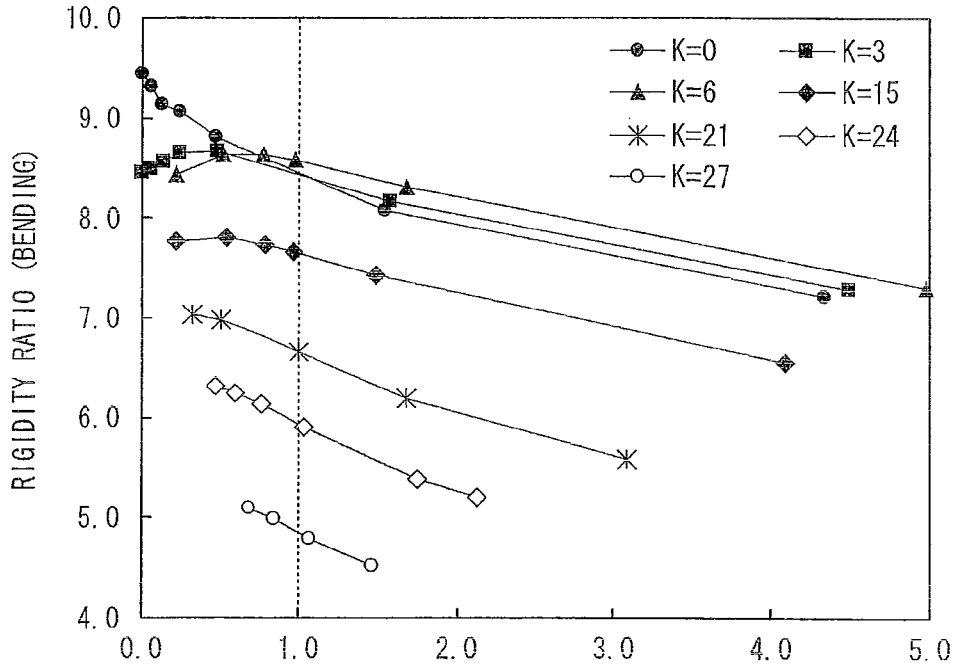
FIG. 30 is a graph showing rigidity ratios (bending) in the case where the diagonal length of the top flat sections is changed.
Figure 31:
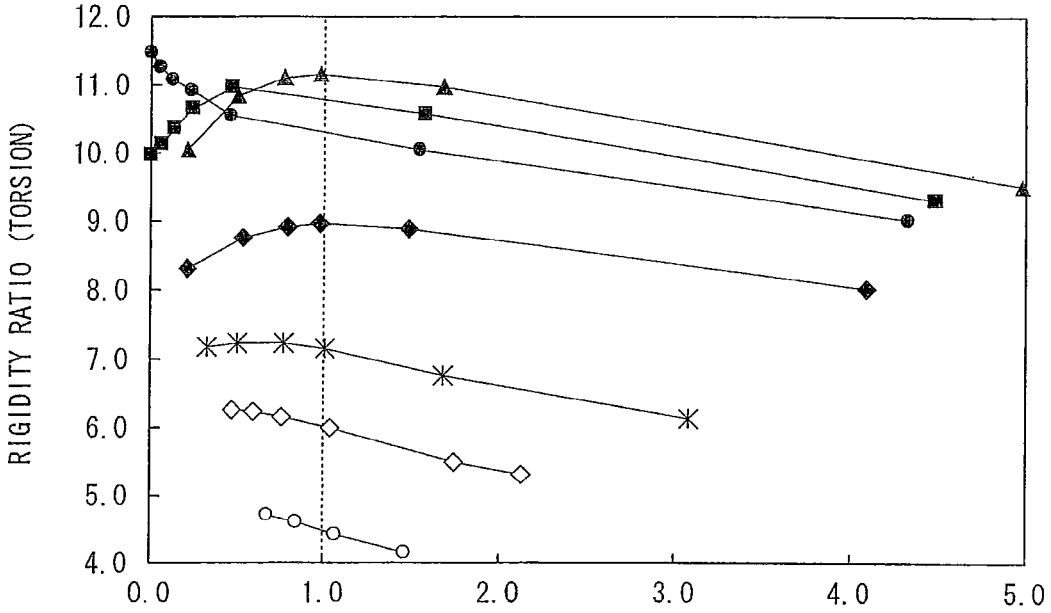
FIG. 31 is a graph showing rigidity ratios (torsion) in the case where the diagonal length of the top flat sections is changed.

FIG. 28 (H=3, bending) and FIG. 29 (H=3, torsion) are graphs of Table 13 (K=0) to Table 19 (K=27) of rigidity ratios (bending) and Table 20 (K=0) to Table 26 (K=27) of rigidity ratios (torsion) in the case where the distance H between the top surface of the protrusion and the top surface of the recess shown in FIG. 18 is 3.0 mm. Moreover, FIG. 30 (H=6, bending) and FIG. 31 (H=6, torsion) are graphs of Table 27 (K=0) to Table 33 (K=27) of rigidity ratios (bending) and Table 34 (K=0) to Table 40 (K=27) of rigidity ratios (torsion) in the case where the protrusion dimension (distance) H is 6.0 mm. FIG. 28 to FIG. 31 each show a graph where each horizontal axis represents the value found by dividing the sum of the area S3 of the top flat section 5E and the area S4 of the inclined section (sum of the inclined surface section 42E (62E) and the corner section inclined surface 43E) by the sum of the area S1 of the upper surface section 41E and the area S2 of the bottom surface section 61E, and each vertical axis represents each rigidity ratio of bending rigidity and torsional rigidity. Here, the area S1 of the upper surface section 41E, the area S2 of the bottom surface section 61E, and the area S3 of the top flat section 5E are surface areas, and the area S4 of the inclined section (sum of the inclined surface section 42E (62E) and the corner section inclined surface 43E) is a projected area projected on the reference surface F when the inclined surface section 42E (62E) and the corner section inclined surface 43E are projected from the upper surface.

TABLE 13

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 8.9 | 1.00 | — | — | — |
| 3.0 | 0.6 | 30 | 0 | 5.7 | 9 | 270 | 285 | 17.1 | 1.91 | 0.100 | 0.020 | 0.011 |

TABLE 13-continued

| | | | | | | | | | | | | |
|---|---|---|---|---|---|---|---|---|---|---|---|---|
| 3.0 | 0.6 | 30 | 0 | 10.0 | 9 | 270 | 285 | 27.1 | 3.03 | 0.100 | 0.020 | 0.011 |
| 3.0 | 0.6 | 30 | 0 | 15.0 | 9 | 270 | 285 | 30.4 | 3.39 | 0.100 | 0.020 | 0.011 |
| 3.0 | 0.6 | 30 | 0 | 30.0 | 9 | 270 | 285 | 33.2 | 3.71 | 0.100 | 0.020 | 0.011 |
| 3.0 | 0.6 | 30 | 0 | 45.0 | 9 | 270 | 285 | 34.8 | 3.89 | 0.100 | 0.020 | 0.011 |
| 3.0 | 0.6 | 30 | 0 | 60.0 | 9 | 270 | 285 | 35.1 | 3.93 | 0.100 | 0.020 | 0.011 |
| 3.0 | 0.6 | 30 | 0 | 75.0 | 9 | 270 | 285 | 34.3 | 3.83 | 0.100 | 0.020 | 0.011 |
| 3.0 | 0.6 | 30 | 0 | 90.0 | 9 | 270 | 285 | 32.9 | 3.68 | 0.100 | 0.020 | 0.011 |

| H/L' | t/L | t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|---|---|
| — | — | — | — | — | — | — | — | Reference |
| 0.011 | 0.002 | 0.002 | 5.00 | 0.00 | | | | |
| 0.011 | 0.002 | 0.002 | 5.00 | 0.00 | 0.00 | 4.34 | 4.34 | |
| 0.011 | 0.002 | 0.002 | 5.00 | 0.00 | 0.00 | 1.55 | 1.55 | |
| 0.011 | 0.002 | 0.002 | 5.00 | 0.00 | 0.00 | 0.46 | 0.46 | |
| 0.011 | 0.002 | 0.002 | 5.00 | 0.00 | 0.00 | 0.23 | 0.23 | |
| 0.011 | 0.002 | 0.002 | 5.00 | 0.00 | 0.00 | 0.13 | 0.13 | |
| 0.011 | 0.002 | 0.002 | 5.00 | 0.00 | 0.00 | 0.06 | 0.06 | |
| 0.011 | 0.002 | 0.002 | 5.00 | 0.00 | 0.00 | 0.00 | 0.00 | |

TABLE 14

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 8.95 | 1.00 | — | — | — |
| 3.0 | 0.6 | 30 | 3 | 6.3 | 9 | 270 | 285 | 18.7 | 2.09 | 0.100 | 0.020 | 0.011 |
| 3.0 | 0.6 | 30 | 3 | 10.0 | 9 | 270 | 285 | 27.0 | 3.02 | 0.100 | 0.020 | 0.011 |
| 3.0 | 0.6 | 30 | 3 | 15.0 | 9 | 270 | 285 | 30.5 | 3.40 | 0.100 | 0.020 | 0.011 |
| 3.0 | 0.6 | 30 | 3 | 30.0 | 9 | 270 | 285 | 32.4 | 3.62 | 0.100 | 0.020 | 0.011 |
| 3.0 | 0.6 | 30 | 3 | 45.0 | 9 | 270 | 285 | 32.4 | 3.62 | 0.100 | 0.020 | 0.011 |
| 3.0 | 0.6 | 30 | 3 | 60.0 | 9 | 270 | 285 | 31.9 | 3.56 | 0.100 | 0.020 | 0.011 |
| 3.0 | 0.6 | 30 | 3 | 75.0 | 9 | 270 | 285 | 31.1 | 3.47 | 0.100 | 0.020 | 0.011 |
| 3.0 | 0.6 | 30 | 3 | 90.0 | 9 | 270 | 285 | 30.4 | 3.40 | 0.100 | 0.020 | 0.011 |

| H/L' | t/L | t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|---|---|
| — | — | — | — | — | — | — | — | Reference |
| 0.011 | 0.002 | 0.002 | 5.00 | 0.10 | 1.00 | 198.0 | 199.0 | |
| 0.011 | 0.002 | 0.002 | 5.00 | 0.10 | 0.03 | 4.46 | 4.48 | |
| 0.011 | 0.002 | 0.002 | 5.00 | 0.10 | 0.01 | 1.57 | 1.58 | |
| 0.011 | 0.002 | 0.002 | 5.00 | 0.10 | 0.01 | 0.47 | 0.47 | |
| 0.011 | 0.002 | 0.002 | 5.00 | 0.10 | 0.01 | 0.24 | 0.24 | |
| 0.011 | 0.002 | 0.002 | 5.00 | 0.10 | 0.01 | 0.13 | 0.13 | |
| 0.011 | 0.002 | 0.002 | 5.00 | 0.10 | 0.01 | 0.06 | 0.06 | |
| 0.011 | 0.002 | 0.002 | 5.00 | 0.10 | 0.01 | 0.00 | 0.01 | |

TABLE 15

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 8.95 | 1.00 | — | — | — |
| 3.0 | 0.6 | 30 | 6 | 10.0 | 9 | 270 | 285 | 26.6 | 2.97 | 0.100 | 0.020 | 0.011 |
| 3.0 | 0.6 | 30 | 6 | 15.0 | 9 | 270 | 285 | 30.4 | 3.40 | 0.100 | 0.020 | 0.011 |

TABLE 15-continued

| | | | | | | | | | | | | |
|---|---|---|---|---|---|---|---|---|---|---|---|---|
| 3.0 | 0.6 | 30 | 6 | 20.0 | 9 | 270 | 285 | 31.6 | 3.53 | 0.100 | 0.020 | 0.011 |
| 3.0 | 0.6 | 30 | 6 | 23.0 | 9 | 270 | 285 | 32.0 | 3.57 | 0.100 | 0.020 | 0.011 |
| 3.0 | 0.6 | 30 | 6 | 30.0 | 9 | 270 | 285 | 32.3 | 3.61 | 0.100 | 0.020 | 0.011 |
| 3.0 | 0.6 | 30 | 6 | 50.0 | 9 | 270 | 285 | 32.0 | 3.58 | 0.100 | 0.020 | 0.011 |

| H/L' | t/L | t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|---|---|
| — | — | — | — | — | — | — | — | Reference |
| 0.011 | 0.002 | 0.002 | 5.00 | 0.20 | 0.12 | 4.86 | 4.97 | |
| 0.011 | 0.002 | 0.002 | 5.00 | 0.20 | 0.05 | 1.63 | 1.68 | |
| 0.011 | 0.002 | 0.002 | 5.00 | 0.20 | 0.04 | 0.94 | 0.98 | |
| 0.011 | 0.002 | 0.002 | 5.00 | 0.20 | 0.04 | 0.74 | 0.77 | |
| 0.011 | 0.002 | 0.002 | 5.00 | 0.20 | 0.03 | 0.48 | 0.51 | |
| 0.011 | 0.002 | 0.002 | 5.00 | 0.20 | 0.02 | 0.20 | 0.22 | |

TABLE 16

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 8.9 | 1.00 | — | — | — |
| 3.0 | 0.6 | 30 | 15 | 13.0 | 9 | 270 | 285 | 25.7 | 2.87 | 0.100 | 0.020 | 0.011 |
| 3.0 | 0.6 | 30 | 15 | 20.0 | 9 | 270 | 285 | 29.2 | 3.26 | 0.100 | 0.020 | 0.011 |
| 3.0 | 0.6 | 30 | 15 | 26.0 | 9 | 270 | 285 | 30.3 | 3.38 | 0.100 | 0.020 | 0.011 |
| 3.0 | 0.6 | 30 | 15 | 30.0 | 9 | 270 | 285 | 30.7 | 3.43 | 0.100 | 0.020 | 0.011 |
| 3.0 | 0.6 | 30 | 15 | 40.0 | 9 | 270 | 285 | 31.2 | 3.49 | 0.100 | 0.020 | 0.011 |
| 3.0 | 0.6 | 30 | 15 | 75.0 | 9 | 270 | 285 | 31.3 | 3.49 | 0.100 | 0.020 | 0.011 |

| H/L' | t/L | t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|---|---|
| — | — | — | — | — | — | — | — | Reference |
| 0.011 | 0.002 | 0.002 | 5.00 | 0.50 | 0.64 | 3.46 | 4.09 | |
| 0.011 | 0.002 | 0.002 | 5.00 | 0.50 | 0.31 | 1.18 | 1.49 | |
| 0.011 | 0.002 | 0.002 | 5.00 | 0.50 | 0.25 | 0.73 | 0.97 | |
| 0.011 | 0.002 | 0.002 | 5.00 | 0.50 | 0.22 | 0.57 | 0.79 | |
| 0.011 | 0.002 | 0.002 | 5.00 | 0.50 | 0.19 | 0.34 | 0.54 | |
| 0.011 | 0.002 | 0.002 | 5.00 | 0.50 | 0.15 | 0.06 | 0.22 | |

TABLE 17

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 8.95 | 1.00 | — | — | — |
| 3.0 | 0.6 | 30 | 21 | 18.4 | 9 | 270 | 285 | 24.4 | 2.72 | 0.100 | 0.020 | 0.011 |
| 3.0 | 0.6 | 30 | 21 | 25.0 | 9 | 270 | 285 | 26.7 | 2.99 | 0.100 | 0.020 | 0.011 |
| 3.0 | 0.6 | 30 | 21 | 37.0 | 9 | 270 | 285 | 28.5 | 3.19 | 0.100 | 0.020 | 0.011 |
| 3.0 | 0.6 | 30 | 21 | 45.0 | 9 | 270 | 285 | 29.1 | 3.25 | 0.100 | 0.020 | 0.011 |
| 3.0 | 0.6 | 30 | 21 | 65.0 | 9 | 270 | 285 | 29.7 | 3.32 | 0.100 | 0.020 | 0.011 |
| 3.0 | 0.6 | 30 | 21 | 90.0 | 9 | 270 | 285 | 30.0 | 3.35 | 0.100 | 0.020 | 0.011 |

TABLE 17-continued

| H/L' | t/L | t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|---|---|
| — | — | — | — | — | — | — | — | Reference |
| 0.011 | 0.002 | 0.002 | 5.00 | 0.70 | 1.00 | 2.08 | 3.08 | |
| 0.011 | 0.002 | 0.002 | 5.00 | 0.70 | 0.66 | 1.03 | 1.69 | |
| 0.011 | 0.002 | 0.002 | 5.00 | 0.70 | 0.48 | 0.49 | 0.97 | |
| 0.011 | 0.002 | 0.002 | 5.00 | 0.70 | 0.43 | 0.34 | 0.77 | |
| 0.011 | 0.002 | 0.002 | 5.00 | 0.70 | 0.37 | 0.14 | 0.51 | |
| 0.011 | 0.002 | 0.002 | 5.00 | 0.70 | 0.32 | 0.00 | 0.32 | |

TABLE 18

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 8.95 | 1.00 | — | — | — |
| 3.0 | 0.6 | 30 | 24 | 26.6 | 9 | 270 | 285 | 24.3 | 2.72 | 0.100 | 0.020 | 0.011 |
| 3.0 | 0.6 | 30 | 24 | 30.0 | 9 | 270 | 285 | 25.1 | 2.81 | 0.100 | 0.020 | 0.011 |
| 3.0 | 0.6 | 30 | 24 | 45.0 | 9 | 270 | 285 | 27.0 | 3.02 | 0.100 | 0.020 | 0.011 |
| 3.0 | 0.6 | 30 | 24 | 60.0 | 9 | 270 | 285 | 27.8 | 3.11 | 0.100 | 0.020 | 0.011 |
| 3.0 | 0.6 | 30 | 24 | 75.0 | 9 | 270 | 285 | 28.2 | 3.16 | 0.100 | 0.020 | 0.011 |
| 3.0 | 0.6 | 30 | 24 | 90.0 | 9 | 270 | 285 | 28.5 | 3.19 | 0.100 | 0.020 | 0.011 |

| H/L' | t/L | t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|---|---|
| — | — | — | — | — | — | — | — | Reference |
| 0.011 | 0.002 | 0.002 | 5.00 | 0.80 | 1.00 | 1.13 | 2.13 | |
| 0.011 | 0.002 | 0.002 | 5.00 | 0.80 | 0.88 | 0.87 | 1.75 | |
| 0.011 | 0.002 | 0.002 | 5.00 | 0.80 | 0.65 | 0.39 | 1.04 | |
| 0.011 | 0.002 | 0.002 | 5.00 | 0.80 | 0.56 | 0.20 | 0.76 | |
| 0.011 | 0.002 | 0.002 | 5.00 | 0.80 | 0.51 | 0.08 | 0.59 | |
| 0.011 | 0.002 | 0.002 | 5.00 | 0.80 | 0.47 | 0.00 | 0.47 | |

TABLE 19

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 8.95 | 1.00 | — | — | — |
| 3.0 | 0.6 | 30 | 27 | 45.0 | 9 | 270 | 285 | 24.0 | 2.68 | 0.100 | 0.020 | 0.011 |
| 3.0 | 0.6 | 30 | 27 | 65.0 | 9 | 270 | 285 | 25.2 | 2.82 | 0.100 | 0.020 | 0.011 |
| 3.0 | 0.6 | 30 | 27 | 75.0 | 9 | 270 | 285 | 25.5 | 2.85 | 0.100 | 0.020 | 0.011 |
| 3.0 | 0.6 | 30 | 27 | 90.0 | 9 | 270 | 285 | 25.7 | 2.87 | 0.100 | 0.020 | 0.011 |

| (top flat section area)/(upper surface section area + | (inclined section area)/(upper surface section area + | (top flat section area + inclined section area)/(upper surface section area + |
|---|---|---|

TABLE 19-continued

| H/L' | t/L | t/L' | H/t | K/J | bottom surface section area) | bottom surface section area) | bottom surface section area) | Remarks |
|---|---|---|---|---|---|---|---|---|
| — | — | — | — | — | — | — | — | Reference |
| 0.011 | 0.002 | 0.002 | 5.00 | 0.90 | 1.00 | 0.47 | 1.47 | |
| 0.011 | 0.002 | 0.002 | 5.00 | 0.90 | 0.80 | 0.18 | 0.98 | |
| 0.011 | 0.002 | 0.002 | 5.00 | 0.90 | 0.75 | 0.10 | 0.84 | |
| 0.011 | 0.002 | 0.002 | 5.00 | 0.90 | 0.68 | 0.00 | 0.68 | |

TABLE 20

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 0.37 | 1.00 | — | — | — |
| 3.0 | 0.6 | 30 | 0 | 5.7 | 9 | 270 | 285 | 0.65 | 1.75 | 0.100 | 0.020 | 0.011 |
| 3.0 | 0.6 | 30 | 0 | 10.0 | 9 | 270 | 285 | 1.05 | 2.85 | 0.100 | 0.020 | 0.011 |
| 3.0 | 0.6 | 30 | 0 | 15.0 | 9 | 270 | 285 | 1.16 | 3.14 | 0.100 | 0.020 | 0.011 |
| 3.0 | 0.6 | 30 | 0 | 30.0 | 9 | 270 | 285 | 1.20 | 3.24 | 0.100 | 0.020 | 0.011 |
| 3.0 | 0.6 | 30 | 0 | 45.0 | 9 | 270 | 285 | 1.22 | 3.29 | 0.100 | 0.020 | 0.011 |
| 3.0 | 0.6 | 30 | 0 | 60.0 | 9 | 270 | 285 | 1.24 | 3.35 | 0.100 | 0.020 | 0.011 |
| 3.0 | 0.6 | 30 | 0 | 75.0 | 9 | 270 | 285 | 1.25 | 3.37 | 0.100 | 0.020 | 0.011 |
| 3.0 | 0.6 | 30 | 0 | 90.0 | 9 | 270 | 285 | 1.23 | 3.33 | 0.100 | 0.020 | 0.011 |

| H/L' | t/L | t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|---|---|
| — | — | — | — | — | — | — | — | Reference |
| 0.011 | 0.002 | 0.002 | 5.00 | 0.00 | | | | |
| 0.011 | 0.002 | 0.002 | 5.00 | 0.00 | 0.00 | 4.34 | 4.34 | |
| 0.011 | 0.002 | 0.002 | 5.00 | 0.00 | 0.00 | 1.55 | 1.55 | |
| 0.011 | 0.002 | 0.002 | 5.00 | 0.00 | 0.00 | 0.46 | 0.46 | |
| 0.011 | 0.002 | 0.002 | 5.00 | 0.00 | 0.00 | 0.23 | 0.23 | |
| 0.011 | 0.002 | 0.002 | 5.00 | 0.00 | 0.00 | 0.13 | 0.13 | |
| 0.011 | 0.002 | 0.002 | 5.00 | 0.00 | 0.00 | 0.06 | 0.06 | |
| 0.011 | 0.002 | 0.002 | 5.00 | 0.00 | 0.00 | 0.00 | 0.00 | |

45

TABLE 21

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 0.37 | 1.00 | — | — | — |
| 3.0 | 0.6 | 30 | 3 | 6.3 | 9 | 270 | 285 | 0.71 | 1.91 | 0.100 | 0.020 | 0.011 |
| 3.0 | 0.6 | 30 | 3 | 10.0 | 9 | 270 | 285 | 1.07 | 2.89 | 0.100 | 0.020 | 0.011 |
| 3.0 | 0.6 | 30 | 3 | 15.0 | 9 | 270 | 285 | 1.21 | 3.26 | 0.100 | 0.020 | 0.011 |
| 3.0 | 0.6 | 30 | 3 | 30.0 | 9 | 270 | 285 | 1.24 | 3.36 | 0.100 | 0.020 | 0.011 |
| 3.0 | 0.6 | 30 | 3 | 45.0 | 9 | 270 | 285 | 1.21 | 3.27 | 0.100 | 0.020 | 0.011 |
| 3.0 | 0.6 | 30 | 3 | 60.0 | 9 | 270 | 285 | 1.16 | 3.13 | 0.100 | 0.020 | 0.011 |
| 3.0 | 0.6 | 30 | 3 | 75.0 | 9 | 270 | 285 | 1.10 | 2.98 | 0.100 | 0.020 | 0.011 |
| 3.0 | 0.6 | 30 | 3 | 90.0 | 9 | 270 | 285 | 1.06 | 2.86 | 0.100 | 0.020 | 0.011 |

| (top flat section area)/(upper surface section area + bottom | (inclined section area)/(upper surface section area + bottom | (top flat section area + inclined section area)/(upper surface section area + bottom |
|---|---|---|

TABLE 21-continued

| | H/L' | t/L | t/L' | H/t | K/J | surface section area) | surface section area) | surface section area) | Remarks |
|---|---|---|---|---|---|---|---|---|---|
| | — | — | — | — | — | — | — | — | Reference |
| | 0.011 | 0.002 | 0.002 | 5.00 | 0.10 | 1.00 | 198.0 | 199.0 | |
| | 0.011 | 0.002 | 0.002 | 5.00 | 0.10 | 0.03 | 4.46 | 4.48 | |
| | 0.011 | 0.002 | 0.002 | 5.00 | 0.10 | 0.01 | 1.57 | 1.58 | |
| | 0.011 | 0.002 | 0.002 | 5.00 | 0.10 | 0.01 | 0.47 | 0.47 | |
| | 0.011 | 0.002 | 0.002 | 5.00 | 0.10 | 0.01 | 0.24 | 0.24 | |
| | 0.011 | 0.002 | 0.002 | 5.00 | 0.10 | 0.01 | 0.13 | 0.13 | |
| | 0.011 | 0.002 | 0.002 | 5.00 | 0.10 | 0.01 | 0.06 | 0.06 | |
| | 0.011 | 0.002 | 0.002 | 5.00 | 0.10 | 0.01 | 0.00 | 0.01 | |

TABLE 22

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 0.37 | 1.00 | — | — | — |
| 3.0 | 0.6 | 30 | 6 | 10.0 | 9 | 270 | 285 | 1.07 | 2.89 | 0.100 | 0.020 | 0.011 |
| 3.0 | 0.6 | 30 | 6 | 15.0 | 9 | 270 | 285 | 1.24 | 3.34 | 0.100 | 0.020 | 0.011 |
| 3.0 | 0.6 | 30 | 6 | 20.0 | 9 | 270 | 285 | 1.27 | 3.44 | 0.100 | 0.020 | 0.011 |
| 3.0 | 0.6 | 30 | 6 | 23.0 | 9 | 270 | 285 | 1.28 | 3.45 | 0.100 | 0.020 | 0.011 |
| 3.0 | 0.6 | 30 | 6 | 30.0 | 9 | 270 | 285 | 1.26 | 3.41 | 0.100 | 0.020 | 0.011 |
| 3.0 | 0.6 | 30 | 6 | 50.0 | 9 | 270 | 285 | 1.18 | 3.19 | 0.100 | 0.020 | 0.011 |

| | H/L' | t/L | t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|---|---|---|
| | — | — | — | — | — | — | — | — | Reference |
| | 0.011 | 0.002 | 0.002 | 5.00 | 0.20 | 0.12 | 4.86 | 4.97 | |
| | 0.011 | 0.002 | 0.002 | 5.00 | 0.20 | 0.05 | 1.63 | 1.68 | |
| | 0.011 | 0.002 | 0.002 | 5.00 | 0.20 | 0.04 | 0.94 | 0.98 | |
| | 0.011 | 0.002 | 0.002 | 5.00 | 0.20 | 0.04 | 0.74 | 0.77 | |
| | 0.011 | 0.002 | 0.002 | 5.00 | 0.20 | 0.03 | 0.48 | 0.51 | |
| | 0.011 | 0.002 | 0.002 | 5.00 | 0.20 | 0.02 | 0.20 | 0.22 | |

TABLE 23

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 0.37 | 1.00 | — | — | — |
| 3.0 | 0.6 | 30 | 15 | 13.0 | 9 | 270 | 285 | 1.03 | 2.78 | 0.100 | 0.020 | 0.011 |
| 3.0 | 0.6 | 30 | 15 | 20.0 | 9 | 270 | 285 | 1.14 | 3.09 | 0.100 | 0.020 | 0.011 |
| 3.0 | 0.6 | 30 | 15 | 26.0 | 9 | 270 | 285 | 1.15 | 3.12 | 0.100 | 0.020 | 0.011 |
| 3.0 | 0.6 | 30 | 15 | 30.0 | 9 | 270 | 285 | 1.15 | 3.11 | 0.100 | 0.020 | 0.011 |
| 3.0 | 0.6 | 30 | 15 | 40.0 | 9 | 270 | 285 | 1.13 | 3.06 | 0.100 | 0.020 | 0.011 |
| 3.0 | 0.6 | 30 | 15 | 75.0 | 9 | 270 | 285 | 1.06 | 2.86 | 0.100 | 0.020 | 0.011 |

| | (top flat section area)/(upper surface section area + bottom surface section | (inclined section area)/(upper surface section area + bottom surface section | (top flat section area + inclined section area)/(upper surface section area + bottom surface section |
|---|---|---|---|

TABLE 23-continued

| | H/L' | t/L | t/L' | H/t | K/J | area) | area) | area) | Remarks |
|---|---|---|---|---|---|---|---|---|---|
| | — | — | — | — | — | — | — | — | Reference |
| | 0.011 | 0.002 | 0.002 | 5.00 | 0.50 | 0.64 | 3.46 | 4.09 | |
| | 0.011 | 0.002 | 0.002 | 5.00 | 0.50 | 0.31 | 1.18 | 1.49 | |
| | 0.011 | 0.002 | 0.002 | 5.00 | 0.50 | 0.25 | 0.73 | 0.97 | |
| | 0.011 | 0.002 | 0.002 | 5.00 | 0.50 | 0.22 | 0.57 | 0.79 | |
| | 0.011 | 0.002 | 0.002 | 5.00 | 0.50 | 0.19 | 0.34 | 0.54 | |
| | 0.011 | 0.002 | 0.002 | 5.00 | 0.50 | 0.15 | 0.06 | 0.22 | |

TABLE 24

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 0.37 | 1.00 | — | — | — |
| 3.0 | 0.6 | 30 | 21 | 18.4 | 9 | 270 | 285 | 0.92 | 2.48 | 0.100 | 0.020 | 0.011 |
| 3.0 | 0.6 | 30 | 21 | 25.0 | 9 | 270 | 285 | 0.99 | 2.66 | 0.100 | 0.020 | 0.011 |
| 3.0 | 0.6 | 30 | 21 | 37.0 | 9 | 270 | 285 | 1.02 | 2.74 | 0.100 | 0.020 | 0.011 |
| 3.0 | 0.6 | 30 | 21 | 45.0 | 9 | 270 | 285 | 1.02 | 2.74 | 0.100 | 0.020 | 0.011 |
| 3.0 | 0.6 | 30 | 21 | 65.0 | 9 | 270 | 285 | 1.00 | 2.71 | 0.100 | 0.020 | 0.011 |
| 3.0 | 0.6 | 30 | 21 | 90.0 | 9 | 270 | 285 | 0.98 | 2.64 | 0.100 | 0.020 | 0.011 |

| | H/L' | t/L | t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|---|---|---|
| | — | — | — | — | — | — | — | — | Reference |
| | 0.011 | 0.002 | 0.002 | 5.00 | 0.70 | 1.00 | 2.08 | 3.08 | |
| | 0.011 | 0.002 | 0.002 | 5.00 | 0.70 | 0.66 | 1.03 | 1.69 | |
| | 0.011 | 0.002 | 0.002 | 5.00 | 0.70 | 0.48 | 0.49 | 0.97 | |
| | 0.011 | 0.002 | 0.002 | 5.00 | 0.70 | 0.43 | 0.34 | 0.77 | |
| | 0.011 | 0.002 | 0.002 | 5.00 | 0.70 | 0.37 | 0.14 | 0.51 | |
| | 0.011 | 0.002 | 0.002 | 5.00 | 0.70 | 0.32 | 0.00 | 0.32 | |

TABLE 25

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 0.37 | 1.00 | — | — | — |
| 3.0 | 0.6 | 30 | 24 | 26.6 | 9 | 270 | 285 | 0.88 | 2.37 | 0.100 | 0.020 | 0.011 |
| 3.0 | 0.6 | 30 | 24 | 30.0 | 9 | 270 | 285 | 0.90 | 2.42 | 0.100 | 0.020 | 0.011 |
| 3.0 | 0.6 | 30 | 24 | 45.0 | 9 | 270 | 285 | 0.93 | 2.51 | 0.100 | 0.020 | 0.011 |
| 3.0 | 0.6 | 30 | 24 | 60.0 | 9 | 270 | 285 | 0.93 | 2.52 | 0.100 | 0.020 | 0.011 |
| 3.0 | 0.6 | 30 | 24 | 75.0 | 9 | 270 | 285 | 0.93 | 2.51 | 0.100 | 0.020 | 0.011 |
| 3.0 | 0.6 | 30 | 24 | 90.0 | 9 | 270 | 285 | 0.92 | 2.49 | 0.100 | 0.020 | 0.011 |

| | H/L' | t/L | t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|---|---|---|
| | — | — | — | — | — | — | — | — | Reference |
| | 0.011 | 0.002 | 0.002 | 5.00 | 0.80 | 1.00 | 1.13 | 2.13 | |
| | 0.011 | 0.002 | 0.002 | 5.00 | 0.80 | 0.88 | 0.87 | 1.75 | |

TABLE 25-continued

| | | | | | | | | | | | | |
|---|---|---|---|---|---|---|---|---|---|---|---|---|
| | | 0.011 | 0.002 | 0.002 | 5.00 | 0.80 | 0.65 | 0.39 | 1.04 | | | |
| | | 0.011 | 0.002 | 0.002 | 5.00 | 0.80 | 0.56 | 0.20 | 0.76 | | | |
| | | 0.011 | 0.002 | 0.002 | 5.00 | 0.80 | 0.51 | 0.08 | 0.59 | | | |
| | | 0.011 | 0.002 | 0.002 | 5.00 | 0.80 | 0.47 | 0.00 | 0.47 | | | |

TABLE 26

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 0.37 | 1.00 | — | — | — |
| 3.0 | 0.6 | 30 | 27 | 45.0 | 9 | 270 | 285 | 0.81 | 2.18 | 0.100 | 0.020 | 0.011 |
| 3.0 | 0.6 | 30 | 27 | 65.0 | 9 | 270 | 285 | 0.83 | 2.23 | 0.100 | 0.020 | 0.011 |
| 3.0 | 0.6 | 30 | 27 | 75.0 | 9 | 270 | 285 | 0.83 | 2.23 | 0.100 | 0.020 | 0.011 |
| 3.0 | 0.6 | 30 | 27 | 90.0 | 9 | 270 | 285 | 0.82 | 2.22 | 0.100 | 0.020 | 0.011 |

| H/L' | t/L | t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|---|---|
| — | — | — | — | — | — | — | — | Reference |
| 0.011 | 0.002 | 0.002 | 5.00 | 0.90 | 1.00 | 0.47 | 1.47 | |
| 0.011 | 0.002 | 0.002 | 5.00 | 0.90 | 0.80 | 0.18 | 0.98 | |
| 0.011 | 0.002 | 0.002 | 5.00 | 0.90 | 0.75 | 0.10 | 0.84 | |
| 0.011 | 0.002 | 0.002 | 5.00 | 0.90 | 0.68 | 0.00 | 0.68 | |

TABLE 27

| H (mm) | t (mm) | J (mm) | K (mm) | θ (deg) | m (number) | L (mm) | L' (mm) | Rigidity (N/mm) | Rigidity Ratio | H/J | t/J | H/L |
|---|---|---|---|---|---|---|---|---|---|---|---|---|
| — | 0.6 | — | — | — | — | — | 285 | 8.95 | 1.00 | — | — | — |
| 6.0 | 0.6 | 30 | 0 | 11.3 | 9 | 270 | 285 | 37.4 | 4.18 | 0.200 | 0.020 | 0.022 |
| 6.0 | 0.6 | 30 | 0 | 19.4 | 9 | 270 | 285 | 64.6 | 7.22 | 0.200 | 0.020 | 0.022 |
| 6.0 | 0.6 | 30 | 0 | 28.2 | 9 | 270 | 285 | 72.3 | 8.08 | 0.200 | 0.020 | 0.022 |
| 6.0 | 0.6 | 30 | 0 | 49.1 | 9 | 270 | 285 | 78.9 | 8.81 | 0.200 | 0.020 | 0.022 |
| 6.0 | 0.6 | 30 | 0 | 63.4 | 9 | 270 | 285 | 81.2 | 9.07 | 0.200 | 0.020 | 0.022 |
| 6.0 | 0.6 | 30 | 0 | 73.9 | 9 | 270 | 285 | 81.8 | 9.14 | 0.200 | 0.020 | 0.022 |
| 6.0 | 0.6 | 30 | 0 | 82.4 | 9 | 270 | 285 | 83.4 | 9.32 | 0.200 | 0.020 | 0.022 |
| 6.0 | 0.6 | 30 | 0 | 90.0 | 9 | 270 | 285 | 84.6 | 9.45 | 0.200 | 0.020 | 0.022 |

| H/L' | t/L | t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|---|---|
| — | — | — | — | — | — | — | — | Reference |
| 0.022 | 0.002 | 0.002 | 10.00 | 0.00 | | | | |
| 0.022 | 0.002 | 0.002 | 10.00 | 0.00 | 0.00 | 4.34 | 4.34 | |
| 0.022 | 0.002 | 0.002 | 10.00 | 0.00 | 0.00 | 1.55 | 1.55 | |
| 0.022 | 0.002 | 0.002 | 10.00 | 0.00 | 0.00 | 0.46 | 0.46 | |
| 0.022 | 0.002 | 0.002 | 10.00 | 0.00 | 0.00 | 0.23 | 0.23 | |
| 0.022 | 0.002 | 0.002 | 10.00 | 0.00 | 0.00 | 0.13 | 0.13 | |
| 0.022 | 0.002 | 0.002 | 10.00 | 0.00 | 0.00 | 0.06 | 0.06 | |
| 0.022 | 0.002 | 0.002 | 10.00 | 0.00 | 0.00 | 0.00 | 0.00 | |

TABLE 28

| H (mm) | t (mm) | J (mm) | K (mm) | θ (deg) | m (number) | L (mm) | L' (mm) | Rigidity (N/mm) | Rigidity Ratio | H/J | t/J | H/L | H/L' | t/L |
|---|---|---|---|---|---|---|---|---|---|---|---|---|---|---|
| — | 0.6 | — | — | — | — | — | 285 | 8.95 | 1.00 | — | — | — | — | — |
| 6.0 | 0.6 | 30 | 3 | 12.5 | 9 | 270 | 285 | 42.5 | 4.75 | 0.200 | 0.020 | 0.022 | 0.022 | 0.002 |
| 6.0 | 0.6 | 30 | 3 | 19.4 | 9 | 270 | 285 | 65.2 | 7.29 | 0.200 | 0.020 | 0.022 | 0.022 | 0.002 |
| 6.0 | 0.6 | 30 | 3 | 28.2 | 9 | 270 | 285 | 73.1 | 8.17 | 0.200 | 0.020 | 0.022 | 0.022 | 0.002 |
| 6.0 | 0.6 | 30 | 3 | 49.1 | 9 | 270 | 285 | 77.7 | 8.68 | 0.200 | 0.020 | 0.022 | 0.022 | 0.002 |
| 6.0 | 0.6 | 30 | 3 | 63.4 | 9 | 270 | 285 | 77.4 | 8.65 | 0.200 | 0.020 | 0.022 | 0.022 | 0.002 |
| 6.0 | 0.6 | 30 | 3 | 73.9 | 9 | 270 | 285 | 76.6 | 8.56 | 0.200 | 0.020 | 0.022 | 0.022 | 0.002 |
| 6.0 | 0.6 | 30 | 3 | 82.4 | 9 | 270 | 285 | 76.0 | 8.49 | 0.200 | 0.020 | 0.022 | 0.022 | 0.002 |
| 6.0 | 0.6 | 30 | 3 | 90.0 | 9 | 270 | 285 | 75.6 | 8.45 | 0.200 | 0.020 | 0.022 | 0.022 | 0.002 |

| t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|
| — | — | — | — | — | — | Reference |
| 0.002 | 10.00 | 0.10 | 1.00 | 198.0 | 199.0 | |
| 0.002 | 10.00 | 0.10 | 0.03 | 4.46 | 4.48 | |
| 0.002 | 10.00 | 0.10 | 0.01 | 1.57 | 1.38 | |
| 0.002 | 10.00 | 0.10 | 0.01 | 0.47 | 0.47 | |
| 0.002 | 10.00 | 0.10 | 0.01 | 0.24 | 0.24 | |
| 0.002 | 10.00 | 0.10 | 0.01 | 0.13 | 0.13 | |
| 0.002 | 10.00 | 0.10 | 0.01 | 0.06 | 0.06 | |
| 0.002 | 10.00 | 0.10 | 0.01 | 0.00 | 0.01 | |

TABLE 29

| H (mm) | t (mm) | J (mm) | K (mm) | θ (deg) | m (number) | L (mm) | L' (mm) | Rigidity (N/mm) | Rigidity Ratio | H/J | t/J | H/L | H/L' | t/L |
|---|---|---|---|---|---|---|---|---|---|---|---|---|---|---|
| — | 0.6 | — | — | — | — | — | 285 | 8.95 | 1.00 | — | — | — | — | — |
| 6.0 | 0.6 | 30 | 6 | 19.4 | 9 | 270 | 285 | 65.4 | 7.30 | 0.200 | 0.020 | 0.022 | 0.022 | 0.002 |
| 6.0 | 0.6 | 30 | 6 | 28.2 | 9 | 270 | 285 | 74.4 | 8.31 | 0.200 | 0.020 | 0.022 | 0.022 | 0.002 |
| 6.0 | 0.6 | 30 | 6 | 36.1 | 9 | 270 | 285 | 76.8 | 8.58 | 0.200 | 0.020 | 0.022 | 0.022 | 0.002 |
| 6.0 | 0.6 | 30 | 6 | 40.3 | 9 | 270 | 285 | 77.3 | 8.63 | 0.200 | 0.020 | 0.022 | 0.022 | 0.002 |
| 6.0 | 0.6 | 30 | 6 | 49.1 | 9 | 270 | 285 | 77.3 | 8.64 | 0.200 | 0.020 | 0.022 | 0.022 | 0.002 |
| 6.0 | 0.6 | 30 | 6 | 67.2 | 9 | 270 | 285 | 75.4 | 8.43 | 0.200 | 0.020 | 0.022 | 0.022 | 0.002 |

| t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|
| — | — | — | — | — | — | Reference |
| 0.002 | 10.00 | 0.20 | 0.12 | 4.86 | 4.97 | |
| 0.002 | 10.00 | 0.20 | 0.05 | 1.63 | 1.68 | |
| 0.002 | 10.00 | 0.20 | 0.04 | 0.94 | 0.98 | |
| 0.002 | 10.00 | 0.20 | 0.04 | 0.74 | 0.77 | |
| 0.002 | 10.00 | 0.20 | 0.03 | 0.48 | 0.51 | |
| 0.002 | 10.00 | 0.20 | 0.02 | 0.20 | 0.22 | |

TABLE 30

| H (mm) | t (mm) | J (mm) | K (mm) | θ (deg) | m (number) | L (mm) | L' (mm) | Rigidity (N/mm) | Rigidity Ratio | H/J | t/J | H/L | H/L' | t/L |
|---|---|---|---|---|---|---|---|---|---|---|---|---|---|---|
| — | 0.6 | — | — | — | — | — | 285 | 8.95 | 1.00 | — | — | — | — | — |
| 6.0 | 0.6 | 30 | 15 | 24.8 | 9 | 270 | 285 | 58.7 | 6.56 | 0.200 | 0.020 | 0.022 | 0.022 | 0.002 |
| 6.0 | 0.6 | 30 | 15 | 36.1 | 9 | 270 | 285 | 66.5 | 7.43 | 0.200 | 0.020 | 0.022 | 0.022 | 0.002 |
| 6.0 | 0.6 | 30 | 15 | 44.3 | 9 | 270 | 285 | 68.6 | 7.66 | 0.200 | 0.020 | 0.022 | 0.022 | 0.002 |
| 6.0 | 0.6 | 30 | 15 | 49.1 | 9 | 270 | 285 | 69.2 | 7.73 | 0.200 | 0.020 | 0.022 | 0.022 | 0.002 |
| 6.0 | 0.6 | 30 | 15 | 59.2 | 9 | 270 | 285 | 69.8 | 7.80 | 0.200 | 0.020 | 0.022 | 0.022 | 0.002 |
| 6.0 | 0.6 | 30 | 15 | 82.4 | 9 | 270 | 285 | 69.5 | 7.77 | 0.200 | 0.020 | 0.022 | 0.022 | 0.002 |

TABLE 30-continued

| t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|
| — | — | — | — | — | — | Reference |
| 0.002 | 10.00 | 0.50 | 0.64 | 3.46 | 4.09 | |
| 0.002 | 10.00 | 0.50 | 0.31 | 1.18 | 1.49 | |
| 0.002 | 10.00 | 0.50 | 0.25 | 0.73 | 0.97 | |
| 0.002 | 10.00 | 0.50 | 0.22 | 0.57 | 0.79 | |
| 0.002 | 10.00 | 0.50 | 0.19 | 0.34 | 0.54 | |
| 0.002 | 10.00 | 0.50 | 0.15 | 0.06 | 0.22 | |

TABLE 31

| H (mm) | t (mm) | J (mm) | K (mm) | θ (deg) | m (number) | L (mm) | L' (mm) | Rigidity (N/mm) | Rigidity Ratio | H/J | t/J | H/L | H/L' | t/L |
|---|---|---|---|---|---|---|---|---|---|---|---|---|---|---|
| — | 0.6 | — | — | — | — | — | 285 | 8.95 | 1.00 | — | — | — | — | — |
| 6.0 | 0.6 | 30 | 21 | 33.7 | 9 | 270 | 285 | 50.0 | 5.59 | 0.200 | 0.020 | 0.022 | 0.022 | 0.002 |
| 6.0 | 0.6 | 30 | 21 | 43.0 | 9 | 270 | 285 | 55.4 | 6.19 | 0.200 | 0.020 | 0.022 | 0.022 | 0.002 |
| 6.0 | 0.6 | 30 | 21 | 55.5 | 9 | 270 | 285 | 59.6 | 6.66 | 0.200 | 0.020 | 0.022 | 0.022 | 0.002 |
| 6.0 | 0.6 | 30 | 21 | 63.4 | 9 | 270 | 285 | 61.1 | 6.82 | 0.200 | 0.020 | 0.022 | 0.022 | 0.002 |
| 6.0 | 0.6 | 30 | 21 | 76.9 | 9 | 270 | 285 | 62.4 | 6.97 | 0.200 | 0.020 | 0.022 | 0.022 | 0.002 |
| 6.0 | 0.6 | 30 | 21 | 90.0 | 9 | 270 | 285 | 62.9 | 7.03 | 0.200 | 0.020 | 0.022 | 0.022 | 0.002 |

| t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|
| — | — | — | — | — | — | Reference |
| 0.002 | 10.00 | 0.70 | 1.00 | 2.08 | 3.08 | |
| 0.002 | 10.00 | 0.70 | 0.66 | 1.03 | 1.69 | |
| 0.002 | 10.00 | 0.70 | 0.49 | 0.51 | 1.01 | |
| 0.002 | 10.00 | 0.70 | 0.43 | 0.34 | 0.77 | |
| 0.002 | 10.00 | 0.70 | 0.37 | 0.14 | 0.51 | |
| 0.002 | 10.00 | 0.70 | 0.32 | 0.00 | 0.32 | |

TABLE 32

| H (mm) | t (mm) | J (mm) | K (mm) | θ (deg) | m (number) | L (mm) | L' (mm) | Rigidity (N/mm) | Rigidity Ratio | H/J | t/J | H/L | H/L' | t/L |
|---|---|---|---|---|---|---|---|---|---|---|---|---|---|---|
| — | 0.6 | — | — | — | — | — | 285 | 8.95 | 1.00 | — | — | — | — | — |
| 6.0 | 0.6 | 30 | 24 | 45.0 | 9 | 270 | 285 | 46.5 | 5.20 | 0.200 | 0.020 | 0.022 | 0.022 | 0.002 |
| 6.0 | 0.6 | 30 | 24 | 49.1 | 9 | 270 | 285 | 48.2 | 5.39 | 0.200 | 0.020 | 0.022 | 0.022 | 0.002 |
| 6.0 | 0.6 | 30 | 24 | 63.4 | 9 | 270 | 285 | 52.9 | 5.91 | 0.200 | 0.020 | 0.022 | 0.022 | 0.002 |
| 6.0 | 0.6 | 30 | 24 | 73.9 | 9 | 270 | 285 | 54.9 | 6.14 | 0.200 | 0.020 | 0.022 | 0.022 | 0.002 |
| 6.0 | 0.6 | 30 | 24 | 82.4 | 9 | 270 | 285 | 56.0 | 6.25 | 0.200 | 0.020 | 0.022 | 0.022 | 0.002 |
| 6.0 | 0.6 | 30 | 24 | 90.0 | 9 | 270 | 285 | 56.5 | 6.32 | 0.200 | 0.020 | 0.022 | 0.022 | 0.002 |

| t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|
| — | — | — | — | — | — | Reference |
| 0.002 | 10.00 | 0.80 | 1.00 | 1.13 | 2.13 | |
| 0.002 | 10.00 | 0.80 | 0.88 | 0.87 | 1.75 | |
| 0.002 | 10.00 | 0.80 | 0.65 | 0.39 | 1.04 | |
| 0.002 | 10.00 | 0.80 | 0.56 | 0.20 | 0.76 | |
| 0.002 | 10.00 | 0.80 | 0.51 | 0.08 | 0.59 | |
| 0.002 | 10.00 | 0.80 | 0.47 | 0.00 | 0.47 | |

TABLE 33

| H (mm) | t (mm) | J (mm) | K (mm) | θ (deg) | m (number) | L (mm) | L' (mm) | Rigidity (N/mm) | Rigidity Ratio | H/J | t/J | H/L | H/L' | t/L |
|---|---|---|---|---|---|---|---|---|---|---|---|---|---|---|
| — | 0.6 | — | — | — | — | — | 285 | 8.95 | 1.00 | — | — | — | — | — |
| 6.0 | 0.6 | 30 | 27 | 63.4 | 9 | 270 | 285 | 40.5 | 4.53 | 0.200 | 0.020 | 0.022 | 0.022 | 0.002 |
| 6.0 | 0.6 | 30 | 27 | 73.9 | 9 | 270 | 285 | 42.9 | 4.80 | 0.200 | 0.020 | 0.022 | 0.022 | 0.002 |
| 6.0 | 0.6 | 30 | 27 | 82.4 | 9 | 270 | 285 | 44.6 | 4.98 | 0.200 | 0.020 | 0.022 | 0.022 | 0.002 |
| 6.0 | 0.6 | 30 | 27 | 90.0 | 9 | 270 | 285 | 45.6 | 5.09 | 0.200 | 0.020 | 0.022 | 0.022 | 0.002 |

| t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|
| — | — | — | — | — | — | Reference |
| 0.002 | 10.00 | 0.90 | 1.00 | 0.47 | 1.47 | |
| 0.002 | 10.00 | 0.90 | 0.84 | 0.23 | 1.07 | |
| 0.002 | 10.00 | 0.90 | 0.75 | 0.10 | 0.84 | |
| 0.002 | 10.00 | 0.90 | 0.68 | 0.00 | 0.68 | |

TABLE 34

| H (mm) | t (mm) | J (mm) | K (mm) | θ (deg) | m (number) | L (mm) | L' (mm) | Rigidity (N/mm) | Rigidity Ratio | H/J | t/J | H/L | H/L' | t/L |
|---|---|---|---|---|---|---|---|---|---|---|---|---|---|---|
| — | 0.6 | — | — | — | — | — | 285 | 0.37 | 1.00 | — | — | — | — | — |
| 6.0 | 0.6 | 30 | 0 | 11.3 | 9 | 270 | 285 | 1.63 | 4.40 | 0.200 | 0.020 | 0.022 | 0.022 | 0.002 |
| 6.0 | 0.6 | 30 | 0 | 19.4 | 9 | 270 | 285 | 3.34 | 9.02 | 0.200 | 0.020 | 0.022 | 0.022 | 0.002 |
| 6.0 | 0.6 | 30 | 0 | 28.2 | 9 | 270 | 285 | 3.73 | 10.06 | 0.200 | 0.020 | 0.022 | 0.022 | 0.002 |
| 6.0 | 0.6 | 30 | 0 | 49.1 | 9 | 270 | 285 | 3.91 | 10.56 | 0.200 | 0.020 | 0.022 | 0.022 | 0.002 |
| 6.0 | 0.6 | 30 | 0 | 63.4 | 9 | 270 | 285 | 4.04 | 10.92 | 0.200 | 0.020 | 0.022 | 0.022 | 0.002 |
| 6.0 | 0.6 | 30 | 0 | 73.9 | 9 | 270 | 285 | 4.11 | 11.09 | 0.200 | 0.020 | 0.022 | 0.022 | 0.002 |
| 6.0 | 0.6 | 30 | 0 | 82.4 | 9 | 270 | 285 | 4.18 | 11.28 | 0.200 | 0.020 | 0.022 | 0.022 | 0.002 |
| 6.0 | 0.6 | 30 | 0 | 90.0 | 9 | 270 | 285 | 4.25 | 11.46 | 0.200 | 0.020 | 0.022 | 0.022 | 0.002 |

| t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|
| — | — | — | — | — | — | Reference |
| 0.002 | 10.00 | 0.00 | | | | |
| 0.002 | 10.00 | 0.00 | 0.00 | 4.34 | 4.34 | |
| 0.002 | 10.00 | 0.00 | 0.00 | 1.55 | 1.55 | |
| 0.002 | 10.00 | 0.00 | 0.00 | 0.46 | 0.46 | |
| 0.002 | 10.00 | 0.00 | 0.00 | 0.23 | 0.23 | |
| 0.002 | 10.00 | 0.00 | 0.00 | 0.13 | 0.13 | |
| 0.002 | 10.00 | 0.00 | 0.00 | 0.06 | 0.68 | |
| 0.002 | 10.00 | 0.00 | 0.00 | 0.00 | 0.00 | |

TABLE 35

| H (mm) | t (mm) | J (mm) | K (mm) | θ (deg) | m (number) | L (mm) | L' (mm) | Rigidity (N/mm) | Rigidity Ratio | H/J | t/J | H/L | H/L' | t/L |
|---|---|---|---|---|---|---|---|---|---|---|---|---|---|---|
| — | 0.6 | — | — | — | — | — | 285 | 0.37 | 1.00 | — | — | — | — | — |
| 6.0 | 0.6 | 30 | 3 | 12.5 | 9 | 270 | 285 | 1.96 | 5.28 | 0.200 | 0.020 | 0.022 | 0.022 | 0.002 |
| 6.0 | 0.6 | 30 | 3 | 19.4 | 9 | 270 | 285 | 3.46 | 9.33 | 0.200 | 0.020 | 0.022 | 0.022 | 0.002 |
| 6.0 | 0.6 | 30 | 3 | 28.2 | 9 | 270 | 285 | 3.91 | 10.57 | 0.200 | 0.020 | 0.022 | 0.022 | 0.002 |
| 6.0 | 0.6 | 30 | 3 | 49.1 | 9 | 270 | 285 | 4.06 | 10.96 | 0.200 | 0.020 | 0.022 | 0.022 | 0.002 |
| 6.0 | 0.6 | 30 | 3 | 63.4 | 9 | 270 | 285 | 3.95 | 10.67 | 0.200 | 0.020 | 0.022 | 0.022 | 0.002 |
| 6.0 | 0.6 | 30 | 3 | 73.9 | 9 | 270 | 285 | 3.84 | 10.36 | 0.200 | 0.020 | 0.022 | 0.022 | 0.002 |
| 6.0 | 0.6 | 30 | 3 | 82.4 | 9 | 270 | 285 | 3.75 | 10.13 | 0.200 | 0.020 | 0.022 | 0.022 | 0.002 |
| 6.0 | 0.6 | 30 | 3 | 90.0 | 9 | 270 | 285 | 3.69 | 9.96 | 0.200 | 0.020 | 0.022 | 0.022 | 0.002 |

TABLE 35-continued

| t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|
| — | — | — | — | — | — | Reference |
| 0.002 | 10.00 | 0.10 | 1.00 | 198.0 | 199.0 | |
| 0.002 | 10.00 | 0.10 | 0.03 | 4.46 | 4.48 | |
| 0.002 | 10.00 | 0.10 | 0.01 | 1.57 | 1.58 | |
| 0.002 | 10.00 | 0.10 | 0.01 | 0.47 | 0.47 | |
| 0.002 | 10.00 | 0.10 | 0.01 | 0.24 | 0.24 | |
| 0.002 | 10.00 | 0.10 | 0.01 | 0.13 | 0.13 | |
| 0.002 | 10.00 | 0.10 | 0.01 | 0.06 | 0.06 | |
| 0.002 | 10.00 | 0.10 | 0.01 | 0.00 | 0.01 | |

TABLE 36

| H (mm) | t (mm) | J (mm) | K (mm) | θ (deg) | m (number) | L (mm) | L' (mm) | Rigidity (N/mm) | Rigidity Ratio | H/J | t/J | H/L | H/L' | t/L |
|---|---|---|---|---|---|---|---|---|---|---|---|---|---|---|
| — | 0.6 | — | — | — | — | — | 285 | 0.37 | 1.00 | — | — | — | — | — |
| 6.0 | 0.6 | 30 | 6 | 19.4 | 9 | 270 | 285 | 3.53 | 9.54 | 0.200 | 0.020 | 0.022 | 0.022 | 0.002 |
| 6.0 | 0.6 | 30 | 6 | 28.2 | 9 | 270 | 285 | 4.07 | 10.98 | 0.200 | 0.020 | 0.022 | 0.022 | 0.002 |
| 6.0 | 0.6 | 30 | 6 | 36.1 | 9 | 270 | 285 | 4.14 | 11.17 | 0.200 | 0.020 | 0.022 | 0.022 | 0.002 |
| 6.0 | 0.6 | 30 | 6 | 40.3 | 9 | 270 | 285 | 4.11 | 11.11 | 0.200 | 0.020 | 0.022 | 0.022 | 0.002 |
| 6.0 | 0.6 | 30 | 6 | 49.1 | 9 | 270 | 285 | 4.01 | 10.84 | 0.200 | 0.020 | 0.022 | 0.022 | 0.002 |
| 6.0 | 0.6 | 30 | 6 | 67.2 | 9 | 270 | 285 | 3.72 | 10.04 | 0.200 | 0.020 | 0.022 | 0.022 | 0.002 |

| t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|
| — | — | — | — | — | — | Reference |
| 0.002 | 10.00 | 0.20 | 0.12 | 4.86 | 4.97 | |
| 0.002 | 10.00 | 0.20 | 0.05 | 1.63 | 1.68 | |
| 0.002 | 10.00 | 0.20 | 0.04 | 0.94 | 0.98 | |
| 0.002 | 10.00 | 0.20 | 0.04 | 0.74 | 0.77 | |
| 0.002 | 10.00 | 0.20 | 0.03 | 0.48 | 0.51 | |
| 0.002 | 10.00 | 0.20 | 0.02 | 0.20 | 0.22 | |

TABLE 37

| H (mm) | t (mm) | J (mm) | K (mm) | θ (deg) | m (number) | L (mm) | L' (mm) | Rigidity (N/mm) | Rigidity Ratio | H/J | t/J | H/L | H/L' | t/L |
|---|---|---|---|---|---|---|---|---|---|---|---|---|---|---|
| — | 0.6 | — | — | — | — | — | 285 | 0.37 | 1.00 | — | — | — | — | — |
| 6.0 | 0.6 | 30 | 15 | 24.8 | 9 | 270 | 285 | 2.97 | 8.03 | 0.200 | 0.020 | 0.022 | 0.022 | 0.002 |
| 6.0 | 0.6 | 30 | 15 | 36.1 | 9 | 270 | 285 | 3.30 | 8.91 | 0.200 | 0.020 | 0.022 | 0.022 | 0.002 |
| 6.0 | 0.6 | 30 | 15 | 44.3 | 9 | 270 | 285 | 3.32 | 8.97 | 0.200 | 0.020 | 0.022 | 0.022 | 0.002 |
| 6.0 | 0.6 | 30 | 15 | 49.1 | 9 | 270 | 285 | 3.31 | 8.93 | 0.200 | 0.020 | 0.022 | 0.022 | 0.002 |
| 6.0 | 0.6 | 30 | 15 | 59.2 | 9 | 270 | 285 | 3.25 | 8.77 | 0.200 | 0.020 | 0.022 | 0.022 | 0.002 |
| 6.0 | 0.6 | 30 | 15 | 82.4 | 9 | 270 | 285 | 3.08 | 8.32 | 0.200 | 0.020 | 0.022 | 0.022 | 0.002 |

| t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|
| — | — | — | — | — | — | Reference |
| 0.002 | 10.00 | 0.50 | 0.64 | 3.46 | 4.09 | |
| 0.002 | 10.00 | 0.50 | 0.31 | 1.18 | 1.49 | |
| 0.002 | 10.00 | 0.50 | 0.25 | 0.73 | 0.97 | |
| 0.002 | 10.00 | 0.50 | 0.22 | 0.57 | 0.79 | |
| 0.002 | 10.00 | 0.50 | 0.19 | 0.34 | 0.54 | |
| 0.002 | 10.00 | 0.50 | 0.15 | 0.06 | 0.22 | |

TABLE 38

| H (mm) | t (mm) | J (mm) | K (mm) | θ (deg) | m (number) | L (mm) | L' (mm) | Rigidity (N/mm) | Rigidity Ratio | H/J | t/J | H/L | H/L' | t/L |
|---|---|---|---|---|---|---|---|---|---|---|---|---|---|---|
| — | 0.6 | — | — | — | — | — | 285 | 0.37 | 1.00 | — | — | — | — | — |
| 6.0 | 0.6 | 30 | 21 | 33.7 | 9 | 270 | 285 | 2.27 | 6.12 | 0.200 | 0.020 | 0.022 | 0.022 | 0.002 |
| 6.0 | 0.6 | 30 | 21 | 43.0 | 9 | 270 | 285 | 2.50 | 6.75 | 0.200 | 0.020 | 0.022 | 0.022 | 0.002 |
| 6.0 | 0.6 | 30 | 21 | 55.5 | 9 | 270 | 285 | 2.65 | 7.15 | 0.200 | 0.020 | 0.022 | 0.022 | 0.002 |
| 6.0 | 0.6 | 30 | 21 | 63.4 | 9 | 270 | 285 | 2.68 | 7.23 | 0.200 | 0.020 | 0.022 | 0.022 | 0.002 |
| 6.0 | 0.6 | 30 | 21 | 76.9 | 9 | 270 | 285 | 2.68 | 7.24 | 0.200 | 0.020 | 0.022 | 0.022 | 0.002 |
| 6.0 | 0.6 | 30 | 21 | 90.0 | 9 | 270 | 285 | 2.66 | 7.17 | 0.200 | 0.020 | 0.022 | 0.022 | 0.002 |

| t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|
| — | — | — | — | — | — | Reference |
| 0.002 | 10.00 | 0.70 | 1.00 | 2.08 | 3.08 | |
| 0.002 | 10.00 | 0.70 | 0.66 | 1.03 | 1.69 | |
| 0.002 | 10.00 | 0.70 | 0.49 | 0.51 | 1.01 | |
| 0.002 | 10.00 | 0.70 | 0.43 | 0.34 | 0.77 | |
| 0.002 | 10.00 | 0.70 | 0.37 | 0.14 | 0.51 | |
| 0.002 | 10.00 | 0.70 | 0.32 | 0.00 | 0.32 | |

TABLE 39

| H (mm) | t (mm) | J (mm) | K (mm) | θ (deg) | m (number) | L (mm) | L' (mm) | Rigidity (N/mm) | Rigidity Ratio | H/J | t/J | H/L | H/L' | t/L |
|---|---|---|---|---|---|---|---|---|---|---|---|---|---|---|
| — | 0.6 | — | — | — | — | — | 285 | 0.37 | 1.00 | — | — | — | — | — |
| 6.0 | 0.6 | 30 | 24 | 45.0 | 9 | 270 | 285 | 1.97 | 5.31 | 0.200 | 0.020 | 0.022 | 0.022 | 0.002 |
| 6.0 | 0.6 | 30 | 24 | 49.1 | 9 | 270 | 285 | 2.04 | 5.50 | 0.200 | 0.020 | 0.022 | 0.022 | 0.002 |
| 6.0 | 0.6 | 30 | 24 | 63.4 | 9 | 270 | 285 | 2.22 | 6.00 | 0.200 | 0.020 | 0.022 | 0.022 | 0.002 |
| 6.0 | 0.6 | 30 | 24 | 73.9 | 9 | 270 | 285 | 2.29 | 6.17 | 0.200 | 0.020 | 0.022 | 0.022 | 0.002 |
| 6.0 | 0.6 | 30 | 24 | 82.4 | 9 | 270 | 285 | 2.31 | 6.24 | 0.200 | 0.020 | 0.022 | 0.022 | 0.002 |
| 6.0 | 0.6 | 30 | 24 | 90.0 | 9 | 270 | 285 | 2.32 | 6.26 | 0.200 | 0.020 | 0.022 | 0.022 | 0.002 |

| t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|
| — | — | — | — | — | — | Reference |
| 0.002 | 10.00 | 0.80 | 1.00 | 1.13 | 2.13 | |
| 0.002 | 10.00 | 0.80 | 0.88 | 0.87 | 1.75 | |
| 0.002 | 10.00 | 0.80 | 0.65 | 0.39 | 1.04 | |
| 0.002 | 10.00 | 0.80 | 0.56 | 0.20 | 0.76 | |
| 0.002 | 10.00 | 0.80 | 0.51 | 0.08 | 0.59 | |
| 0.002 | 10.00 | 0.80 | 0.47 | 0.00 | 0.47 | |

TABLE 40

| H (mm) | t (mm) | J (mm) | K (mm) | θ (deg) | m (number) | L (mm) | L' (mm) | Rigidity (N/mm) | Rigidity Ratio | H/J | t/J | H/L | H/L' | t/L |
|---|---|---|---|---|---|---|---|---|---|---|---|---|---|---|
| — | 0.6 | — | — | — | — | — | 285 | 0.37 | 1.00 | — | — | — | — | — |
| 6.0 | 0.6 | 30 | 27 | 63.4 | 9 | 270 | 285 | 1.54 | 4.16 | 0.200 | 0.020 | 0.022 | 0.022 | 0.002 |
| 6.0 | 0.6 | 30 | 27 | 73.9 | 9 | 270 | 285 | 1.64 | 4.43 | 0.200 | 0.020 | 0.022 | 0.022 | 0.002 |
| 6.0 | 0.6 | 30 | 27 | 82.4 | 9 | 270 | 285 | 1.70 | 4.60 | 0.200 | 0.020 | 0.022 | 0.022 | 0.002 |
| 6.0 | 0.6 | 30 | 27 | 90.0 | 9 | 270 | 285 | 1.74 | 4.71 | 0.200 | 0.020 | 0.022 | 0.022 | 0.002 |

| t/L' | H/t | K/J | (top flat section area)/(upper surface section area + bottom surface section area) | (inclined section area)/(upper surface section area + bottom surface section area) | (top flat section area + inclined section area)/(upper surface section area + bottom surface section area) | Remarks |
|---|---|---|---|---|---|---|
| — | — | — | — | — | — | Reference |
| 0.002 | 10.00 | 0.90 | 1.00 | 0.47 | 1.47 | |
| 0.002 | 10.00 | 0.90 | 0.84 | 0.23 | 1.07 | |

TABLE 40-continued

| | | | | | |
|---|---|---|---|---|---|
| 0.002 | 10.00 | 0.90 | 0.75 | 0.10 | 0.84 |
| 0.002 | 10.00 | 0.90 | 0.68 | 0.00 | 0.68 |

As can be seen from FIG. 28 to FIG. 31, rigidity ratio changes with values of the diagonal length K of the top flat section 5E and the inclination angle θ of the inclined surface section 42E (62E). Although values of the optimum diagonal length K and the inclination angle θ can be found in design, suitable values for K and θ may change due to the characteristics of materials to be used for the panel, and also they may be changed in order to ensure secondary-workability when forming the shape of the panel with protrusions and recesses provided thereon. Even in the case where values of the diagonal length K and the inclination angle θ change in this type of manner, it is possible to ensure the maximum value of rigidity ratio including the inflection point provided that the value of (top flat section area+inclined section area)/(upper surface section area+bottom surface section area) is not more than 1.0. Therefore, even if the characteristics of the panel material or the required level of secondary workability change, it is possible to ensure superior panel rigidity.

Moreover, although the panel shape of Example 5 is taken as a base, a similar effect can also be obtained with use of the panels of Examples 1 to 4.

Figure 32:
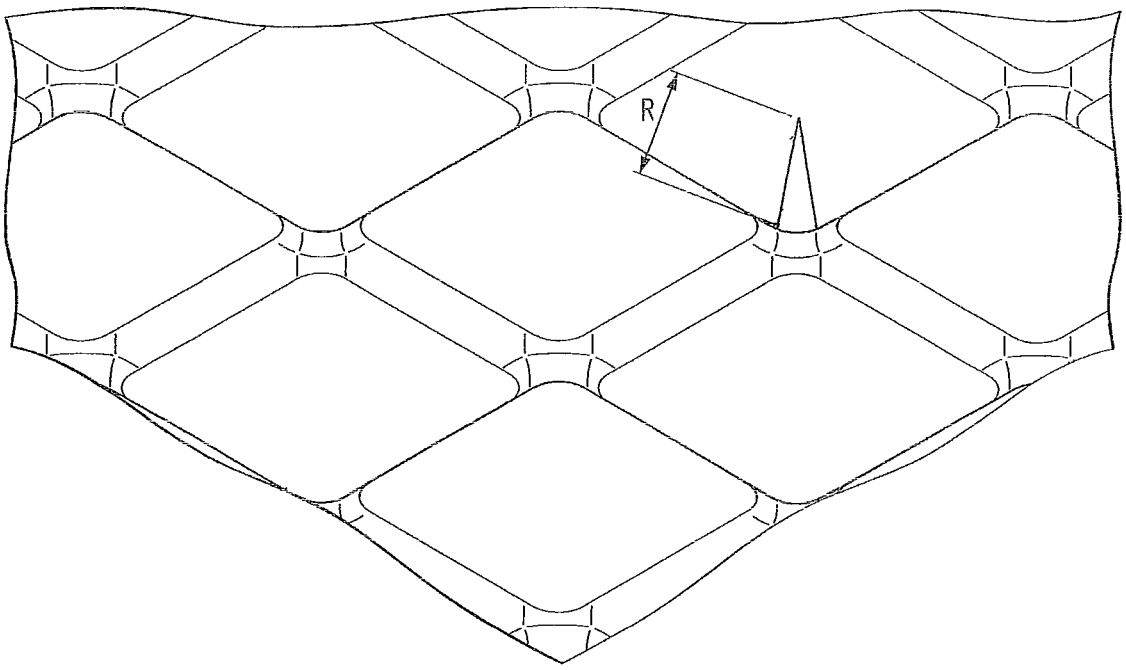
FIG. 32 is a perspective view showing a circular arc section which connects the protrusion and the recess.
Figure 33:
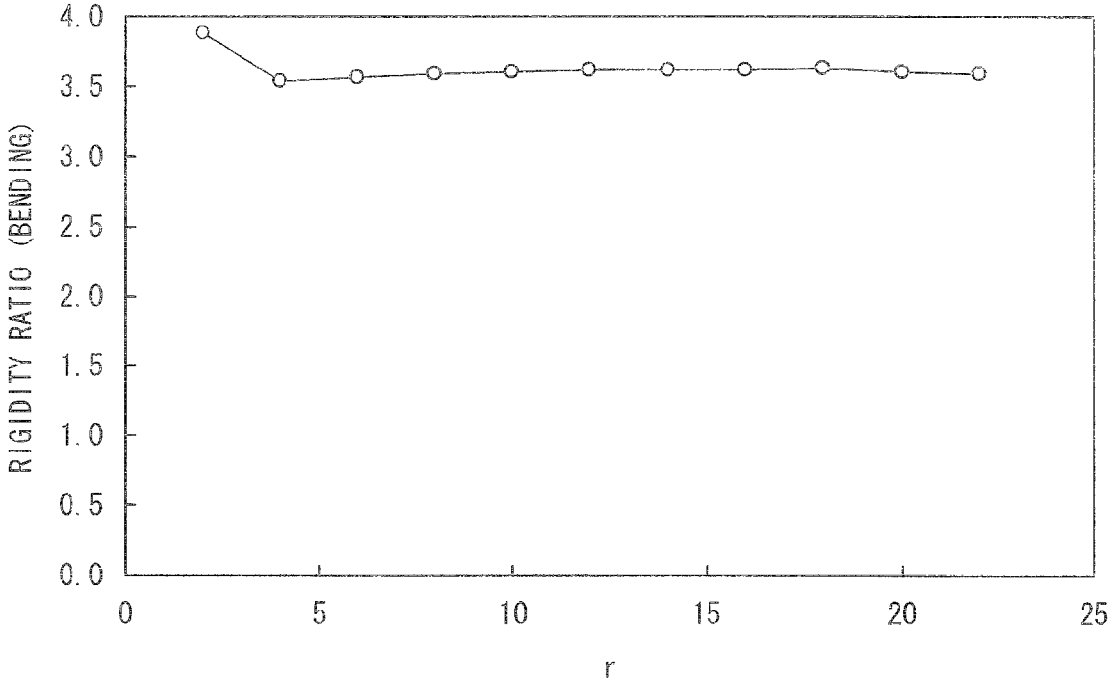
FIG. 33 is a graph showing rigidity ratios (bending) in the case where the size of the circular arc section is changed.
Figure 34:
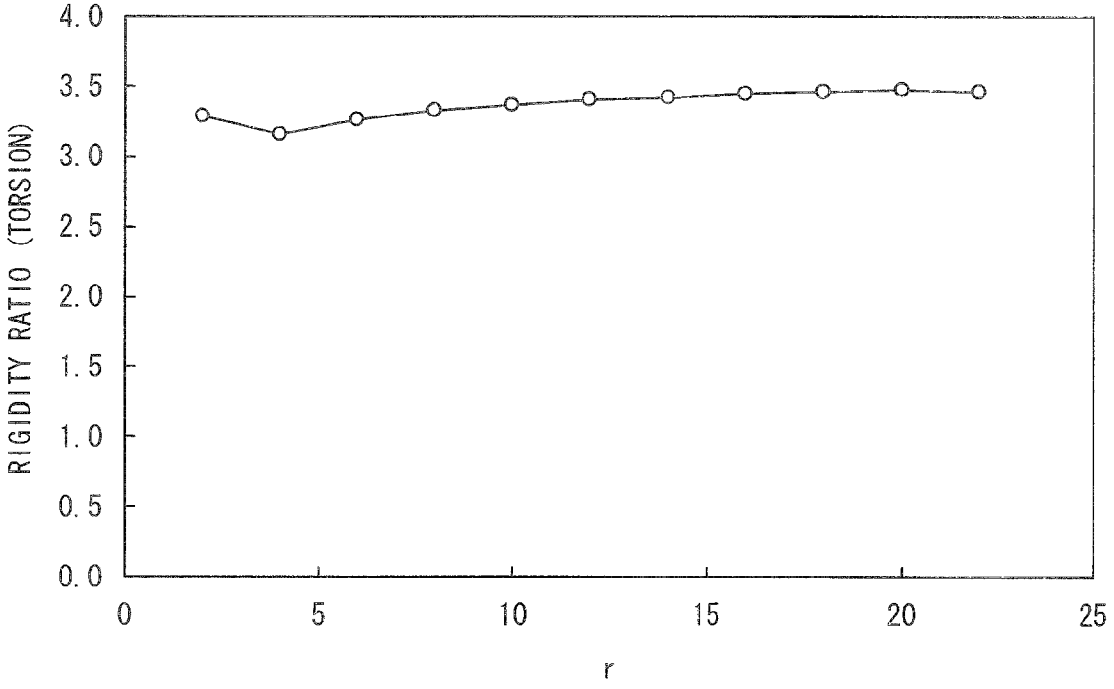
FIG. 34 is a graph showing rigidity ratios (torsion) in the case where the size of the circular arc section is changed.

Taking the panel shape of Example 4 as a base, with use of the dimensions of the respective sections of the panel shown in Tables 41 and 42, respective rigidity ratios of bending rigidity and torsional rigidity in the case where a circular arc section (radius R=r×t) is provided at the intersection of the inclined surface sections which connect a protrusion and a recess as shown in FIG. 32 and the ratio r of the radius R of the circular arc section with respect to the plate thickness t is changed (as with Comparative Example 1, a panel having no protrusions and recesses is taken as the reference of comparison), are shown in FIG. 33 and FIG. 34.

TABLE 41

| H (mm) | t (mm) | J (mm) | K (mm) | R (mm) | r | θ (deg) | m (number) | L (mm) | L' (mm) | Rigidity (N/mm) |
|---|---|---|---|---|---|---|---|---|---|---|
| — | 0.6 | — | — | — | — | — | — | — | 285 | 8.95 |
| 3.0 | 0.6 | 30 | 0 | 1.2 | 2 | 45 | 9 | 270 | 285 | 34.8 |
| 3.0 | 0.6 | 30 | 0 | 2.4 | 4 | 45 | 9 | 270 | 285 | 31.7 |
| 3.0 | 0.6 | 30 | 0 | 3.6 | 6 | 45 | 9 | 270 | 285 | 31.9 |
| 3.0 | 0.6 | 30 | 0 | 4.8 | 8 | 45 | 9 | 270 | 285 | 32.2 |
| 3.0 | 0.6 | 30 | 0 | 6 | 10 | 45 | 9 | 270 | 285 | 32.3 |
| 0.0 | 0.6 | 30 | 0 | 7.2 | 12 | 45 | 9 | 270 | 285 | 32.3 |
| 0.0 | 0.6 | 30 | 0 | 8.4 | 14 | 45 | 9 | 270 | 285 | 32.4 |
| 0.0 | 0.6 | 30 | 0 | 9.6 | 16 | 45 | 9 | 270 | 285 | 32.4 |
| 0.0 | 0.6 | 30 | 0 | 10.8 | 18 | 45 | 9 | 270 | 285 | 32.4 |
| 0.0 | 0.6 | 30 | 0 | 12 | 20 | 45 | 9 | 270 | 285 | 32.3 |
| 0.0 | 0.6 | 30 | 0 | 13.2 | 22 | 45 | 9 | 270 | 285 | 32.1 |

| Rigidity Ratio | H/J | t/J | H/L | H/L' | t/L | t/L' | H/t | K/J | Remarks |
|---|---|---|---|---|---|---|---|---|---|
| 1.00 | — | — | — | — | — | — | — | — | Reference |
| 3.89 | 0.100 | 0.020 | 0.011 | 0.011 | 0.002 | 0.002 | 5.00 | 0.04 | |
| 3.54 | 0.100 | 0.020 | 0.011 | 0.011 | 0.002 | 0.002 | 5.00 | 0.08 | |
| 3.57 | 0.100 | 0.020 | 0.011 | 0.011 | 0.002 | 0.002 | 5.00 | 0.12 | |
| 3.59 | 0.100 | 0.020 | 0.011 | 0.011 | 0.002 | 0.002 | 5.00 | 0.16 | |
| 3.61 | 0.100 | 0.020 | 0.011 | 0.011 | 0.002 | 0.002 | 5.00 | 0.20 | |
| 3.61 | 0.000 | 0.020 | 0.000 | 0.000 | 0.002 | 0.002 | 0.00 | 0.24 | |
| 3.82 | 0.000 | 0.020 | 0.000 | 0.000 | 0.002 | 0.002 | 0.00 | 0.28 | |
| 3.62 | 0.000 | 0.020 | 0.000 | 0.000 | 0.002 | 0.002 | 0.00 | 0.32 | |
| 3.62 | 0.000 | 0.020 | 0.000 | 0.000 | 0.002 | 0.002 | 0.00 | 0.36 | |
| 3.61 | 0.000 | 0.020 | 0.000 | 0.000 | 0.002 | 0.002 | 0.00 | 0.40 | |
| 3.59 | 0.000 | 0.020 | 0.000 | 0.000 | 0.002 | 0.002 | 0.00 | 0.44 | |

TABLE 42

| H (mm) | t (mm) | J (mm) | K (mm) | R (mm) | r | θ (deg) | m (number) | L (mm) | L' (mm) | Rigidity (N/mm) |
|---|---|---|---|---|---|---|---|---|---|---|
| — | 0.6 | — | — | — | — | — | — | — | 285 | 0.37 |
| 3.0 | 0.6 | 30 | 0 | 1.2 | 2 | 45 | 9 | 270 | 285 | 1.22 |
| 3.0 | 0.6 | 30 | 0 | 2.4 | 4 | 45 | 9 | 270 | 285 | 1.17 |
| 3.0 | 0.6 | 30 | 0 | 3.6 | 6 | 45 | 9 | 270 | 285 | 1.21 |
| 3.0 | 0.8 | 30 | 0 | 4.8 | 8 | 45 | 9 | 270 | 285 | 1.23 |
| 3.0 | 0.6 | 30 | 0 | 6 | 10 | 45 | 9 | 270 | 285 | 1.25 |
| 3.0 | 0.6 | 30 | 0 | 7.2 | 12 | 45 | 9 | 270 | 285 | 1.26 |
| 3.0 | 0.6 | 30 | 0 | 8.4 | 14 | 45 | 9 | 270 | 285 | 1.27 |
| 3.0 | 0.6 | 30 | 0 | 9.6 | 16 | 45 | 9 | 270 | 285 | 1.28 |
| 3.0 | 0.6 | 30 | 0 | 10.8 | 18 | 45 | 9 | 270 | 285 | 1.28 |
| 3.0 | 0.6 | 30 | 0 | 12 | 20 | 45 | 9 | 270 | 285 | 1.29 |

TABLE 42-continued

| 3.0 | 0.6 | 30 | 0 | 13.2 | 22 | 45 | 9 | 270 | 285 | 1.28 |
|---|---|---|---|---|---|---|---|---|---|---|
| Rigidity Ratio | H/J | t/J | H/L | H/L' | t/L | t/L' | H/t | K/J | Remarks | |
| 1.00 | — | — | — | — | — | — | — | — | Reference | |
| 3.29 | 0.100 | 0.020 | 0.011 | 0.011 | 0.002 | 0.002 | 5.00 | 0.00 | | |
| 3.15 | 0.100 | 0.020 | 0.011 | 0.011 | 0.002 | 0.002 | 5.00 | 0.00 | | |
| 3.25 | 0.100 | 0.020 | 0.011 | 0.011 | 0.002 | 0.002 | 5.00 | 0.00 | | |
| 3.32 | 0.100 | 0.020 | 0.011 | 0.011 | 0.002 | 0.002 | 5.00 | 0.00 | | |
| 3.37 | 0.100 | 0.020 | 0.011 | 0.011 | 0.002 | 0.002 | 5.00 | 0.00 | | |
| 3.40 | 0.100 | 0.020 | 0.011 | 0.011 | 0.002 | 0.002 | 5.00 | 0.00 | | |
| 3.43 | 0.100 | 0.020 | 0.011 | 0.011 | 0.002 | 0.002 | 5.00 | 0.00 | | |
| 3.44 | 0.100 | 0.020 | 0.011 | 0.011 | 0.002 | 0.002 | 5.00 | 0.00 | | |
| 3.46 | 0.100 | 0.020 | 0.011 | 0.011 | 0.002 | 0.002 | 5.00 | 0.00 | | |
| 3.48 | 0.100 | 0.020 | 0.011 | 0.011 | 0.002 | 0.002 | 5.00 | 0.00 | | |
| 3.46 | 0.100 | 0.020 | 0.011 | 0.011 | 0.002 | 0.002 | 5.00 | 0.00 | | |

As can be seen from FIG. 33 and FIG. 34, the level of bending rigidity and torsional rigidity improved even when the value of r was changed from 0 to 22, and it can be understood that it is possible to obtain the effect of improving the rigidity even if r of the intersection section is appropriately set according to the characteristic of the material to be used for the panel. That is to say, by providing a circular arc section instead of the flat section, it is possible to obtain an effect similar to that in the case of providing the flat section. Moreover, there is an advantage in that working of the circular arc section formation can be performed easily.

The present invention is not a configuration to be limited by the above embodiments, and includes other configurations which enable realization of the object of the present invention. The present invention also includes modifications such as those shown below.

For example, in the above embodiments, there has been described a case where the reference surface F of the panel 1 is a flat surface. However, the reference surface F is not limited to a flat surface, and it may be a cylindrical surface, a spherical surface, a gently curved surface, or any other three-dimensional curved surface. Furthermore, the shape of the panel 1 is not limited to a rectangular shape, and a panel in an arbitrary shape may be used. Moreover, the shapes of the flat surface of the protrusions, the recesses, and the flat sections are not limited to those in the above embodiments, and an arbitrary shape may be used. The protrusions and the recesses do not always have to be formed only with protrusions from the reference surface to one side and with recesses to the other side, and it is possible, only with protrusions to one side or only with recesses to the other side, to obtain a panel having an arrangement and dimensions of protrusions and recesses of the intended purpose as a result.

Furthermore, the distance H between the quadrangular frustrum top surfaces of the protrusion and the recess does not always have to be greater than the plate thickness, and the panel may be provided with H smaller than the plate thickness t.

Moreover, the plate bending radius for forming protrusions and recesses may be appropriately set according to the characteristics of the material to be used for the panel.

In addition, the best configurations and methods for carrying out the present invention are disclosed in the above description. However, the present invention is not limited to these. That is to say, although the present invention is especially illustrated and described primarily for the specific embodiments, those working in the field may make various modifications to the above embodiments in terms of shape, material, quantity, and other detailed configurations, without departing from the technical idea and the scope of the invention.

Therefore, the description which limits the shapes and materials disclosed above refers to panels illustrated as examples for facilitating understanding of the present invention, and the present invention is not limited by these shapes and materials. Therefore, the present invention includes descriptions made with names of members which do not have part or all of the limitations on these shapes and materials.

INDUSTRIAL APPLICABILITY

According to the present invention it is possible to provide a panel which has a simple structure and is capable of reliably increasing the level of rigidity thereof and reducing the weight thereof.

REFERENCE SIGNS LIST

1, 1A, 1B, 1C, 1D, 1E: Panel
4A, 4B, 4C, 4D, 4E: Protrusion
5A, 5C: Flat section
5E: Top flat section (top upper surface)
6, 6B, 6D, 6E: Recess
42A, 42B, 42C, 42D, 42E: Inclined surface section (protrusion side inclined surface)
51E: Bridge
62B, 62D, 62E: Inclined surface section (recess side inclined surface)
F: Reference surface

The invention claimed is:

1. A panel which is made of metal, the panel comprising,
protrusions protruding from a predetermined reference surface and having an upper surface section; and
flat sections being flush with the reference surface, wherein:
an entire periphery of each of the protrusions not including a corner section is surrounded by the flat sections, and an entire periphery of each of the flat sections is surrounded by the protrusions;
each of the corner sections of respective adjacent protrusions is connected via a bridge having a flat top upper surface or having a circular arc section;
a protrusion side inclined surface which is not vertical to the predetermined reference surface is formed on a peripheral portion of the protrusions;

a corner section inclined surface which extends from the corner sections toward the reference surface is formed; and (S3+S4)/(S1) is equal to or less than 1.0, where:

S1 is a total area of the upper surface sections of the protrusions;

S3 is a total area of the flat top upper surface of the bridges; and

S4 is a total area of the protrusion side inclined surface and the corner section inclined surface.

2. The panel according to claim 1, wherein when viewed from a front, the protrusions, and the flat sections are alternately arranged along a widthwise direction and a lengthwise direction orthogonal to this widthwise direction.

3. The panel according to claim 1, wherein when viewed from a front, each of the protrusions has a hexagonal shape, and each of the flat sections has a triangular shape.

4. The panel according to claim 1, wherein when viewed from a front, the protrusions and the flat sections both have a quadrangular shape.

5. The panel according to claim 1, wherein a frame section is provided along a periphery of the panel, which includes all of the protrusions, and the flat sections.

6. A panel which is made of a metal, the panel comprising, protrusions protruding from a predetermined reference surface and having an upper surface section; and recesses being recessed from the reference surface and having a bottom surface section, wherein:

an entire periphery of each of the protrusions not including a corner section is surrounded by the recesses, and an entire periphery of each of the recesses is surrounded by the protrusions not including the corner section;

each of the corner sections of respective adjacent protrusions is connected via a bridge having a flat top upper surface or having a circular arc section, the flat top upper surface or the circular arc section of the bridge being provided apart from a plane containing the upper surface sections of the protrusions toward the predetermined reference surface;

a protrusion side inclined surface which is not vertical to the predetermined reference surface is formed on a peripheral portion of the protrusions, and a recess side inclined surface which is not vertical to the predetermined reference surface is formed on a peripheral portion of the recesses;

a corner section inclined surface which extends from the corner sections toward the reference surface is formed; and (S3+S4)/(S1+S2) is equal to or less than 1.0, where:

S1 is a total area of the upper surface sections of the protrusions;

S2 is a total area of the bottom surface sections of the recesses;

S3 is a total area of the flat top upper surface of the bridges; and

S4 is a total area of the protrusion side inclined surface, the recess side inclined surface, and the corner section inclined surface.

7. The panel according to claim 6, wherein when viewed from a front, the protrusions, and the recesses are alternately arranged along a widthwise direction and a lengthwise direction orthogonal to this widthwise direction.

8. The panel according to claim 6, wherein when viewed from a front, each of the protrusions has a hexagonal shape, and each of the recesses has a triangular shape.

9. The panel according to claim 6, wherein when viewed from a front, the protrusions and the recesses both have a quadrangular shape.

10. The panel according to claim 6, wherein:

when the protrusion side inclined surface and the recess side inclined surface are viewed on a cross-section perpendicular to the reference surface, the protrusion side inclined surface and the recess side inclined surface are linearly and continuously connected; and an inclination angle of the protrusion side inclined surface and an inclination angle of the recess side inclined surface are same.

11. The panel according to claim 6, wherein:

planar shapes and planar dimensions of the protrusions and the recesses are same.

12. The panel according to claim 6, wherein:

a protruding dimension of the protrusions and a recessing dimension of the recesses respectively in a direction perpendicular to the reference surface are same.

13. The panel according to claim 6, wherein a frame section is provided along a periphery of the panel, which includes all of the protrusions, and the recesses.

* * * * *